United States Patent [19]

Kirmser et al.

[11] 4,096,934

[45] Jun. 27, 1978

Best Available Copy

[54] METHOD AND APPARATUS FOR REPRODUCING DESIRED IDEOGRAPHS

[76] Inventors: Philip George Kirmser, 1009 Michael Rd.; Kuo-Kuang Hu, 925 Mission Ave., both of Manhattan, Kans. 66502

[21] Appl. No.: 622,773

[22] Filed: Oct. 15, 1975

[51] Int. Cl.[2] ..... B41J 1/52

[52] U.S. Cl. ..... 400/110; 400/102

[58] Field of Search ..... 197/1 A, 98, 53, 54; 235/145, 146; 340/172.5; 178/25, 17 R, 17 A, 17 B, 33; 364/900

[56] References Cited

U.S. PATENT DOCUMENTS

| | | | |
|---|---|---|---|
| 3,640,369 | 2/1972 | Rolph | 197/54 |
| 3,781,809 | 12/1973 | Murakoshi et al. | 340/172.5 |
| 3,809,203 | 5/1974 | Ogawa et al. | 197/1 A |
| 3,809,204 | 5/1974 | Ogawa | 197/1 A |
| 3,820,644 | 6/1974 | Yeh | 197/1 A |
| 3,852,720 | 12/1974 | Park | 340/172.5 |
| 3,909,796 | 9/1975 | Kitamura | 340/172.5 |
| 3,913,722 | 10/1975 | Bowdle et al. | 197/54 |
| 3,938,099 | 2/1976 | Hyder | 340/172.5 |
| 3,947,825 | 3/1976 | Cassada | 340/172.5 |
| 3,950,734 | 4/1976 | Li | 340/172.5 |

*Primary Examiner*—Paul T. Sewell
*Attorney, Agent, or Firm*—Mason, Fenwick and Lawrence

[57] ABSTRACT

A method and apparatus for reproducing desired Chinese ideographs using standard typewriter keyboard bearing phonetic symbols is disclosed for typing, typesetting and composing, transmissions of telegrams in computer languages and the like including the steps of coding ideographs by their phonetic spelling and characteristic identification to uniquely identify each ideograph, storing the coded information, inputing the phonetic spelling of a desired ideograph, inputing characteristic identification of the desired ideograph, identifying the desired ideograph based on the stored information and the input information, and reproducing the desired ideograph thereby permitting the use of a conventional keyboard to print Chinese ideographs without requiring any additional means for selecting the desired ideograph.

30 Claims, 25 Drawing Figures

圖18-2

Correspondences Between the Chinese and International Phonetic Alphabets with Approximate English Equivalents

| Vowels | | | Consonants | | |
|---|---|---|---|---|---|
| Chinese | International | English | Chinese | International | English |
| ㄧ | i | IY | ㄉ | d | D |
| ㄨ | u | UW | ㄕ | ʂ | SH (SHZ)* |
| ㄢ | an | AN | ㄐ | dɕ | GEE* |
| ㄜ | ə | E | ㄌ | l | L |
| ㄥ | əŋ | ENG (UENG) | ㄓ | dʐ (dʑ) | J (JZ)* |
| ㄣ | n | EN | ㄑ | ɕ | (she sound)* |
| ㄚ | a | A | ㄏ | h | H* |
| ㄠ | au | AU | ㄍ | g | G |
| ㄤ | a | ANG | ㄊ | t | T |
| ㄛ | o | O | ㄇ | m | M |
| ㄡ | ou | OU | ㄗ | dz | TZ (DZ)* |
| ㄩ | y | UI | ㄔ | tɕ | CHI* |
| ㄞ | ai | AI | ㄋ | n | N |
| ㄟ | ei | EI | ㄈ | f | F |
| ㄝ | e | E (E) YEH | ㄘ | tʂ | CH* |
| ㄦ | ɚ | EL (ER) | ㄖ | ʐ | ZH* |
| | | | ㄎ | k | K |
| | | | ㄙ | s | S* |
| | | | ㄅ | b | B |
| | | | ㄘ | ts | TS* |
| | | | ㄆ | p | P |

*voiced

圖18-3-1

Examples of Coding for Brush Strokes which Resemble the Phonetic Symbols

| Code | Strokes | Examples |
|---|---|---|
| ㄅ | 勹 | 丐 |
| | 勹 | 均包易句 |
| ㄨ | 夂 | 敎做放效 |
| | 文 | 文斑紊閔 |
| | 夂 | 各路務 |
| | 夕 | 夕多名外死 |
| | 夕,夕 | 夜液掖瑤 |
| | 久 | 久畝玖 |
| ㄇ | 冂 | 過凸且 |
| | 冂 | 皿血 |
| | 冂 | 同用尚角兩 |
| | 内 | 内納病丙 |
| | 肉 | 肉腐 |
| | 冖 | 冠冥冪 |
| | 宀 | 家寶寶窮鶴 |
| | 凵 | 鴦攜 |
| ㄈ | 匚 | 區巨匯瀝醫 |
| | 匸 | 虐瘧 |
| | 彐 | 婦雪歸帚 |
| ㄉ | 刀 | 刀分切召 |
| | 刂 | 別則前副 |
| | 刃 | 刃 |
| | 力 | 別 |
| | 力 | 力另勳賁 |

| Code | Strokes | Examples |
|---|---|---|
| ㄉ | 刃 | 刃忍 |
| | 刄 | 鞦 |
| | 刃 | 那 |
| ㄋ | 了 | 了亭 |
| | 丁,丁 | 亟承亟 |
| | 乃 | 乃仍及攜 |
| ㄍ | 巛 | 災巢巡 |
| ㄎ | 丂 | 攷鄂聘粵 |
| | 丂 | 號 |
| | 丂 | 汚鄂 |
| | 丂 | 考與舉 |
| ㄏ | 厂 | 歷辰振 |
| | 广 | 店 |
| | 厂 | 虎處 |
| | 尸 | 皮被皺 |
| ㄐ | 丩 | 叫收糾 |
| | 丬 | 將牀牆藏 |
| | 爿 | 鼎 |
| ㄑ | 亻 | 灰所派 |
| | 亻 | 段 |
| | 氏 | 氏氏砥 |
| | 亻 | 兵兵兵 |
| | 卯, | 留劉 |
| | 卯, | 卿卯 |

王18-3-2

| Code | Strokes | Examples |
|---|---|---|
| 丅 | 丅 | 介兵新巫片 |
| | 下,下 | 下卡斥 |
| | 丁 | 丁訂釘寧 |
| | 丁 | 予序 |
| | 卜 | 虎占上桌卡 |
| | 上 | 片 |
| | 卜 | 昨作 |
| 屮 | 出 | 出樂屈 |
| | 少 | 朔皺 |
| | 屯 | 屯頓邨 |
| | 止,止 | 止步此武歸 |
| 彳 | 彳 | 彼後行 |
| | 彡 | 杉衫彬須髮 |
| 尸 | 尸 | 尸屋居尺局 |
| | 户 | 户房扁扇 |
| | 尸 | 眉楣 |
| | 尸 | 倉創蒼 |
| | 尹 | 君群尹 |
| | 尸 | 霞 |
| | 吕 | 富 |
| | 㠯 | 師帥薛 |
| | 巳 | 民抿改 |
| | 尸,尸 | 巳己杞 |
| | 巴 | 巴把吧 |

| Code | Strokes | Examples |
|---|---|---|
| 日 | 日 | 日時陽易 |
| | 曰 | 書曰 |
| 卩 | 卩 | 即節報 |
| | 阝 | 改 |
| 厶 | 厶 | 私公去酸 |
| 廿 | 廿 | 草甘廿 |
| | 世 | 世諜屁 |
| | 卅 | 帶滯 |
| | 也 | 也地牠 |
| | 廾 | 奔弊其共 |
| | 艹 | 草花 |
| | 丱 | 聯關 |
| | 小 | 兼謙廉 |
| | 小 | 亦 |
| | 业 | 業叢 |
| | 开 | 開刑形型 |
| | 丹 | 丹彤溥 |
| | 冊 | 冊刪柵 |
| | 卅 | 卅 |
| | 井 | 井曲阱講 |
| | 弗 | 弗佛費 |
| 牙 | 牙 | 牙雅穿 |
| 幺 | 幺 | 幼幻後 |
| | 乡 | 鄉嚮 |

| Code | Strokes | Examples |
|---|---|---|
| 又 | 又 | 又投没後夏 |
| | 叉 | 叉蚤騷 |
| | マ | 予務令疑 |
| 勹 | 勹 | 角魚免危晚 |
| 尤 | 尤 | 尬尷 |
| | 尤 | 尤就 |
| | 兊 | 既概 |
| | 冗 | 沈挑酬 |
| | 九 | 九旭拋 |
| | 丸 | 丸紈 |
| 乙 | 乙 | 瓦 |
| | 乚 | 歐丙 |
| | 乚 | 亡甚 |
| 乂 | 乂 | 殺駁 |
| | 十 | 十古傘早干 |
| | 丰 | 用靜解傑牛 |
| | 冂 | 有友右 |
| | 夫 | 夫扶拜 |
| | 夫 | 春奉奏 |
| | 丰,丰,丰 | 蜂丰拜 |
| | 中 | 中貴仲 |
| | 申 | 申伸呻 |
| | 串 | 串患 |
| | 屮 | 韋偉 |
| | 韋,韋,韋 | 書盡律津東 |

| Code | Strokes | Examples |
|---|---|---|
| 巾 | 巾 | 布市帳巾 |
| | 廴 | 延建 |
| | 事 | 事 |
| | 米 | 米糧釋 |
| 凵 | 凵 | 凹豐瑤罐 |
| | 山 | 山崇峻端 |
| 几 | 几 | 几飢抗 |
| | 儿,儿 | 兄光鬼兀 |
| | 几 | 朵没段 |
| | 凡,凡 | 凡凡帆帆 |
| | 凵 | 風鳳瘋 |

王18-4-1 Coding When the Phonetic Symbol is an Abbreviation of the Name of the Brush Stroke

| Code | Brush Strokes Basic | Brush Strokes Extension | Pronunciation | Examples |
|---|---|---|---|---|
| ㄅ | 八 | | ㄅㄚ | 八公分盆 |
| | | 入 | | 入全 |
| | | 人 | | 人大夫走足 |
| | | 亼 | | 會今合令 |
| | | 丿 | | 館從以 |
| | | 𠂉 | | 午旋缸 |
| | | 八 | | 共其公期 |
| | | 丷 | | 美羊前養說翔 |
| | 必 | | ㄅㄧ | 必祕泌瑟 |
| | 貝 | | ㄅㄟ | 貝則責嬰 |
| | | 頁 | | 頁頭題 |
| ㄆ | 丿 | | ㄆㄧㄝˇ | 牛白任鬼乎樂自 |
| | 丿 | | | 片夏愛變班 |
| ㄇ | 木 | 木,朩 | ㄇㄨ | 木校樣架 |
| | | 朮 | | 朮 |
| | 門 | | ㄇㄣ | 門開間問 |
| | | 鬥 | | 鬥鬧關 |
| ㄈ | 方 | | ㄈㄤ | 方放於敷堃 |
| | 囗 | | ㄈㄨㄛㄍㄨㄛˊ | 國固圓園團 |
| | | 田 | | 田異畝塊畜漯 |
| | | 冋,回 | | 回徊迴 |
| | | 四 | | 四 |
| | | 罒,四 | | 罷羅罰兒 |
| | | 目 | | 目眼盯 |

| Code | Brush Strokes Basic | Brush Strokes Extension | Pronunciation | Examples |
|---|---|---|---|---|
| ㄉ | 丶 | | ㄉㄧㄣˇ | 之然主拔 |
| | | 乀 | | 之 |
| | 石 | | ㄉㄢˋ | 石研破拓宕 |
| ㄊ | 土 | | ㄊㄨˇ | 土幸壁坐 |
| | | 土 | | 地城塊增 |
| | | 十 | | 切 |
| | | 士 | | 士吉仕賣 |
| | | 夂 | | 者教孝 |
| ㄋ | 女 | | ㄋㄩˇ | 女婆嬰安 |
| | | 女 | | 好媽如恕 |
| | 鳥 | | ㄋㄧㄠˇ | 鳥鷄鳳鵬鷹 |
| | | 鳥 | | 鳥 |
| | | 烏 | | 烏塢鵝 |
| ㄌ | 立 | | ㄌㄧˋ | 立位意億莅 |
| | | 立 | | 端 |
| | | 亠 | | 六交效忘京 |
| | 畾 | | ㄌㄟˇ | 畾纍儡壘 |
| ㄐ | 乚 | | ㄐㄨ | 巴已己電 |
| | | 乙 | | 乙乞吃 |
| | | 匕,匕 | | 化尼匕它 |
| | | 七,七 | | 七宅 |
| | | 匕 | | 能比 |
| | | 匕 | | 些比 |
| | | 匕 | | 頃比鼠 |
| | | 丫 | | 以 |

王18-4-2

| Code | Brush Strokes Basic | Brush Strokes Extension | Pronunciation | Examples |
|---|---|---|---|---|
| ㄐ | 金 | 金 | ㄐㄧㄣ | 金鏟銅鐵鍊 |
| | 見 | | ㄐㄧㄢˋ | 見親現窺 |
| | 匊 | | ㄐㄩˊ | 菊鞠掬 |
| | 癶 | | ㄐㄧˋ | 祭際 |
| | | 癶 | | 發撥潑 |
| | 厂 | | ㄐㄧㄠ | 長髮賬 |
| ㄑ | 欠 | | ㄑㄧㄢˋ | 欠歉吹款歎 |
| | 犬 | | ㄑㄩㄢˇ | 犬伏然哭類 |
| | | 犭 | | 狗狼犯猛 |
| | | 豕,豕 | | 家象豬 |
| | | 豸 | | 貓豹 |
| ㄒ | 心 | | ㄒㄧㄣ | 心沁忠恕惡 |
| | | 忄,忄 | | 情性慱快怪 |
| ㄓ | 丨 | | ㄓˊ | 州洲 |
| | | 卜,卜 | | 卜外卧朴 |
| | 隹 | | ㄓㄨㄟ | 雖推集雄誰雙 |
| | 舟 | | ㄓㄡ | 舟船般航 |
| | 竹 | 𥫗 | ㄓㄨ | 竹第等答笑 |
| | 辶 | | ㄓ | 進退遠近 |
| | 止 | 止 | ㄓˇ | 止正此歸 |
| ㄔ | 臣 | | ㄔㄣˊ | 臣賢宦卧 |
| ㄕ | 身 | | ㄕㄣ | 身射躬窮 |
| | 扌 | | ㄕㄡˇ | 把打推拉紮 |
| ㄗ | 子 | | ㄗˋ | 子好字孟猛存滸 |

| Code | Brush Strokes Basic | Brush Strokes Extension | Pronunciation | Examples |
|---|---|---|---|---|
| ㄅ | 鼠 | | ㄅㄨㄣˇ | 鼠 |
| | 曳 | | | 曳 |
| | 代 | 代 | | 代民鳶 |
| | 瓦 | | ㄅㄨㄚˇ | 瓦 |
| | 飛 | 飛 | | 飛 |
| | 于 | | ㄅㄨˋ | 于手乎爭事姊 |
| | 今 | | ㄅㄨㄣ | 今 |
| | 疋 | 疋 | | 疋蟠 |
| | 局 | | ㄅㄨˋ | 局 |
| | 羽 | 羽 | | 羽翼扇翅 |
| | 弓 | | ㄅㄨㄥˊ | 弓躬強窮穹 |
| | 弱 | 弱 | | 弱溺 |
| | 疆 | 疆 | | 疆 |
| | 戈 | | ㄅㄨㄛ | 戈成伐淺箋 |
| | 戉 | 戉 | | 戉 |
| | 艮 | | ㄅㄣˋ | 根跟垠很恨 |
| | 即 | 即 | | 即節 |
| | 郎 | 郎 | | 郎朗 |
| | 良 | 良 | | 良粮娘 |
| | 飠 | 飠 | | 飯飽飢餓 |
| | 食 | 食 | | 食餐 |
| ㄅ | 口 | | ㄅㄨˋ | 口號哭倡古估固 |
| ㄅ | 臼 | | ㄅㄧㄡˋ | 臼舅兒舊 |
| | | 臼 | | 臼 |

FIG-4-3

| Code | Brush Strokes Basic | Brush Strokes Extension | Pronunciation | Examples |
|---|---|---|---|---|
| ㄗ | | 子 | | 子孔孩孤勅 |
| | | 孑 | | 孑 |
| | 足 | | ㄗㄨˋ | 路跟跡跑 |
| | | 疋 | | 疏蔬 |
| ㄘ | 寸 | | ㄘㄨㄣˋ | 寸付村等專將 |
| ㄙ | 糸 | | ㄙ | 絲經紅線 |
| | | 糸 | | 索累繫纍 |
| | | 系 | | 系係縣 |
| ㄚ | 爪 | | ㄓㄨㄚ | 爪爬抓 |
| | | 爫 | | 爭爵采遥稻愛 |
| | 瓜 | | ㄍㄨㄚ | 瓜孤弧瓣 |
| | 馬 | | ㄇㄚ | 馬媽罵駁 |
| | | 馬,焉 | | 焉焉 |
| ㄛ | 火 | | ㄈㄨㄛ | 火燒秋淡淡痰 |
| | | 灬 | | 然魚熬烹煮 |
| ㄜ | 車 | | ㄔㄜ | 車轉軍 |
| | | 叀 | | 專傳擊惠 |
| | 禾 | | ㄊㄜˊ | 禾穌秀 |
| | | 禾 | | 和秋穫 |
| | | 禾,禾 | | 余茶穀 |
| ㄝ | 列 | | ㄌㄧㄝˋ | 列例烈裂 |
| ㄞ | 才 | | ㄘㄞˊ | 才材 |
| ㄟ | 水 | | ㄈㄨㄟˇ | 水冰漿 |
| | | 氷 | | 求泰暴隷 |

| Code | Brush Strokes Basic | Brush Strokes Extension | Pronunciation | Examples |
|---|---|---|---|---|
| ㄠ | | 小 | | 慕添 |
| | | 氵 | | 永泳詠 |
| | 氵 | | | 河江海沙灘 |
| | 北 | | ㄅㄟˇ | 北背揹 |
| | 非 | | ㄈㄟ | 非輩菲悲徘 |
| ㄡ | 小 | | ㄒㄧㄡˇ | 小尖原 |
| | | 小 | | 光肖消顯半脊 |
| | | 丬 | | 來乘業朱東象 |
| | 少 | | ㄕㄠˋ | 少沙妙杪紗 |
| | | 少 | | 步頻 |
| | 毛 | | ㄇㄠˊ | 毛毯鬆撓 |
| | 囱 | | | 粤 |
| | | 囱 | ㄍㄨㄥ | 奥懊澳襖 |
| ㄡ | 牛 | | ㄨㄧㄡˊ | 物牠犧 |
| ㄢ | 言 | | ㄧㄢˊ | 言說請響 |
| ㄣ | 亻 | | ㄅㄣˋ | 住信仁侍 |
| ㄤ | 王 | | ㄨㄤ | 王全琶住 |
| | | 王 | | 現理碧玩 |
| | | 玉 | | 玉璧瑩 |
| ㄥ | 工 | 工 | ㄍㄨㄥ | 工左巧差 |
| | | 工 | | 候 |
| | 冫 | | ㄅㄧㄥ | 冰冷凜 |
| | | 冫 | | 冬於 |

圭18-4-4

| Code | Brush Strokes Basic | Brush Strokes Extension | Pronunciation | Examples |
|---|---|---|---|---|
| ㄥ | 虫 | | ㄔㄨㄥˇ | 虫蟲蜂螢蠅 |
| | 疒 | | ㄅㄧㄥˋ | 病痛痢疾 |
| | 黽 | | | 蠅 |
| | | 黽 | | 竈 |
| | | 黽 | | 黽 |
| ㄦ | 耳 | 耳 | ㄦˇ | 耳聲耶聆聞 |
| | | 聽 | | 聽敢聽 |
| | 阝 | | | 陳陽阻邦郵都 |
| ㄧ | 一 | 一 | ㄧ | 並平血融巫五月靈 |
| | 衣 | | ㄧ | 衣裳 |
| | | 衣 | | 裏表 |
| | | 衣 | | 旅派 |
| | | 衣 | | 長喪 |
| | 衤 | | ㄧ | 初衫袖被 |
| | | 衤 | | 社神祖 |
| ㄨ | 毋 | | ㄨ | 毋毒 |
| | 母 | | ㄇㄨˇ | 母每姆毒 |
| | 麀 | | ㄌㄨˋ | 麀麟麋麤 |
| | 為 | | ㄨㄟˊ | 為偽 |
| ㄩ | 月 | | ㄩㄝˋ | 月明朝期 |
| | | 月 | | 肌肥胸 |
| | 雨 | | ㄩˇ | 雨雷雲靈 |

圭18-5

Characters of the Special Category which are Coded by a Single Keystroke

| Character | 的 | 一 | 不 | 是 | 了 |
|---|---|---|---|---|---|
| Code | ㄉ | ㄧ | ㄅ | ㄕ | ㄌ or ㄋ* |
| Pronunciation or Explanation | ㄉㄜ˙ | ㄧ | ㄅㄨˋ | ㄕˋ | ㄌㄜ˙ The shape of the phonetic symbol is the same as the character ㄋ . |

*Both codings are allowed for.

圭18-6

Pronouns which are Coded Phonetically Only

| Character | 我 | 你 | 他 | 們 |
|---|---|---|---|---|
| Code | ㄨㄛ | ㄋㄧ | ㄊㄚ | ㄇㄣ |
| Pronunciation | ㄨㄛˇ | ㄋㄧˇ | ㄊㄚ | ㄇㄣ˙ |

圭18-7

Coding of Characters in the Exceptional Category

| Character | Code | Radical | The Conflicting Character |
|---|---|---|---|
| 候 | ㄏㄡㄣ | 亻 ㄩㄣ | 候 ㄏㄡㄅㄣㄅ |
| 屁 | ㄆㄧㄈ | 尸 ㄈ | 批 ㄆㄧㄈㄐ |
| 胛 | ㄐㄧㄚㄩㄝ | 月 ㄩㄝ | 岬 ㄐㄧㄚㄩㄈㄨ |
| 罟 | ㄍㄨㄈㄆ | 四 ㄈㄆ | 固 ㄍㄨㄈㄅ |
| 閘 | ㄏㄅㄇㄣ | 門 ㄇㄣ | 罕 ㄏㄅㄇㄨ |
| 麤 | ㄓㄆㄌㄨㄨ | 麀 ㄌㄨ | 丈 ㄓㄆㄨㄨ 章 ㄓㄆㄌㄨ |
| 蚪 | ㄌㄡㄅㄨㄥ | 虫 ㄔㄨㄥ | 斗 ㄌㄡㄥㄨ |
| 伊 | ㄧㄣㄣ | 亻 ㄩㄣ | 尹 ㄧㄣㄈ |
| 蜊 | ㄌㄧㄔㄨㄥ | 虫 ㄔㄨㄥ | 痢 ㄌㄧㄥㄌ |
| 賡 | ㄍㄥㄍㄥ | 庚 ㄍㄥ | 庚 ㄍㄥㄅㄅ |

FIG-8

Optional Coding for Frequently Used Characters

| | | | | | | | | | | | |
|---|---|---|---|---|---|---|---|---|---|---|---|
| 有 | ㄧㄡ | 天 | ㄊㄧㄢ | 竹 | ㄓㄨㄛ | 兩 | ㄌㄧㄤ | 此 | ㄘ | 官 | ㄍㄨㄢ |
| 人 | ㄖㄣ | 去 | ㄑㄩ | 面 | ㄇㄧㄢ | 從 | ㄘㄨㄥ | 些 | ㄒㄧㄝ | 圖 | ㄊㄨ |
| 在 | ㄗㄞ | 學 | ㄒㄩㄝ | 能 | ㄋㄥ | 然 | ㄖㄢ | 吃 | ㄔ | 情 | ㄑㄧㄥ |
| 上 | ㄕㄤ | 家 | ㄐㄧㄚ | 沒 | ㄇㄛ | 因 | ㄧㄣ | 幾 | ㄐㄧ | 怎 | ㄗㄣ |
| 國 | ㄍㄨㄛ | 裏 | ㄌㄧ | 本 | ㄅㄣ | 分 | ㄈㄣ | 常 | ㄔㄤ | 向 | ㄒㄧㄤ |
| 來 | ㄌㄞ | 好 | ㄏㄠ | 長 | ㄓㄤ | 心 | ㄒㄧㄣ | 高 | ㄍㄠ | 原 | ㄩㄢ |
| 這 | ㄓㄜ | 都 | ㄉㄨ | 起 | ㄑㄧ | 經 | ㄐㄧㄥ | 最 | ㄗㄨㄟ | 平 | ㄆㄧㄥ |
| 大 | ㄉㄚ | 會 | ㄏㄨㄟ | 行 | ㄒㄧㄥ | 對 | ㄉㄨㄟ | 南 | ㄋㄢ | 活 | ㄏㄨㄛ |
| 說 | ㄕㄨㄛ | 下 | ㄒㄧㄚ | 見 | ㄐㄧㄢ | 什 | ㄕㄜ | 山 | ㄕㄢ | 書 | ㄕㄨ |
| 小 | ㄒㄧㄠ | 麼 | ㄇㄜ | 民 | ㄇㄧㄣ | 六 | ㄌㄧㄡ | 白 | ㄅㄞ | 報 | ㄅㄠ |
| 個 | ㄍㄜ | 年 | ㄋㄧㄢ | 做 | ㄗㄨㄛ | 便 | ㄅㄧㄢ | 應 | ㄧㄥ | 並 | ㄅㄧㄥ |
| 到 | ㄉㄠ | 出 | ㄔㄨ | 於 | ㄩ | 頭 | ㄊㄡ | 進 | ㄐㄧㄣ | 快 | ㄎㄨㄞ |
| 子 | ㄗ | 多 | ㄉㄨㄛ | 還 | ㄏㄞ | 東 | ㄉㄨㄥ | 走 | ㄗㄡ | 體 | ㄊㄧ |
| 二 | ㄦ | 用 | ㄩㄥ | 法 | ㄈㄚ | 外 | ㄨㄞ | 女 | ㄋㄩ | 畢 | ㄅㄧㄣ |
| 要 | ㄧㄠ | 看 | ㄎㄢ | 老 | ㄌㄠ | 月 | ㄩㄝ | 政 | ㄓㄥ | 車 | ㄔㄜ |
| 就 | ㄐㄧㄡ | 四 | ㄙ | 成 | ㄔㄥ | 等 | ㄉㄥ | 將 | ㄐㄧㄤ | 親 | ㄑㄧㄣ |
| 中 | ㄓㄨㄥ | 為 | ㄨㄟ | 如 | ㄖㄨ | 公 | ㄍㄨㄥ | 太 | ㄊㄞ | 母 | ㄇㄨ |
| 可 | ㄎㄜ | 日 | ㄖ | 同 | ㄊㄨㄥ | 主 | ㄓㄨ | 手 | ㄕㄡ | 少 | ㄕㄠ |
| 和 | ㄏㄜ | 根 | ㄍㄣ | 西 | ㄒㄧ | 當 | ㄉㄤ | 給 | ㄍㄟ | 總 | ㄗㄨㄥ |
| 全 | ㄑㄩㄢ | 五 | ㄨ | 教 | ㄐㄧㄠ | 開 | ㄎㄞ | 呢 | ㄋㄜ | 比 | ㄅㄧ |
| 那 | ㄋㄚ | 後 | ㄏㄡ | 前 | ㄑㄧㄢ | 定 | ㄉㄧㄥ | 口 | ㄎㄡ | 安 | ㄢ |
| 也 | ㄧㄝ | 方 | ㄈㄤ | 明 | ㄇㄧㄥ | 話 | ㄏㄨㄚ | 路 | ㄌㄨ | 內 | ㄋㄟ |
| 三 | ㄙㄢ | 把 | ㄅㄚ | 問 | ㄨㄣ | 先 | ㄒㄧㄢ | 點 | ㄉㄧㄢ | 許 | ㄒㄩ |
| 地 | ㄉㄧ | 樣 | ㄧㄤ | 水 | ㄕㄨㄟ | 但 | ㄉㄢ | 聽 | ㄊㄧㄥ | 表 | ㄅㄧㄠ |
| 生 | ㄕㄥ | 之 | ㄓ | 動 | ㄉㄨㄥ | 北 | ㄅㄟ | 真 | ㄓㄣ | 光 | ㄍㄨㄤ |

| | | | |
|---|---|---|---|
| 別 | ㄅㄧㄝ | | |
| 王 | ㄨㄤ | | |
| 條 | ㄊㄧㄠ | | |
| 媽 | ㄇㄚ | | |
| 愛 | ㄞ | | |
| 才 | ㄘㄞ | | |
| 空 | ㄎㄨㄥ | | |
| 夫 | ㄈㄨ | | |
| 代 | ㄉㄞ | | |
| 故 | ㄍㄨ | | |
| 界 | ㄐㄧㄝ | | |
| 風 | ㄈㄥ | | |
| 及 | ㄐㄧ | | |
| 萬 | ㄨㄢ | | |
| 求 | ㄑㄧㄡ | | |
| 且 | ㄑㄧㄝ | | |
| 林 | ㄌㄧㄣ | | |
| 飛 | ㄈㄟ | | |
| 覺 | ㄐㄩㄝ | | |
| 樂 | ㄌㄜ | | |

王18-9-1

The Nearly Maximum Possible Optional Coding List
(Standard Pronunciation is Required)

| | |
|---|---|
| 跨 | ㄎㄨㄚ |
| 括 | ㄎㄨㄛ |
| 快 | ㄎㄨㄞ |
| 虧 | ㄎㄨㄟ |
| 款 | ㄎㄨㄢ |
| 困 | ㄎㄨㄣ |
| 礦 | ㄎㄨㄤ |
| 空 | ㄎㄨㄥ |
| 哈 | ㄏㄚ |
| 和 | ㄏㄜ |
| 還 | ㄏㄞ |
| 黑 | ㄏㄟ |
| 好 | ㄏㄠ |
| 後 | ㄏㄡ |
| 漢 | ㄏㄢ |
| 很 | ㄏㄣ |
| 航 | ㄏㄤ |
| 橫 | ㄏㄥ |
| 湖 | ㄏㄨ |
| 話 | ㄏㄨㄚ |
| 活 | ㄏㄨㄛ |
| 壞 | ㄏㄨㄞ |
| 會 | ㄏㄨㄟ |
| 歡 | ㄏㄨㄢ |
| 婚 | ㄏㄨㄣ |
| 高 | ㄍㄠ |
| 夠 | ㄍㄡ |
| 感 | ㄍㄢ |
| 跟 | ㄍㄣ |
| 港 | ㄍㄤ |
| 更 | ㄍㄥ |
| 故 | ㄍㄨ |
| 掛 | ㄍㄨㄚ |
| 國 | ㄍㄨㄛ |
| 怪 | ㄍㄨㄞ |
| 規 | ㄍㄨㄟ |
| 官 | ㄍㄨㄢ |
| 滾 | ㄍㄨㄣ |
| 光 | ㄍㄨㄤ |
| 公 | ㄍㄨㄥ |
| 卡 | ㄎㄚ |
| 可 | ㄎㄜ |
| 開 | ㄎㄞ |
| 考 | ㄎㄠ |
| 口 | ㄎㄡ |
| 看 | ㄎㄢ |
| 肯 | ㄎㄣ |
| 抗 | ㄎㄤ |
| 坑 | ㄎㄥ |
| 苦 | ㄎㄨ |
| 蘭 | ㄌㄢ |
| 浪 | ㄌㄤ |
| 冷 | ㄌㄥ |
| 裏 | ㄌㄧ |
| 倆 | ㄌㄧㄚ |
| 列 | ㄌㄧㄝ |
| 料 | ㄌㄧㄠ |
| 六 | ㄌㄧㄡ |
| 連 | ㄌㄧㄢ |
| 林 | ㄌㄧㄣ |
| 兩 | ㄌㄧㄤ |
| 領 | ㄌㄧㄥ |
| 路 | ㄌㄨ |
| 羅 | ㄌㄨㄛ |
| 亂 | ㄌㄨㄢ |
| 論 | ㄌㄨㄣ |
| 龍 | ㄌㄨㄥ |
| 律 | ㄌㄩ |
| 略 | ㄌㄩㄝ |
| 攣 | ㄌㄩㄢ |
| 淋 | ㄌㄩㄣ |
| 噶 | ㄍㄚ |
| 個 | ㄍㄜ |
| 該 | ㄍㄞ |
| 給 | ㄍㄟ |
| 內 | ㄋㄟ |
| 腦 | ㄋㄠ |
| 南 | ㄋㄢ |
| 嫩 | ㄋㄣ |
| 農 | ㄋㄤ |
| 能 | ㄋㄥ |
| 揑 | ㄋㄧㄝ |
| 鳥 | ㄋㄧㄠ |
| 牛 | ㄋㄧㄡ |
| 年 | ㄋㄧㄢ |
| 您 | ㄋㄧㄣ |
| 娘 | ㄋㄧㄤ |
| 寧 | ㄋㄧㄥ |
| 努 | ㄋㄨ |
| 娜 | ㄋㄨㄛ |
| 暖 | ㄋㄨㄢ |
| 農 | ㄋㄨㄥ |
| 女 | ㄋㄩ |
| 瘧 | ㄋㄩㄝ |
| 拉 | ㄌㄚ |
| 咯 | ㄌㄛ |
| 樂 | ㄌㄜ |
| 來 | ㄌㄞ |
| 類 | ㄌㄟ |
| 老 | ㄌㄠ |
| 樓 | ㄌㄡ |
| 對 | ㄉㄨㄟ |
| 端 | ㄉㄨㄢ |
| 頓 | ㄉㄨㄣ |
| 動 | ㄉㄨㄥ |
| 特 | ㄊㄜ |
| 太 | ㄊㄞ |
| 討 | ㄊㄠ |
| 頭 | ㄊㄡ |
| 談 | ㄊㄢ |
| 糖 | ㄊㄤ |
| 疼 | ㄊㄥ |
| 體 | ㄊㄧ |
| 鐵 | ㄊㄧㄝ |
| 條 | ㄊㄧㄠ |
| 天 | ㄊㄧㄢ |
| 聽 | ㄊㄧㄥ |
| 團 | ㄊㄨ |
| 脫 | ㄊㄨㄛ |
| 推 | ㄊㄨㄟ |
| 團 | ㄊㄨㄢ |
| 吞 | ㄊㄨㄣ |
| 同 | ㄊㄨㄥ |
| 那 | ㄋㄚ |
| 呢 | ㄋㄜ |
| 乃 | ㄋㄞ |
| 法 | ㄈㄚ |
| 佛 | ㄈㄛ |
| 飛 | ㄈㄟ |
| 否 | ㄈㄡ |
| 飲 | ㄈㄣ |
| 分 | ㄈㄣ |
| 方 | ㄈㄤ |
| 風 | ㄈㄥ |
| 夫 | ㄈㄨ |
| 大 | ㄉㄚ |
| 得 | ㄉㄜ |
| 代 | ㄉㄞ |
| 到 | ㄉㄠ |
| 都 | ㄉㄡ |
| 但 | ㄉㄢ |
| 當 | ㄉㄤ |
| 等 | ㄉㄥ |
| 地 | ㄉㄧ |
| 爹 | ㄉㄧㄝ |
| 調 | ㄉㄧㄠ |
| 丟 | ㄉㄧㄡ |
| 點 | ㄉㄧㄢ |
| 定 | ㄉㄧㄥ |
| 度 | ㄉㄨ |
| 多 | ㄉㄨㄛ |
| 朋 | ㄆㄥ |
| 皮 | ㄆㄧ |
| 瞥 | ㄆㄧㄝ |
| 票 | ㄆㄧㄠ |
| 片 | ㄆㄧㄢ |
| 品 | ㄆㄧㄣ |
| 平 | ㄆㄧㄥ |
| 普 | ㄆㄨ |
| 媽 | ㄇㄚ |
| 模 | ㄇㄛ |
| 麼 | ㄇㄜ |
| 買 | ㄇㄞ |
| 沒 | ㄇㄟ |
| 毛 | ㄇㄠ |
| 謀 | ㄇㄡ |
| 滿 | ㄇㄢ |
| 忙 | ㄇㄤ |
| 蒙 | ㄇㄥ |
| 米 | ㄇㄧ |
| 滅 | ㄇㄧㄝ |
| 苗 | ㄇㄧㄠ |
| 面 | ㄇㄧㄢ |
| 民 | ㄇㄧㄣ |
| 明 | ㄇㄧㄥ |
| 母 | ㄇㄨ |
| 把 | ㄅㄚ |
| 播 | ㄅㄛ |
| 白 | ㄅㄞ |
| 北 | ㄅㄟ |
| 報 | ㄅㄠ |
| 辦 | ㄅㄢ |
| 本 | ㄅㄣ |
| 幫 | ㄅㄤ |
| 崩 | ㄅㄥ |
| 比 | ㄅㄧ |
| 別 | ㄅㄧㄝ |
| 表 | ㄅㄧㄠ |
| 便 | ㄅㄧㄢ |
| 賓 | ㄅㄧㄣ |
| 並 | ㄅㄧㄥ |
| 部 | ㄅㄨ |
| 怕 | ㄆㄚ |
| 破 | ㄆㄛ |
| 派 | ㄆㄞ |
| 配 | ㄆㄟ |
| 跑 | ㄆㄠ |
| 剖 | ㄆㄡ |
| 盤 | ㄆㄢ |
| 盆 | ㄆㄣ |
| 旁 | ㄆㄤ |

王18-9-1

The Nearly Maximum Possible Optional Coding List
(Standard Pronunciation is Required)

| | |
|---|---|
| 跨 | ㄎㄨㄚ |
| 括 | ㄎㄨㄛ |
| 快 | ㄎㄨㄞ |
| 虧 | ㄎㄨㄟ |
| 款 | ㄎㄨㄢ |
| 困 | ㄎㄨㄣ |
| 礦 | ㄎㄨㄤ |
| 空 | ㄎㄨㄥ |
| 哈 | ㄏㄚ |
| 和 | ㄏㄜ |
| 還 | ㄏㄞ |
| 黑 | ㄏㄟ |
| 好 | ㄏㄠ |
| 後 | ㄏㄡ |
| 漢 | ㄏㄢ |
| 很 | ㄏㄣ |
| 航 | ㄏㄤ |
| 橫 | ㄏㄥ |
| 湖 | ㄏㄨ |
| 話 | ㄏㄨㄚ |
| 活 | ㄏㄨㄛ |
| 壞 | ㄏㄨㄞ |
| 會 | ㄏㄨㄟ |
| 歡 | ㄏㄨㄢ |
| 婚 | ㄏㄨㄣ |
| 高 | ㄍㄠ |
| 夠 | ㄍㄡ |
| 感 | ㄍㄢ |
| 跟 | ㄍㄣ |
| 港 | ㄍㄤ |
| 更 | ㄍㄥ |
| 故 | ㄍㄨ |
| 掛 | ㄍㄨㄚ |
| 國 | ㄍㄨㄛ |
| 怪 | ㄍㄨㄞ |
| 規 | ㄍㄨㄟ |
| 官 | ㄍㄨㄢ |
| 滾 | ㄍㄨㄣ |
| 光 | ㄍㄨㄤ |
| 公 | ㄍㄨㄥ |
| 卡 | ㄎㄚ |
| 可 | ㄎㄜ |
| 開 | ㄎㄞ |
| 考 | ㄎㄠ |
| 口 | ㄎㄡ |
| 看 | ㄎㄢ |
| 肯 | ㄎㄣ |
| 抗 | ㄎㄤ |
| 坑 | ㄎㄥ |
| 苦 | ㄎㄨ |
| 蘭 | ㄌㄢ |
| 浪 | ㄌㄤ |
| 冷 | ㄌㄥ |
| 裏 | ㄌㄧ |
| 倆 | ㄌㄧㄚ |
| 列 | ㄌㄧㄝ |
| 料 | ㄌㄧㄠ |
| 六 | ㄌㄧㄡ |
| 連 | ㄌㄧㄢ |
| 林 | ㄌㄧㄣ |
| 兩 | ㄌㄧㄤ |
| 領 | ㄌㄧㄥ |
| 路 | ㄌㄨ |
| 羅 | ㄌㄨㄛ |
| 亂 | ㄌㄨㄢ |
| 論 | ㄌㄨㄣ |
| 龍 | ㄌㄨㄥ |
| 律 | ㄌㄩ |
| 略 | ㄌㄩㄝ |
| 攣 | ㄌㄩㄢ |
| 淋 | ㄌㄩㄣ |
| 噶 | ㄍㄚ |
| 個 | ㄍㄜ |
| 該 | ㄍㄞ |
| 給 | ㄍㄟ |
| 內 | ㄋㄟ |
| 腦 | ㄋㄠ |
| 南 | ㄋㄢ |
| 嫩 | ㄋㄣ |
| 農 | ㄋㄨ |
| 能 | ㄋㄥ |
| 揑 | ㄋㄧㄝ |
| 鳥 | ㄋㄧㄠ |
| 牛 | ㄋㄧㄡ |
| 年 | ㄋㄧㄢ |
| 您 | ㄋㄧㄣ |
| 娘 | ㄋㄧㄤ |
| 寧 | ㄋㄧㄥ |
| 努 | ㄋㄨ |
| 娜 | ㄋㄨㄛ |
| 暖 | ㄋㄨㄢ |
| 農 | ㄋㄨㄥ |
| 女 | ㄋㄩ |
| 瘧 | ㄋㄩㄝ |
| 拉 | ㄌㄚ |
| 咯 | ㄌㄛ |
| 樂 | ㄌㄜ |
| 來 | ㄌㄞ |
| 類 | ㄌㄟ |
| 老 | ㄌㄠ |
| 樓 | ㄌㄡ |
| 對 | ㄉㄨㄟ |
| 端 | ㄉㄨㄢ |
| 頓 | ㄉㄨㄣ |
| 動 | ㄉㄨㄥ |
| 特 | ㄊㄜ |
| 太 | ㄊㄞ |
| 討 | ㄊㄠ |
| 頭 | ㄊㄡ |
| 談 | ㄊㄢ |
| 糖 | ㄊㄤ |
| 疼 | ㄊㄥ |
| 體 | ㄊㄧ |
| 鐵 | ㄊㄧㄝ |
| 條 | ㄊㄧㄠ |
| 天 | ㄊㄧㄢ |
| 聽 | ㄊㄧㄣ |
| 圖 | ㄊㄧㄤ |
| 脫 | ㄊㄧㄥ |
| 推 | ㄊㄨ |
| 團 | ㄊㄨㄟ |
| 吞 | ㄊㄨㄣ |
| 同 | ㄊㄨㄥ |
| 那 | ㄋㄚ |
| 呢 | ㄋㄜ |
| 乃 | ㄋㄞ |
| 法 | ㄈㄚ |
| 佛 | ㄈㄛ |
| 飛 | ㄈㄟ |
| 否 | ㄈㄡ |
| 飲 | ㄈㄣ |
| 分 | ㄈㄣ |
| 方 | ㄈㄤ |
| 風 | ㄈㄥ |
| 夫 | ㄈㄨ |
| 大 | ㄉㄚ |
| 得 | ㄉㄜ |
| 代 | ㄉㄞ |
| 到 | ㄉㄠ |
| 都 | ㄉㄡ |
| 但 | ㄉㄢ |
| 當 | ㄉㄤ |
| 等 | ㄉㄥ |
| 地 | ㄉㄧ |
| 爹 | ㄉㄧㄝ |
| 調 | ㄉㄧㄠ |
| 丟 | ㄉㄧㄡ |
| 點 | ㄉㄧㄢ |
| 定 | ㄉㄧㄥ |
| 度 | ㄉㄨ |
| 多 | ㄉㄨㄛ |
| 朋 | ㄆㄥ |
| 皮 | ㄆㄧ |
| 瞥 | ㄆㄧㄝ |
| 票 | ㄆㄧㄠ |
| 片 | ㄆㄧㄢ |
| 品 | ㄆㄧㄣ |
| 平 | ㄆㄧㄥ |
| 普 | ㄆㄨ |
| 媽 | ㄇㄚ |
| 模 | ㄇㄛ |
| 磨 | ㄇㄜ |
| 買 | ㄇㄞ |
| 沒 | ㄇㄟ |
| 毛 | ㄇㄠ |
| 謀 | ㄇㄡ |
| 滿 | ㄇㄢ |
| 忙 | ㄇㄤ |
| 蒙 | ㄇㄥ |
| 米 | ㄇㄧ |
| 滅 | ㄇㄧㄝ |
| 苗 | ㄇㄧㄠ |
| 面 | ㄇㄧㄢ |
| 民 | ㄇㄧㄣ |
| 明 | ㄇㄧㄥ |
| 母 | ㄇㄨ |
| 把 | ㄅㄚ |
| 播 | ㄅㄛ |
| 白 | ㄅㄞ |
| 北 | ㄅㄟ |
| 報 | ㄅㄠ |
| 辦 | ㄅㄢ |
| 本 | ㄅㄣ |
| 幫 | ㄅㄤ |
| 崩 | ㄅㄥ |
| 比 | ㄅㄧ |
| 別 | ㄅㄧㄝ |
| 表 | ㄅㄧㄠ |
| 便 | ㄅㄧㄢ |
| 賓 | ㄅㄧㄣ |
| 並 | ㄅㄧㄥ |
| 部 | ㄅㄨ |
| 怕 | ㄆㄚ |
| 破 | ㄆㄛ |
| 派 | ㄆㄞ |
| 配 | ㄆㄟ |
| 跑 | ㄆㄠ |
| 剖 | ㄆㄡ |
| 盤 | ㄆㄢ |
| 盆 | ㄆㄣ |
| 旁 | ㄆㄤ |

FIG-10

Permissible Variations in Coding of the General and Exceptional Categories

| Standard Pronunciation | Less Standard Pronunciation | Acceptable Coding | Exceptional Characters and Their Correct Coding |
|---|---|---|---|
| ㄅㄧㄥ | ㄅㄧㄣ | ㄅㄧㄣ | none |
| ㄆㄧㄥ | ㄆㄧㄣ | ㄆㄧㄣ | none |
| ㄇㄧㄥ | ㄇㄧㄣ | ㄇㄧㄣ | 明 ㄇㄧㄥ* 民ㄇㄧㄣ* |
| ㄉㄧㄥ | ㄉㄧㄣ | ㄉㄧㄣ | none |
| ㄊㄧㄥ | ㄊㄧㄣ | ㄊㄧㄣ | none |
| ㄋㄧㄥ | ㄋㄧㄣ | ㄋㄧㄣ | none |
| ㄌㄧㄥ | ㄌㄧㄣ | ㄌㄧㄣ | none |
| ㄍㄥ | ㄍㄣ | ㄍㄣ | none |
| ㄎㄥ | ㄎㄣ | ㄎㄣ | none |
| ㄏㄥ | ㄏㄣ | ㄏㄣ | none |
| ㄐㄧㄥ | ㄐㄧㄣ | ㄐㄧㄣ | 經 ㄐㄧㄥ* 進ㄐㄧㄣ* |
| ㄑㄧㄥ | ㄑㄧㄣ | ㄑㄧㄣ | 情 ㄑㄧㄥ* 親ㄑㄧㄣ* |
| ㄒㄧㄥ | ㄒㄧㄣ | ㄒㄧㄣ | 心 ㄒㄧㄣ* 心ㄒㄧㄣㄒ |
| ㄓㄥ | ㄓㄣ | ㄓㄣ | 真 ㄓㄣ* 政ㄓㄥ* |
| ㄔㄥ | ㄔㄣ | ㄔㄣ | none |
| ㄕㄥ | ㄕㄣ | ㄕㄣ | |
| ㄖㄥ | ㄖㄣ | ㄖㄣ | none |
| ㄗㄥ | ㄗㄣ | ㄗㄣ | none |
| ㄘㄥ | ㄘㄣ | ㄘㄣ | none |
| ㄙㄥ | ㄙㄣ | ㄙㄣ | none |
| ㄧㄥ | ㄧㄣ | ㄧㄣ | 因 ㄧㄣ* 應 ㄧㄥ* |

*short code

| Standard Pronunciation | Less Standard Pronunciation | Acceptable Coding | Exceptional Characters and Their Correct Coding |
|---|---|---|---|
| ㄋ... | ㄌ... | ㄌ... | 你 ㄋㄧ* 裡ㄌㄧ* |
| | | | 呢 ㄋㄜ* 樂ㄌㄜ* |
| | | | 了 (ㄌ or ㄋ)** 鳥ㄌㄧㄠㄋ ** |
| | | | 牢 ㄌㄠㄇㄨ** 鬧ㄋㄠㄇㄨ** |
| ㄓ... | ㄗ... | ㄓ... | 之ㄓ* 子ㄗ* |
| | | | 秩 ㄓㄜㄨㄅ** 責ㄗㄜㄨㄅ** |
| ㄔ... | ㄘ... | ㄔ... | 吃ㄔ* 此ㄘ* |
| ㄕ... | ㄙ... | ㄕ... | 是ㄕ 四ㄙ* |
| | | | 說ㄕㄨㄛ* 所ㄙㄨㄛ* |

* short code
** long code, the underlined part is the geometric coding of the character 王18-11-1 The Master Coding List for the Optimal Phonemetype II ㄅ
八 ㄅㄟ
巴 ㄅㄧㄚ
吧 ㄅㄧㄚㄅ
捌 ㄅㄧㄚㄅ
八 ㄅㄧㄚㄅ
芭 ㄅㄧㄚㄅ
笆 ㄅㄧㄚㄅ
疤 ㄅㄧㄚㄅ
粑 ㄅㄧㄚㄅ
拔 ㄅㄧㄚㄅ
跋 ㄅㄧㄚㄅ
把 ㄅㄧㄚㄅ
靶 ㄅㄧㄚㄅ
把 ㄅㄧㄚㄅ
罷 ㄅㄧㄚㄅ
爸 ㄅㄧㄚㄅ
霸 ㄅㄧㄚㄅ
壩 ㄅㄧㄚㄅ
灞 ㄅㄧㄚㄅ
ㄆ
波 ㄆㄛㄅㄛ
玻 ㄆㄛㄅㄛ
撥 ㄆㄛㄅㄛ
剝 ㄆㄛㄅㄛ
菠 ㄆㄛㄅㄛ
鉢 ㄆㄛㄅㄛ
缽 ㄆㄛㄅㄛ
伯 ㄆㄛㄅㄛ
博 ㄆㄛㄅㄛ
柏 ㄆㄛㄅㄛ
薄 ㄆㄛㄅㄛ
泊 ㄆㄛㄅㄛ
渤 ㄆㄛㄅㄛ
勃 ㄆㄛㄅㄛ
蔔 ㄆㄛㄅㄛ
膊 ㄆㄛㄅㄛ
脖 ㄆㄛㄅㄛ
鈸 ㄆㄛㄅㄛ
箔 ㄆㄛㄅㄛ
帛 ㄆㄛㄅㄛ
博 ㄆㄛㄅㄛ
駁 ㄆㄛㄅㄛ
頻 ㄆㄛㄅㄛ
舶 ㄆㄛㄅㄛ
搏 ㄆㄛㄅㄛ
鉑 ㄆㄛㄅㄛ
礴 ㄆㄛㄅㄛ
簸 ㄆㄛㄅㄛ
跛 ㄆㄛㄅㄛ
播 ㄆㄛㄅㄛ
簸 ㄆㄛㄅㄛ
毫 ㄆㄛㄅㄛ
擘 ㄆㄛㄅㄛ
拚 ㄆㄛㄅㄛ
白 ㄆㄛㄅㄛ
百 ㄆㄛㄅㄛ
擺 ㄆㄛㄅㄛ
佰 ㄆㄛㄅㄛ
敗 ㄆㄛㄅㄛ
拜 ㄆㄛㄅㄛ
背 ㄆㄛㄅㄛ
杯 ㄆㄛㄅㄛ
悲 ㄆㄛㄅㄛ
卑 ㄆㄛㄅㄛ
碑 ㄆㄛㄅㄛ
盃 ㄆㄛㄅㄛ
ㄇ
背 ㄅㄟ
北 ㄅㄟ
被 ㄅㄟ
備 ㄅㄟ
背 ㄅㄟ
貝 ㄅㄟ
倍 ㄅㄟ
輩 ㄅㄟ
狽 ㄅㄟ
焙 ㄅㄟ
蓓 ㄅㄟ
憊 ㄅㄟ
悖 ㄅㄟ
ㄈ
包 ㄅㄠ
胞 ㄅㄠ
剝 ㄅㄠ
褒 ㄅㄠ
苞 ㄅㄠ
薄 ㄅㄠ
雹 ㄅㄠ
保 ㄅㄠ
寶 ㄅㄠ
飽 ㄅㄠ
堡 ㄅㄠ
報 ㄅㄠ
抱 ㄅㄠ
暴 ㄅㄠ
爆 ㄅㄠ
鮑 ㄅㄠ
鮑 ㄅㄠ
豹 ㄅㄠ
趵 ㄅㄠ
ㄉ
班 ㄅㄢ
般 ㄅㄢ
搬 ㄅㄢ
斑 ㄅㄢ
頒 ㄅㄢ
扳 ㄅㄢ
板 ㄅㄢ
版 ㄅㄢ
閥 ㄅㄢ
阪 ㄅㄢ
坂 ㄅㄢ
半 ㄅㄢ
辦 ㄅㄢ
伴 ㄅㄢ
拌 ㄅㄢ
扮 ㄅㄢ
瓣 ㄅㄢ
絆 ㄅㄢ
奔 ㄅㄣ
本 ㄅㄣ
畚 ㄅㄣ
笨 ㄅㄣ
苯 ㄅㄣ
幫 ㄅㄤ
邦 ㄅㄤ
傍 ㄅㄤ
梆 ㄅㄤ
膀 ㄅㄤ
榜 ㄅㄤ
綁 ㄅㄤ
棒 ㄅㄤ
磅 ㄅㄤ
傍 ㄅㄤ
蚌 ㄅㄤ
鎊 ㄅㄤ
謗 ㄅㄤ
崩 ㄅㄥ
繃 ㄅㄥ
甭 ㄅㄥ
蹦 ㄅㄥ
逼 ㄅㄧ
鼻 ㄅㄧ
荸 ㄅㄧ
比 ㄅㄧ
筆 ㄅㄧ
彼 ㄅㄧ
妣 ㄅㄧ
比 ㄅㄧ
祕 ㄅㄧ
弼 ㄅㄧ
裨 ㄅㄧ
篦 ㄅㄧ
睥 ㄅㄧ
髀 ㄅㄧ
鄁 ㄅㄧ
鉍 ㄅㄧ
憋 ㄅㄧㄝ
鼈 ㄅㄧㄝ
別 ㄅㄧㄝ
蹩 ㄅㄧㄝ
彆 ㄅㄧㄝ
鷩 ㄅㄧㄝ
標 ㄅㄧㄠ
彪 ㄅㄧㄠ
鏢 ㄅㄧㄠ
飆 ㄅㄧㄠ
麃 ㄅㄧㄠ
表 ㄅㄧㄠˇ
錶 ㄅㄧㄠˇ
婊 ㄅㄧㄠˇ
裱 ㄅㄧㄠˇ
鰾 ㄅㄧㄠˇ
邊 ㄅㄧㄢ
編 ㄅㄧㄢ
蝙 ㄅㄧㄢ
鞭 ㄅㄧㄢ
扁 ㄅㄧㄢ
貶 ㄅㄧㄢ
匾 ㄅㄧㄢ
便 ㄅㄧㄢˋ
變 ㄅㄧㄢˋ
遍 ㄅㄧㄢˋ
辨 ㄅㄧㄢˋ
辯 ㄅㄧㄢˋ
汴 ㄅㄧㄢˋ
辯 ㄅㄧㄢˋ
賓 ㄅㄧㄣ

王18-11-2

ㄅㄧㄢ ㄅㄧㄢˋ 癖 ㄅㄧㄢˋ 譬 ㄅㄧㄢˋ 屁 ㄅㄧㄝˋ 嬖 ㄅㄧㄝˋ 瞥 ㄅㄧㄠ 飄 ㄅㄧㄠ 漂 ㄅㄧㄠˋ 飄 ㄅㄧㄠˋ 嫖 ㄅㄧㄠˋ 漂 ㄅㄧㄠ 瞟 ㄅㄧㄠˋ 票 ㄅㄧㄠ 漂 ㄅㄧㄠˋ 剽 ㄅㄧㄢ 篇 ㄅㄧㄢ 偏 ㄅㄧㄢˋ 便 ㄅㄧㄢˋ 胼 ㄅㄧㄢˋ 諞 ㄅㄧㄢˋ 片 ㄅㄧㄢ 騙 ㄅㄧㄢˋ 偏 ㄅㄧㄥ 拼 ㄅㄧㄥˋ 姘 ㄅㄧㄥˋ 貧 ㄅㄧㄣ 蘋 ㄅㄧㄣˊ 頻 ㄅㄧㄣˋ 顰 ㄅㄧㄣ 品 ㄅㄧㄣˇ 聘 ㄅㄧㄣˋ

ㄅㄧ 匹 ㄅㄧˋ 披 ㄅㄧˋ 劈 ㄅㄧˋ 坯 ㄅㄧ 霹 ㄅㄧˋ 噼 ㄅㄧ 丕 ㄅㄧ 砒 ㄅㄧ 紕 ㄅㄧˊ 皮 ㄅㄧˊ 疲 ㄅㄧˊ 脾 ㄅㄧˊ 琵 ㄅㄧˊ 啤 ㄅㄧˊ 埤 ㄅㄧˊ 枇 ㄅㄧˊ 毗 ㄅㄧˊ 裨 ㄅㄧˊ 鼙 ㄅㄧˊ 陂 ㄅㄧˇ 匹 ㄅㄧˇ 疋 ㄅㄧˇ 劈 ㄅㄧˋ

ㄅㄤˋ 傍 ㄅㄤˋ 螃 ㄅㄤˋ 龐 ㄅㄤˋ 胖 ㄅㄤˋ 砰 ㄅㄤ 烹 ㄅㄤ 抨 ㄅㄤˊ 朋 ㄅㄤˊ 蓬 ㄅㄤˊ 澎 ㄅㄤˊ 彭 ㄅㄤˊ 膨 ㄅㄤˊ 鵬 ㄅㄤˊ 棚 ㄅㄤˊ 硼 ㄅㄤˊ 篷 ㄅㄤˊ 捧 ㄅㄤˇ 碰 ㄅㄤˋ 批 ㄅㄤ

ㄅㄢ 潘 ㄅㄢˋ 攀 ㄅㄢˋ 盤 ㄅㄢˊ 槃 ㄅㄢˊ 磐 ㄅㄢˊ 判 ㄅㄢˋ 叛 ㄅㄢˋ 盼 ㄅㄢˋ 畔 ㄅㄢˋ 拌 ㄅㄢˋ 噴 ㄅㄣ 盆 ㄅㄣˊ 湓 ㄅㄣˊ 噴 ㄅㄣˋ 滂 ㄅㄤ 乓 ㄅㄤˋ 旁 ㄅㄤˊ 膀

ㄅㄤˇ 佩 ㄅㄤˋ 沛 ㄅㄤˋ 霈 ㄅㄤˋ 珮 ㄅㄤˋ 旆 ㄅㄤˋ 轡 ㄅㄤˋ 泡 ㄅㄠ 拋 ㄅㄠ 袍 ㄅㄠˊ 咆 ㄅㄠˊ 庖 ㄅㄠˊ 跑 ㄅㄠˋ 礮 ㄅㄠˋ 泡 ㄅㄠˋ 砲 ㄅㄠˋ 炮 ㄅㄠˋ 皰 ㄅㄠˋ 裒 ㄅㄡ 剖 ㄅㄡˋ

ㄅㄚ 魄 ㄅㄚˋ 珀 ㄅㄚ 拍 ㄅㄚˊ 排 ㄅㄚˊ 牌 ㄅㄚˊ 徘 ㄅㄚˊ 簿 ㄅㄚˋ 簿 ㄅㄚˋ 簿 ㄅㄚˋ 滙 ㄅㄚˋ 派 ㄅㄚˋ 湃 ㄅㄚˋ 胚 ㄅㄟ 呸 ㄅㄟˋ 培 ㄅㄟˊ 賠 ㄅㄟˊ 陪 ㄅㄟˊ 裴 ㄅㄟˊ 坏 ㄅㄟˋ 配 ㄅㄟˋ

ㄅㄚ 趴 ㄅㄚ 葩 ㄅㄚ 啪 ㄅㄚˋ 爬 ㄅㄚˊ 琶 ㄅㄚˊ 杷 ㄅㄚˊ 耙 ㄅㄚˊ 扒 ㄅㄚˋ 怕 ㄅㄚˋ 帕 ㄅㄚˋ 潑 ㄅㄛ 坡 ㄅㄛ 陂 ㄅㄛˇ 婆 ㄅㄛˊ 鄱 ㄅㄛˊ 頗 ㄅㄛˋ 叵 ㄅㄛˇ 破 ㄅㄛˋ 迫 ㄅㄛˋ

ㄅㄧㄥ 並 ㄅㄧㄥˋ 病 ㄅㄧㄥˋ 并 ㄅㄧㄥ 併 ㄅㄧㄥ 柄 ㄅㄧㄥ 摒 ㄅㄧㄥˇ 不 ㄅㄨˋ 補 ㄅㄨ 捕 ㄅㄨ 埔 ㄅㄨ 卜 ㄅㄨ 哺 ㄅㄨ 不 ㄅㄨˋ 部 ㄅㄨ 布 ㄅㄨ 步 ㄅㄨ 佈 ㄅㄨ 簿 ㄅㄨ 埠 ㄅㄨ 怖 ㄅㄨ 鉋 ㄅㄨ

ㄅㄧㄣ 濱 ㄅㄧㄣ 彬 ㄅㄧㄣ 瀕 ㄅㄧㄣ 賦 ㄅㄧㄣ 檳 ㄅㄧㄣ 繽 ㄅㄧㄣ 邠 ㄅㄧㄣˋ 稟 ㄅㄧㄣˇ 殯 ㄅㄧㄣˋ 鬢 ㄅㄧㄣ 擯 ㄅㄧㄣ 兵 ㄅㄧㄥ 冰 ㄅㄧㄥ 氷 ㄅㄧㄥˇ 餅 ㄅㄧㄥˇ 丙 ㄅㄧㄥˇ 禀 ㄅㄧㄥˇ 柄 ㄅㄧㄥˇ 秉 ㄅㄧㄥˇ 炳 ㄅㄧㄥˇ 昺

FIG-11-3

ㄇㄧˊ ㄇㄧㄏㄈㄙ
醾
ㄇㄧˇ ㄇㄧㄨ
米靡弭麋
ㄇㄧˋ ㄇㄧㄇㄅㄧㄡ
密蜜祕覓秘泌汨冪
ㄇㄧㄝ ㄇㄧㄇㄨ
咩滅蔑篾
ㄇㄧㄠ ㄇㄧㄠˋ
喵苗

ㄇㄨˊ ㄇㄨㄝㄍ
蒙
ㄇㄨㄅㄧㄡ ㄇㄨㄅㄧㄡˋ
盟矇濛檬朦萌懵
ㄇㄨˇ ㄇㄨㄈㄝㄍ
猛
ㄇㄨㄈㄚㄅ ㄇㄨㄈㄚㄅˋ
蜢
ㄇㄨㄈㄚㄅˇ ㄇㄨㄈㄚㄅㄧㄡˋ
錳艋
ㄇㄨㄈㄚㄅㄧㄡˇ ㄇㄨㄈㄚㄅㄧㄡˇ
夢
ㄇㄨㄈㄚㄅㄧㄡˇ ㄇㄨㄈㄚㄅㄧㄡˇ
孟
ㄇㄨㄈㄚㄅㄧㄡˇ ㄇㄨㄈㄚㄅㄧㄡˇ
咪
ㄇㄨㄈㄚㄅㄧㄡˇ ㄇㄨㄈㄚㄅㄧㄡˇ
瞇
ㄇㄨㄈㄚㄅㄧㄡˇ ㄇㄨㄈㄚㄅㄧㄡˇ
迷彌謎縻瀰

ㄇㄨㄅㄧㄡˋ ㄇㄨㄅㄧㄡˋ
鰻
ㄇㄨㄅㄧㄡˋ ㄇㄨㄅㄧㄡˋ
幔
ㄇㄨㄅㄧㄡˋ ㄇㄨㄅㄧㄡˋ
謾
ㄇㄨㄅㄧㄡˋ ㄇㄨㄅㄧㄡˋ
悶
ㄇㄨㄅㄧㄡˋ ㄇㄨㄅㄧㄡˋ
們門捫
ㄇㄨㄅㄧㄡˋ ㄇㄨㄅㄧㄡˋ
悶懣
ㄇㄨㄅㄧㄡˋ ㄇㄨㄅㄧㄡˋ
燜
ㄇㄨㄅㄧㄡˋ ㄇㄨㄅㄧㄡˋ
們
ㄇㄨㄅㄧㄡˋ ㄇㄨㄅㄧㄡˋ
忙
ㄇㄨㄅㄧㄡˋ ㄇㄨㄅㄧㄡˋ
芒茫盲氓
ㄇㄨㄅㄧㄡˋ ㄇㄨㄅㄧㄡˋ
鋩
ㄇㄨㄅㄧㄡˋ ㄇㄨㄅㄧㄡˋ
莽蟒

ㄇㄨㄅㄧㄡˋ ㄇㄨㄅㄧㄡˋ
耄
ㄇㄨㄅㄧㄡˋ ㄇㄨㄅㄧㄡˋ
謀牟眸繆
ㄇㄨㄅㄧㄡˋ ㄇㄨㄅㄧㄡˋ
某牡
ㄇㄨㄅㄧㄡˋ ㄇㄨㄅㄧㄡˋ
顯
ㄇㄨㄅㄧㄡˋ ㄇㄨㄅㄧㄡˋ
蠻饅瞞顢鰻
ㄇㄨㄅㄧㄡˋ ㄇㄨㄅㄧㄡˋ
滿
ㄇㄨㄅㄧㄡˋ ㄇㄨㄅㄧㄡˋ
慢曼漫嫚蔓

ㄇㄨㄅㄧㄡˋ ㄇㄨㄅㄧㄡˋ
昧寐魅袂
ㄇㄨㄅㄧㄡˋ ㄇㄨㄅㄧㄡˋ
貓
ㄇㄨㄅㄧㄡˋ ㄇㄨㄅㄧㄡˋ
毛茅矛髦旄蟊
ㄇㄨㄅㄧㄡˋ ㄇㄨㄅㄧㄡˋ
卯鉚
ㄇㄨㄅㄧㄡˋ ㄇㄨㄅㄧㄡˋ
帽冒貌貿茂瑁懋袤

ㄇㄨㄅㄧㄡˋ ㄇㄨㄅㄧㄡˋ
邁勱
ㄇㄨㄅㄧㄡˋ ㄇㄨㄅㄧㄡˋ
沒煤眉梅枚黴湄霉媒玫莓楣嵋
ㄇㄨㄅㄧㄡˋ ㄇㄨㄅㄧㄡˋ
美每鎂
ㄇㄨㄅㄧㄡˋ ㄇㄨㄅㄧㄡˋ
妹媚沬瑁

ㄇㄨˇ ㄇㄨㄅㄧㄡˋ
馬
ㄇㄨˇ ㄇㄨㄅㄧㄡˋ
嗎螞
ㄇㄨˇ ㄇㄨㄅㄧㄡˋ
碼瑪
ㄇㄨˇ ㄇㄨㄅㄧㄡˋ
罵
ㄇㄨˋ ㄇㄨㄅㄧㄡˋ
麼嗎嘛
ㄇㄨˋ ㄇㄨㄅㄧㄡˋ
摸
ㄇㄨˋ ㄇㄨㄅㄧㄡˋ
模磨摩魔嘛謨糢摹蘑
ㄇㄨˋ ㄇㄨㄅㄧㄡˋ
抹

ㄇㄨˋ ㄇㄨㄅㄧㄡˋ
沒莫末脈墨默漠膜抹寞陌沫歿秣茉
ㄇㄨˋ ㄇㄨㄅㄧㄡˋ
麼
ㄇㄨˋ ㄇㄨㄅㄧㄡˋ
埋霾
ㄇㄨˋ ㄇㄨㄅㄧㄡˋ
買
ㄇㄨˋ ㄇㄨㄅㄧㄡˋ
賣麥

ㄇㄨˋ ㄇㄨㄅㄧㄡˋ
躾蒲濮
ㄇㄨˋ ㄇㄨㄅㄧㄡˋ
普浦譜圃溥
ㄇㄨˋ ㄇㄨㄅㄧㄡˋ
暴鋪舖曝瀑
ㄇㄨ ㄇㄨㄅㄧㄡˋ
媽
ㄇㄨˋ ㄇㄨㄅㄧㄡˋ
麼麻嘛蔴痳蟆

ㄅㄧㄣˋ ㄅㄧㄣㄍㄨㄥ
牝
ㄅㄧㄥ ㄅㄧㄥㄍㄨㄥ
乒
ㄅㄧㄥˊ ㄅㄧㄥㄍㄨㄥ
娉
ㄅㄧㄥˊ ㄅㄧㄥㄍㄨㄥ
平瓶憑評屏萍蘋坪枰
ㄅㄨ ㄅㄧㄥㄍㄨㄥ
鋪撲仆
ㄅㄨˊ ㄅㄧㄥㄍㄨㄥ
葡僕蒲菩樸朴

ㄅㄨˋ 沐 ㄅㄨㄟ 首 ㄅㄨㄢ 蘩

ㄅㄚ 發 ㄅㄚㄈㄨㄢ 伐 ㄅㄚㄌㄧㄝㄅ 醱

ㄅㄚˊ 乏 ㄅㄚㄊㄤ 罰 ㄅㄚㄍㄨㄛ 閥 ㄅㄚㄍㄨㄥ 筏 ㄅㄚㄍㄨㄟ 砝

ㄅㄚˇ 法 ㄅㄚㄍㄨㄟˋ 髮

ㄅㄚˋ 法 ㄅㄚㄍㄨㄟˋ 琺

ㄅㄛˊ 佛 ㄅㄛˋ 縛 ㄅㄟ 飛

ㄅㄟˋ 非 ㄅㄟ 菲 ㄅㄟ 啡 ㄅㄟ 妃 ㄅㄟ 扉 ㄅㄟ 蜚

ㄅㄟˊ 肥 ㄅㄟ 淝 ㄅㄟˇ 匪 ㄅㄟ 翡 ㄅㄟ 誹 ㄅㄟ 斐 ㄅㄟ 懼 ㄅㄟ 榧

ㄅㄟˋ 費 ㄅㄟ 廢 ㄅㄟ 肺 ㄅㄟ 沸 ㄅㄟ 吠 ㄅㄟ 痱 ㄅㄟ 芾

ㄅㄧㄠˋ 描 ㄅㄧㄠˋ 瞄 ㄅㄧㄠˋ 秒 ㄅㄧㄠˋ 渺 ㄅㄧㄠˋ 藐 ㄅㄧㄠˋ 杳 ㄅㄧㄠˋ 杪 ㄅㄧㄠˋ 邈

ㄅㄧㄠˋ 妙 ㄅㄧㄠˋ 廟 ㄅㄧㄠˋ 繆 ㄅㄧㄠˋ 謬 ㄅㄧㄣˋ 棉 ㄅㄧㄣˋ 眠 ㄅㄧㄣˋ 綿 ㄅㄧㄣˋ 緜 ㄅㄧㄣˋ 免 ㄅㄧㄣˋ 勉 ㄅㄧㄣˋ 緬 ㄅㄧㄣˋ 冕

ㄅㄧㄣˋ 娩 ㄅㄧㄣˋ 丐 ㄅㄧㄣˋ 沔 ㄅㄧㄣˋ 面 ㄅㄧㄣˋ 麵 ㄅㄧㄣˋ 民 ㄅㄧㄣˋ 岷 ㄅㄧㄥˋ 閩 ㄅㄧㄥˋ 敏 ㄅㄧㄥˋ 皿 ㄅㄧㄥˋ 愍 ㄅㄧㄥˋ 憫 ㄅㄧㄥˋ 抿 ㄅㄧㄥˋ 閔 ㄅㄧㄥˋ 湣 ㄅㄧㄥˋ 明 ㄅㄧㄥˋ 名 ㄅㄧㄥˋ 鳴 ㄅㄧㄥˋ 銘 ㄅㄧㄥˋ 螟 ㄅㄧㄥˋ 冥

ㄅㄧㄥˋ 瞑 ㄅㄧㄥˋ 茗 ㄅㄧㄥˋ 皿 ㄅㄧㄥˋ 命 ㄅㄧㄥˋ 模 ㄅㄨˋ 母 ㄅㄨˋ 姆 ㄅㄨˋ 畝 ㄅㄨˋ 牡 ㄅㄨˋ 拇 ㄅㄨˋ 目 ㄅㄨˋ 木 ㄅㄨˋ 幕 ㄅㄨˋ 牧 ㄅㄨˋ 慕 ㄅㄨˋ 墓 ㄅㄨˋ 募 ㄅㄨˋ 穆 ㄅㄨˋ 睦 ㄅㄨˋ 暮

ㄅㄨˋ 沐 ㄅㄨˋ 首 ㄅㄨˋ 蘩 ㄅㄨˋ 伐 ㄅㄨˋ 醱 ㄅㄨˋ 乏 ㄅㄨˋ 罰 ㄅㄨˋ 閥 ㄅㄨˋ 筏 ㄅㄨˋ 砝 ㄅㄨˋ 髮 ㄅㄨˋ 法 ㄅㄨˋ 琺 ㄅㄨˋ 佛 ㄅㄨˋ 縛 ㄅㄨˋ 飛 ㄅㄨˋ 非 ㄅㄨˋ 菲 ㄅㄨˋ 啡 ㄅㄨˋ 妃 ㄅㄨˋ 扉 ㄅㄨˋ 蜚 ㄅㄨˋ 肥 ㄅㄨˋ 淝 ㄅㄨˋ 匪 ㄅㄨˋ 翡 ㄅㄨˋ 誹 ㄅㄨˋ 斐 ㄅㄨˋ 懼 ㄅㄨˋ 榧 ㄅㄨˋ 費 ㄅㄨˋ 廢 ㄅㄨˋ 肺 ㄅㄨˋ 沸 ㄅㄨˋ 吠 ㄅㄨˋ 痱 ㄅㄨˋ 芾

ㄅㄨˋ 描 ㄅㄨˋ 瞄 ㄅㄨˋ 秒 ㄅㄨˋ 渺 ㄅㄨˋ 藐 ㄅㄨˋ 杳 ㄅㄨˋ 杪 ㄅㄨˋ 邈 ㄅㄨˋ 妙 ㄅㄨˋ 廟 ㄅㄨˋ 繆 ㄅㄨˋ 謬 ㄅㄨˋ 棉 ㄅㄨˋ 眠 ㄅㄨˋ 綿 ㄅㄨˋ 緜 ㄅㄨˋ 免 ㄅㄨˋ 勉 ㄅㄨˋ 緬 ㄅㄨˋ 冕

ㄅㄨˋ 娩 ㄅㄨˋ 丐 ㄅㄨˋ 沔 ㄅㄨˋ 面 ㄅㄨˋ 麵 ㄅㄨˋ 民 ㄅㄨˋ 岷 ㄅㄨˋ 閩 ㄅㄨˋ 敏 ㄅㄨˋ 皿 ㄅㄨˋ 愍 ㄅㄨˋ 憫 ㄅㄨˋ 抿 ㄅㄨˋ 閔 ㄅㄨˋ 湣 ㄅㄨˋ 明 ㄅㄨˋ 名 ㄅㄨˋ 鳴 ㄅㄨˋ 銘 ㄅㄨˋ 螟 ㄅㄨˋ 冥

ㄅㄨˋ 瞑 ㄅㄨˋ 茗 ㄅㄨˋ 皿 ㄅㄨˋ 命 ㄅㄨˋ 模 ㄅㄨˋ 母 ㄅㄨˋ 姆 ㄅㄨˋ 畝 ㄅㄨˋ 牡 ㄅㄨˋ 拇 ㄅㄨˋ 目 ㄅㄨˋ 木 ㄅㄨˋ 幕 ㄅㄨˋ 牧 ㄅㄨˋ 慕 ㄅㄨˋ 墓 ㄅㄨˋ 募 ㄅㄨˋ 穆 ㄅㄨˋ 睦 ㄅㄨˋ 暮

ㄅㄨˋ 沐 ㄅㄨˋ 首 ㄅㄨˋ 蘩 ㄅㄨˋ 伐 ㄅㄨˋ 醱 ㄅㄨˋ 乏 ㄅㄨˋ 罰 ㄅㄨˋ 閥 ㄅㄨˋ 筏 ㄅㄨˋ 砝 ㄅㄨˋ 髮 ㄅㄨˋ 法 ㄅㄨˋ 琺 ㄅㄨˋ 佛 ㄅㄨˋ 縛 ㄅㄨˋ 飛 ㄅㄨˋ 非 ㄅㄨˋ 菲 ㄅㄨˋ 啡 ㄅㄨˋ 妃 ㄅㄨˋ 扉 ㄅㄨˋ 蜚 ㄅㄨˋ 肥 ㄅㄨˋ 淝 ㄅㄨˋ 匪 ㄅㄨˋ 翡 ㄅㄨˋ 誹 ㄅㄨˋ 斐 ㄅㄨˋ 懼 ㄅㄨˋ 榧 ㄅㄨˋ 費 ㄅㄨˋ 廢 ㄅㄨˋ 肺 ㄅㄨˋ 沸 ㄅㄨˋ 吠 ㄅㄨˋ 痱 ㄅㄨˋ 芾

ㄅㄧㄠ ㄅㄧㄠㄍㄨㄥ
貂 碉

ㄅㄧㄠ ㄅㄧㄠㄇㄣ
調 掉 吊 釣 弔 銚

ㄅㄧㄡ ㄅㄧㄡㄈㄨㄟ
丟

ㄅㄧㄢ ㄅㄧㄢㄌㄧㄡㄍㄨㄥ
滇 顛 巔 癲

ㄅㄧㄢ ㄅㄧㄢㄊㄧㄝㄅㄧㄠㄅㄧㄠ
點 典 碘 点

ㄅㄧㄢ ㄅㄧㄢㄉㄧㄢ
電 店 殿

ㄅㄧㄝ ㄅㄧㄝㄍㄨㄥㄅㄧㄠㄅㄧㄠ
弟 帝 遞 蒂 諦 締 棣

ㄅㄧㄝ ㄅㄧㄝㄅㄧㄥㄅㄧㄥㄅㄧㄥ

FIG-11-6

| | | | |
|---|---|---|---|
| ㄉㄧㄥˋ | 滕 | ㄊㄤˊ | 榻 |
| ㄉㄧˋ | 體 | ㄊㄨㄛˋ | 蹅 |
| ㄉㄧㄢˋ | 替 | ㄊㄨㄥˋ | 踢 |
| ㄉㄧㄝˋ | 剃 | ㄊㄨㄟˋ | 特 |
| ㄉㄧㄣˋ | 題 | ㄊㄨㄣˋ | 忒 |
| ㄉㄧㄤˋ | 提 | ㄊㄨㄢˋ | 胎 |
| ㄉㄧㄠˋ | 堤 | ㄊㄞˊ | 臺 |
| ㄉㄧㄡˋ | 啼 | ㄊㄞˇ | 抬 |
| ㄉㄧㄢˋ | 蹄 | ㄊㄞˋ | 颱 |
| ㄉㄧㄝˋ | 踶 | ㄊㄠˊ | 檯 |
| ㄉㄧㄣˋ | 提 | ㄊㄠˇ | 苔 |
| ㄉㄧㄥˋ | 體 | ㄊㄠˋ | 太 |
| ㄉㄧㄢˋ | 体 | ㄊㄡˊ | 態 |
| ㄉㄧㄤˋ | 替 | ㄊㄡˇ | 泰 |
| ㄉㄨㄟˋ | 涕 | ㄊㄡˋ | 汰 |
| ㄉㄧㄥˋ | 屉 | ㄊㄢˋ | 鈦 |
| ㄉㄧㄝˋ | 鍬 | ㄊㄤˊ | 叨 |
| ㄉㄧㄠˋ | 逖 | ㄊㄤˇ | 饕 |
| ㄉㄧㄝˋ | 剃 | ㄊㄤˋ | 餮 |
| ㄉㄨㄥˋ | 悌 | ㄊㄣˊ | 饕 |
| ㄊㄤˋ | 碭 | ㄊㄣˇ | 餮 |
| ㄊㄤ | 湯 | ㄊㄣˋ | 饕 |
| ㄊㄤˋ | 鐘 | ㄊㄥˊ | 餮 |
| ㄊㄤˊ | 堂 | ㄊㄥˇ | 饕 |
| ㄊㄤˊ | 糖 | ㄊㄥˋ | 餮 |
| ㄊㄤˊ | 唐 | ㄊㄦˊ | 饕 |
| ㄊㄤˊ | 塘 | ㄊㄦˇ | 餮 |
| ㄊㄤˊ | 螳 | ㄊㄦˋ | 饕 |
| ㄊㄤˊ | 醣 | ㄊㄧˊ | 饕 |
| ㄊㄤˊ | 膛 | ㄊㄧˇ | 饕 |
| ㄊㄤˇ | 棠 | ㄊㄧˋ | 饕 |
| ㄊㄤˋ | 倘 | ㄊㄨˊ | 饕 |
| ㄊㄤˋ | 躺 | ㄊㄨˇ | 饕 |
| ㄊㄤˋ | 儻 | ㄊㄨˋ | 饕 |
| ㄊㄤˋ | 淌 | ㄊㄩˊ | 饕 |
| ㄊㄤˋ | 帑 | ㄊㄩˇ | 饕 |
| ㄊㄤˋ | 趟 | ㄊㄩˋ | 饕 |
| ㄊㄤˋ | 湯 | ㄊㄠˊ | 饕 |
| ㄊㄤˋ | 燙 | ㄊㄠˇ | 饕 |
| ㄊㄤˋ | 騰 | ㄊㄠˋ | 饕 |
| ㄊㄤˋ | 藤 | ㄊㄡˊ | 饕 |
| ㄊㄤˋ | 謄 | ㄊㄡˇ | 饕 |
| ㄊㄤˋ | 騰 | ㄊㄡˋ | 饕 |
| ㄊㄤˋ | 騰 | ㄊㄢˊ | 饕 |
| ㄊㄤˋ | 騰 | ㄊㄢˇ | 饕 |
| ㄊㄤˋ | 騰 | ㄊㄢˋ | 饕 |
| ㄊㄤˋ | 騰 | ㄊㄤˊ | 饕 |
| ㄊㄤˋ | 騰 | ㄊㄤˇ | 饕 |
| ㄊㄤˋ | 騰 | ㄊㄤˋ | 饕 |
| ㄊㄤˋ | 騰 | ㄊㄣˊ | 饕 |
| ㄊㄤˋ | 騰 | ㄊㄣˇ | 饕 |
| ㄊㄤˋ | 騰 | ㄊㄣˋ | 饕 |
| ㄊㄤˋ | 騰 | ㄊㄥˊ | 饕 |
| ㄊㄤˋ | 騰 | ㄊㄥˇ | 饕 |
| ㄊㄤˋ | 騰 | ㄊㄥˋ | 饕 |
| ㄊㄤˋ | 騰 | ㄊㄦˊ | 饕 |
| ㄊㄤˋ | 騰 | ㄊㄦˇ | 饕 |
| ㄊㄤˋ | 騰 | ㄊㄦˋ | 饕 |
| ㄊㄤˋ | 騰 | ㄊㄧˊ | 饕 |
| ㄊㄤˋ | 騰 | ㄊㄧˇ | 饕 |
| ㄊㄤˋ | 騰 | ㄊㄧˋ | 饕 |
| ㄊㄤˋ | 騰 | ㄊㄨˊ | 饕 |
| ㄊㄤˋ | 騰 | ㄊㄨˇ | 饕 |
| ㄊㄤˋ | 騰 | ㄊㄨˋ | 饕 |
| ㄊㄤˋ | 騰 | ㄊㄩˊ | 饕 |
| ㄊㄤˋ | 騰 | ㄊㄩˇ | 饕 |
| ㄊㄤˋ | 騰 | ㄊㄩˋ | 饕 |
| ㄊㄤˋ | 騰 | ㄊㄠˊ | 饕 |
| ㄊㄤˋ | 騰 | ㄊㄠˇ | 饕 |
| ㄊㄤˋ | 騰 | ㄊㄠˋ | 饕 |
| ㄊㄤˋ | 騰 | ㄊㄡˊ | 饕 |
| ㄊㄤˋ | 騰

王18-11-7

個 ㄊㄧㄣˋ
惕 ㄊㄧㄢˋ
帖 ㄊㄧㄝˇ
貼 ㄊㄧㄝˇㄊㄧㄝˇ
鐵 ㄊㄧㄝˇ
帖 ㄊㄧㄝˇㄅㄧㄢˋ
鉄 ㄊㄧㄝˇㄅㄧㄢˋㄨㄣˇ
挑 ㄊㄧㄠˇㄈㄨˋ
祧 ㄊㄧㄠˇㄈㄨˋ
條 ㄊㄧㄠˊㄊㄧㄠˊㄨㄣˋ
調 ㄊㄧㄠˊㄊㄧㄠˋ
笤 ㄊㄧㄠˊㄊㄨㄥˊ
迢 ㄊㄧㄠˊㄊㄨㄥˊ
挑 ㄊㄧㄠˇㄊㄧㄠˋ
窕 ㄊㄧㄠˇㄊㄧㄠˋㄨㄣˋ
跳 ㄊㄧㄠˋㄈㄨˋ
眺 ㄊㄧㄠˋㄈㄨˋ
糴 ㄊㄧㄠˋㄊㄨㄥˊㄨㄣˋ
天 ㄊㄧㄢ

添 ㄊㄧㄢ
田 ㄊㄧㄢˊ
填 ㄊㄧㄢˊㄊㄧㄢˋㄨㄥˊ
甜 ㄊㄧㄢˊㄊㄧㄢˋㄨㄥˊ
滇 ㄊㄧㄢˊㄊㄧㄢˋㄨㄥˊ
恬 ㄊㄧㄢˊㄊㄧㄢˋㄨㄥˊ
闐 ㄊㄧㄢˊㄊㄧㄢˋㄨㄥˊ
舔 ㄊㄧㄢˇㄊㄧㄢˋㄨㄥˊ
忝 ㄊㄧㄢˇㄊㄧㄢˋㄨㄥˊ
聽 ㄊㄧㄥˋㄊㄧㄥˋ
廳 ㄊㄧㄥˋㄊㄧㄥˋ
汀 ㄊㄧㄥˋㄊㄧㄥˋ
停 ㄊㄧㄥˊㄊㄧㄥˋ
庭 ㄊㄧㄥˊㄊㄧㄥˋ
廷 ㄊㄧㄥˊㄊㄧㄥˋ
亭 ㄊㄧㄥˊㄊㄧㄥˋ
蜓 ㄊㄧㄥˊㄊㄧㄥˋ
婷 ㄊㄧㄥˊㄊㄧㄥˋ
霆 ㄊㄧㄥˊㄊㄧㄥˋ
艇 ㄊㄧㄥˇㄊㄧㄥˋ
挺 ㄊㄧㄥˇㄊㄧㄥˋ

町 ㄊㄧㄥˇㄊㄧㄥˋㄊㄨㄥˊ
梃 ㄊㄧㄥˇㄊㄧㄥˋㄊㄨㄥˊ
禿 ㄊㄨ
圖 ㄊㄨˊㄊㄨˋ
途 ㄊㄨˊㄊㄨˋㄊㄨㄥˊ
突 ㄊㄨˊㄊㄨˋㄊㄨㄥˊ
塗 ㄊㄨˊㄊㄨˋㄊㄨㄥˊ
徒 ㄊㄨˊㄊㄨˋㄊㄨㄥˊ
屠 ㄊㄨˊㄊㄨˋㄊㄨㄥˊ
凸 ㄊㄨˊㄊㄨˋㄊㄨㄥˊ
涂 ㄊㄨˊㄊㄨˋㄊㄨㄥˊ
荼 ㄊㄨˊㄊㄨˋㄊㄨㄥˊ
土 ㄊㄨˋ
吐 ㄊㄨˋㄊㄨˋ
兔 ㄊㄨˋㄊㄨˋ
吐 ㄊㄨˋㄊㄨˋㄨㄣˋ
唾 ㄊㄨˋㄊㄨˋㄨㄣˋ
脫 ㄊㄨㄛˋㄊㄨㄛˋㄅㄨㄥˋ
拖 ㄊㄨㄛˋㄊㄨㄛˋㄅㄨㄥˋ
托 ㄊㄨㄛˋㄊㄨㄛˋㄅㄨㄥˋ
託 ㄊㄨㄛˋㄊㄨㄛˋㄅㄨㄥˋ

駝 ㄊㄨㄛˊㄊㄨㄛˋㄅㄨㄥˋ
陀 ㄊㄨㄛˊㄊㄨㄛˋㄅㄨㄥˋ
沱 ㄊㄨㄛˊㄊㄨㄛˋㄅㄨㄥˋ
馱 ㄊㄨㄛˊㄊㄨㄛˋㄅㄨㄥˋ
跎 ㄊㄨㄛˊㄊㄨㄛˋㄅㄨㄥˋ
鴕 ㄊㄨㄛˊㄊㄨㄛˋㄅㄨㄥˋ
橐 ㄊㄨㄛˊㄊㄨㄛˋㄅㄨㄥˋ
妥 ㄊㄨㄛˇㄊㄨㄛˋㄅㄨㄥˋ
橢 ㄊㄨㄛˇㄊㄨㄛˋㄅㄨㄥˋㄨㄣˋ
拓 ㄊㄨㄛˇㄊㄨㄛˋㄅㄨㄥˋ
唾 ㄊㄨㄛˇㄊㄨㄛˋㄅㄨㄥˋㄊㄨㄛˋ
推 ㄊㄨㄟˊㄅㄨㄥˋ
頹 ㄊㄨㄟˊㄊㄨㄛˋㄅㄨㄥˋ
腿 ㄊㄨㄟˇㄊㄨㄛˋㄅㄨㄥˋㄨㄣˋ
退 ㄊㄨㄟˋㄊㄨㄛˋ
湍 ㄊㄨㄢˊㄊㄨㄢˋㄅㄨㄥˋ
團 ㄊㄨㄢˊㄊㄨㄢˋㄈㄨㄥˊ
糰 ㄊㄨㄢˊㄊㄨㄢˋㄈㄨㄥˊㄨㄣˋ

吞 ㄊㄨㄣ
屯 ㄊㄨㄣˊ
飩 ㄊㄨㄣˋㄨㄣˋ
臀 ㄊㄨㄣˋㄈㄨㄥˊㄅㄨㄥˋ
豚 ㄊㄨㄣˋㄅㄨㄥˋ
囤 ㄊㄨㄣˋㄈㄨㄥˋ
褪 ㄊㄨㄟˋ
通 ㄊㄨㄥ
恫 ㄊㄨㄥˋ
同 ㄊㄨㄥˊ
童 ㄊㄨㄥˊㄓㄨㄥˊ
銅 ㄊㄨㄥˊㄅㄨㄥˋ
筒 ㄊㄨㄥˊㄊㄨㄥˋ
桐 ㄊㄨㄥˊㄊㄨㄥˋㄅㄨㄥˋ
潼 ㄊㄨㄥˊㄊㄨㄥˋㄅㄨㄥˋ
瞳 ㄊㄨㄥˊㄊㄨㄥˋㄅㄨㄥˋ
峒 ㄊㄨㄥˊㄊㄨㄥˋㄅㄨㄥˋㄨㄣˋ
彤 ㄊㄨㄥˊㄊㄨㄥˋㄅㄨㄥˋㄨㄣˋ
侗 ㄊㄨㄥˊㄊㄨㄥˋㄅㄨㄥˋㄨㄣˋ
僮 ㄊㄨㄥˊㄊㄨㄥˋㄅㄨㄥˋㄨㄣˋ
統 ㄊㄨㄥˊㄊㄨㄥˋㄅㄨㄥˋㄨㄣˋㄅㄨㄥˋ

筒 ㄊㄨㄥˊㄊㄨㄥˋㄅㄨㄥˋ
桶 ㄊㄨㄥˊㄊㄨㄥˋㄅㄨㄥˋㄨㄣˋ
痛 ㄊㄨㄥˋㄊㄨㄥˋ
衕 ㄊㄨㄥˋㄊㄨㄥˋㄅㄨㄥˋ
慟 ㄊㄨㄥˋㄊㄨㄥˋㄅㄨㄥˋㄨㄣˋ
ㄅㄨㄥˋ
那 ㄅㄨㄛˋㄅㄨㄛˋㄅㄨㄥˋ
拿 ㄅㄨㄛˊㄅㄨㄛˋㄅㄨㄥˋ
那 ㄅㄨㄛˋㄅㄨㄛˋㄅㄨㄥˋㄅㄨㄥˋ
哪 ㄅㄨㄛˋㄅㄨㄛˋㄅㄨㄥˋㄅㄨㄥˋㄅㄨㄥˋ
那 ㄅㄨㄛˋㄅㄨㄛˋㄅㄨㄥˋㄅㄨㄥˋㄅㄨㄥˋㄅㄨㄥˋ
納 ㄅㄨㄛˋㄅㄨㄛˋㄅㄨㄥˋㄅㄨㄥˋㄅㄨㄥˋㄅㄨㄥˋㄅㄨㄥˋ
吶 ㄅㄨㄛˋㄅㄨㄛˋㄅㄨㄥˋㄅㄨㄥˋㄅㄨㄥˋㄅㄨㄥˋㄅㄨㄥˋㄅㄨㄥˋ
捺 ㄅㄨㄛˋㄅㄨㄛˋㄅㄨㄥˋㄅㄨㄥˋㄅㄨㄥˋㄅㄨㄥˋㄅㄨㄥˋㄅㄨㄥˋㄅㄨㄥˋ
哪 ㄅㄨㄛˋㄅㄨㄛˋㄅㄨㄥˋㄅㄨㄥˋㄅㄨㄥˋㄅㄨㄥˋㄅㄨㄥˋㄅㄨㄥˋㄅㄨㄥˋㄅㄨㄥˋ
訥 ㄅㄨㄛˋㄅㄨㄛˋㄅㄨㄥˋㄅㄨㄥˋㄅㄨㄥˋㄅㄨㄥˋㄅㄨㄥˋㄅㄨㄥˋㄅㄨㄥˋㄅㄨㄥˋㄅㄨㄥˋ
呢 ㄅㄨㄛˋㄅㄨㄛˋㄅㄨㄥˋㄅㄨㄥˋㄅㄨㄥˋㄅㄨㄥˋㄅㄨㄥˋㄅㄨㄥˋㄅㄨㄥˋㄅㄨㄥˋㄅㄨㄥˋㄅㄨㄥˋ

乃 ㄅㄨㄞˇ
奶 ㄅㄨㄞˇㄅㄨㄞˇ
迺 ㄅㄨㄞˇㄅㄨㄞˇㄅㄨㄥˋ
氖 ㄅㄨㄞˇㄅㄨㄞˇㄅㄨㄥˋㄅㄨㄥˋ
耐 ㄅㄨㄞˋㄅㄨㄞˋㄅㄨㄥˋ
奈 ㄅㄨㄞˋㄅㄨㄞˋㄅㄨㄥˋㄅㄨㄥˋ
鼐 ㄅㄨㄞˋㄅㄨㄞˋㄅㄨㄥˋㄅㄨㄥˋㄅㄨㄥˋ
ㄅㄨㄟˇ
餒 ㄅㄨㄟˋㄅㄨㄟˋㄅㄨㄥˋ
ㄅㄨㄟˋ
內 ㄅㄨㄟˋㄅㄨㄥˋ
氣 ㄅㄨㄟˋㄅㄨㄟˋㄅㄨㄥˋㄅㄨㄥˋ
ㄅㄠˋ
撓 ㄅㄠˋㄅㄨㄥˋㄅㄨㄥˋ
鐃 ㄅㄠˋㄅㄨㄥˋㄅㄨㄥˋㄅㄨㄥˋ
譊 ㄅㄠˋㄅㄨㄥˋㄅㄨㄥˋㄅㄨㄥˋㄅㄨㄥˋ
呶 ㄅㄠˋㄅㄨㄥˋㄅㄨㄥˋㄅㄨㄥˋㄅㄨㄥˋㄅㄨㄥˋ
ㄅㄠˋ
腦 ㄅㄠˋㄅㄨㄥˋㄅㄨㄥˋㄅㄨㄥˋㄅㄨㄥˋㄅㄨㄥˋ
惱 ㄅㄠˋㄅㄨㄥˋㄅㄨㄥˋㄅㄨㄥˋㄅㄨㄥˋㄅㄨㄥˋㄅㄨㄥˋ
瑙 ㄅㄠˋㄅㄨㄥˋㄅㄨㄥˋㄅㄨㄥˋㄅㄨㄥˋㄅㄨㄥˋㄅㄨㄥˋㄅㄨㄥˋ
ㄅㄠˋ
鬧 ㄅㄠˋㄅㄨㄥˋ
淖 ㄅㄠˋㄅㄨㄥˋㄅㄨㄥˋㄅㄨㄥˋ

耨 ㄋㄡˋ
ㄋㄢˊ
南 ㄋㄢˊㄋㄢˋ
難 ㄋㄢˊㄋㄢˋㄋㄢˋ
男 ㄋㄢˊㄋㄢˋㄋㄢˋㄋㄢˋ
楠 ㄋㄢˊㄋㄢˋㄋㄢˋㄋㄢˋㄋㄢˋ
喃 ㄋㄢˊㄋㄢˋㄋㄢˋㄋㄢˋㄋㄢˋㄋㄢˋ
蒲 ㄋㄢˊㄋㄢˋㄋㄢˋㄋㄢˋㄋㄢˋㄋㄢˋㄋㄢˋ
ㄋㄢˋ
赧 ㄋㄢˋㄋㄢˋㄋㄢˋㄋㄢˋㄋㄢˋㄋㄢˋㄋㄢˋㄋㄢˋ
難 ㄋㄢˋㄋㄢˋㄋㄢˋㄋㄢˋㄋㄢˋㄋㄢˋㄋㄢˋㄋㄢˋㄋㄢˋ
ㄋㄢˋ
嫩 ㄋㄢˋㄋㄢˋㄋㄢˋㄋㄢˋㄋㄢˋㄋㄢˋㄋㄢˋㄋㄢˋㄋㄢˋㄋㄢˋ
ㄋㄢˋ
囊 ㄋㄢˋㄋㄢˋㄋㄢˋㄋㄢˋㄋㄢˋㄋㄢˋㄋㄢˋㄋㄢˋㄋㄢˋㄋㄢˋㄋㄢˋ
ㄋㄢˋ
曩 ㄋㄢˋㄋㄢˋㄋㄢˋㄋㄢˋㄋㄢˋㄋㄢˋㄋㄢˋㄋㄢˋㄋㄢˋㄋㄢˋㄋㄢˋㄋㄢˋ
ㄋㄢˋ
能 ㄋㄢˋㄋㄢˋㄋㄢˋㄋㄢˋㄋㄢˋㄋㄢˋㄋㄢˋㄋㄢˋㄋㄢˋㄋㄢˋㄋㄢˋㄋㄢˋㄋㄢˋ
ㄋㄧˊ
呢 ㄋㄧˊㄋㄧˊㄋㄧˊㄋㄧˊㄋㄧˊㄋㄧˊㄋㄧˊㄋㄧˊㄋㄧˊㄋㄧˊㄋㄧˊㄋㄧˊㄋㄧˊ
尼 ㄋㄧˊㄋㄧˊㄋㄧˊㄋㄧˊㄋㄧˊㄋㄧˊㄋㄧˊㄋㄧˊㄋㄧˊㄋㄧˊㄋㄧˊㄋㄧˊㄋㄧˊ
泥 ㄋㄧˊㄋㄧˊㄋㄧˊㄋㄧˊㄋㄧˊㄋㄧˊㄋㄧˊㄋㄧˊㄋㄧˊㄋㄧˊㄋㄧˊㄋㄧˊㄋㄧˊ
婗 ㄋㄧˊㄋㄧˊㄋㄧˊㄋㄧˊㄋㄧˊㄋㄧˊㄋㄧˊㄋㄧˊㄋㄧˊㄋㄧˊㄋㄧˊㄋㄧˊㄋㄧˊ

霓 ㄋㄧˊㄋㄧˊㄋㄧˊㄋㄧˊㄋㄧˊㄋㄧˊㄋㄧˊㄋㄧˊㄋㄧˊㄋㄧˊㄋㄧˊㄋㄧˊㄋㄧˊ
倪 ㄋㄧˊㄋㄧˊㄋㄧˊㄋㄧˊㄋㄧˊㄋㄧˊㄋㄧˊㄋㄧˊㄋㄧˊㄋㄧˊㄋㄧˊㄋㄧˊㄋㄧˊ
怩 ㄋㄧˊㄋㄧˊㄋㄧˊㄋㄧˊㄋㄧˊㄋㄧˊㄋㄧˊㄋㄧˊㄋㄧˊㄋㄧˊㄋㄧˊㄋㄧˊㄋㄧˊ
ㄋㄧˇ
你 ㄋㄧˇㄋㄧˇㄋㄧˇㄋㄧˇㄋㄧˇㄋㄧˇㄋㄧˇㄋㄧˇㄋㄧˇㄋㄧˇㄋㄧˇㄋㄧˇㄋㄧˇ
擬 ㄋㄧˇㄋㄧˇㄋㄧˇㄋㄧˇㄋㄧˇㄋㄧˇㄋㄧˇㄋㄧˇㄋㄧˇㄋㄧˇㄋㄧˇㄋㄧˇㄋㄧˇ
妳 ㄋㄧˇㄋㄧˇㄋㄧˇㄋㄧˇㄋㄧˇㄋㄧˇㄋㄧˇㄋㄧˇㄋㄧˇㄋㄧˇㄋㄧˇㄋㄧˇㄋㄧˇ
ㄋㄧˋ
逆 ㄋㄧˋㄋㄧˋㄋㄧˋㄋㄧˋㄋㄧˋㄋㄧˋㄋㄧˋㄋㄧˋㄋㄧˋㄋㄧˋㄋㄧˋㄋㄧˋㄋㄧˋ
溺 ㄋㄧˋㄋㄧˋㄋㄧˋㄋㄧˋㄋㄧˋㄋㄧˋㄋㄧˋㄋㄧˋㄋㄧˋㄋㄧˋㄋㄧˋㄋㄧˋㄋㄧˋ
匿 ㄋㄧˋㄋㄧˋㄋㄧˋㄋㄧˋㄋㄧˋㄋㄧˋㄋㄧˋㄋㄧˋㄋㄧˋㄋㄧˋㄋㄧˋㄋㄧˋㄋㄧˋ
膩 ㄋㄧˋㄋㄧˋㄋㄧˋㄋㄧˋㄋㄧˋㄋㄧˋㄋㄧˋㄋㄧˋㄋㄧˋㄋㄧˋㄋㄧˋㄋㄧˋㄋㄧˋ
ㄋㄧㄝ
捏 ㄋㄧㄝˋㄋㄧㄝˋㄋㄧㄝˋㄋㄧㄝˋㄋㄧㄝˋㄋㄧㄝˋㄋㄧㄝˋㄋㄧㄝˋㄋㄧㄝˋㄋㄧㄝˋㄋㄧㄝˋㄋㄧㄝˋ
ㄋㄧㄝˋ
鎳 ㄋㄧㄝˋㄋㄧㄝˋㄋㄧㄝˋㄋㄧㄝˋㄋㄧㄝˋㄋㄧㄝˋㄋㄧㄝˋㄋㄧㄝˋㄋㄧㄝˋㄋㄧㄝˋㄋㄧㄝˋㄋㄧㄝˋ
孽 ㄋㄧㄝˋㄋㄧㄝˋㄋㄧㄝˋㄋㄧㄝˋㄋㄧㄝˋㄋㄧㄝˋㄋㄧㄝˋㄋㄧㄝˋㄋㄧㄝˋㄋㄧㄝˋㄋㄧㄝˋㄋㄧㄝˋ
聶 ㄋㄧㄝˋㄋㄧㄝˋㄋㄧㄝˋㄋㄧㄝˋㄋㄧㄝˋㄋㄧㄝˋㄋㄧㄝˋㄋㄧㄝˋㄋㄧㄝˋㄋㄧㄝˋㄋㄧㄝˋㄋㄧㄝˋ
躡 ㄋㄧㄝˋㄋㄧㄝˋㄋㄧㄝˋㄋㄧㄝˋㄋㄧㄝˋㄋㄧㄝˋㄋㄧㄝˋㄋㄧㄝˋㄋㄧㄝˋㄋㄧㄝˋㄋㄧㄝˋㄋㄧㄝˋ
涅 ㄋㄧㄝˋㄋㄧㄝˋㄋㄧㄝˋㄋㄧㄝˋㄋㄧㄝˋㄋㄧㄝˋㄋㄧㄝˋㄋㄧㄝˋㄋㄧㄝˋㄋㄧㄝˋㄋㄧㄝˋㄋㄧㄝˋ
ㄋㄧㄠˇ
鳥 ㄋㄧㄠˇㄋㄧㄠˇㄋㄧㄠˇㄋㄧㄠˇㄋㄧㄠˇㄋㄧㄠˇㄋㄧㄠˇㄋㄧㄠˇㄋㄧㄠˇㄋㄧㄠˇㄋㄧㄠˇㄋㄧㄠˇ
嫋 ㄋㄧㄠˇㄋㄧㄠˇㄋㄧㄠˇㄋㄧㄠˇㄋㄧㄠˇㄋㄧㄠˇㄋㄧㄠˇㄋㄧㄠˇㄋㄧㄠˇㄋㄧㄠˇㄋㄧㄠˇㄋㄧㄠˇ
ㄋㄧㄠˋ
尿 ㄋㄧㄠˋㄋㄧㄠˋㄋㄧㄠˋㄋㄧㄠˋㄋㄧㄠˋㄋㄧㄠˋㄋㄧㄠˋㄋㄧㄠˋㄋㄧㄠˋㄋㄧㄠˋㄋㄧㄠˋㄋㄧㄠˋ

牛 ㄋㄧㄡˊ
紐 ㄋㄧㄡˊㄋㄧㄡˊㄅㄧ
扭 ㄋㄧㄡˊㄋㄧㄡˊㄅㄧ
鈕 ㄋㄧㄡˊㄋㄧㄡˊㄅㄧ
ㄋㄧㄡˇ
謬 ㄋㄧㄡˋㄋㄧㄡˋㄅㄧ
ㄋㄧㄢ
蔫 ㄋㄧㄢㄋㄧㄢㄋㄧㄢㄋㄧㄢㄋㄧㄢㄋㄧㄢㄋㄧㄢㄋㄧㄢㄋㄧㄢㄋㄧㄢㄋㄧㄢㄋㄧㄢ
ㄋㄧㄢˊ
年 ㄋㄧㄢˊㄋㄧㄢˊㄋㄧㄢˊㄋㄧㄢˊㄋㄧㄢˊㄋㄧㄢˊㄋㄧㄢˊㄋㄧㄢˊㄋㄧㄢˊㄋㄧㄢˊㄋㄧㄢˊㄋㄧㄢˊ
黏 ㄋㄧㄢˊㄋㄧㄢˊㄋㄧㄢˊㄋㄧㄢˊㄋㄧㄢˊㄋㄧㄢˊㄋㄧㄢˊㄋㄧㄢˊㄋㄧㄢˊㄋㄧㄢˊㄋㄧㄢˊㄋㄧㄢˊ
粘 ㄋㄧㄢˊㄋㄧㄢˊㄋㄧㄢˊㄋㄧㄢˊㄋㄧㄢˊㄋㄧㄢˊㄋㄧㄢˊㄋㄧㄢˊㄋㄧㄢˊㄋㄧㄢˊㄋㄧㄢˊㄋㄧㄢˊ
拈 ㄋㄧㄢˊㄋㄧㄢˊㄋㄧㄢˊㄋㄧㄢˊㄋㄧㄢˊㄋㄧㄢˊㄋㄧㄢˊㄋㄧㄢˊㄋㄧㄢˊㄋㄧㄢˊㄋㄧㄢˊㄋㄧㄢˊ
ㄋㄧㄢˇ
輾 ㄋㄧㄢˇㄋㄧㄢˇㄋㄧㄢˇㄋㄧㄢˇㄋㄧㄢˇㄋㄧㄢˇㄋㄧㄢˇㄋㄧㄢˇㄋㄧㄢˇㄋㄧㄢˇㄋㄧㄢˇㄋㄧㄢˇ
碾 ㄋㄧㄢˇㄋㄧㄢˇㄋㄧㄢˇㄋㄧㄢˇㄋㄧㄢˇㄋㄧㄢˇㄋㄧㄢˇㄋㄧㄢˇㄋㄧㄢˇㄋㄧㄢˇㄋㄧㄢˇㄋㄧㄢˇ
捻 ㄋㄧㄢˇㄋㄧㄢˇㄋㄧㄢˇㄋㄧㄢˇㄋㄧㄢˇㄋㄧㄢˇㄋㄧㄢˇㄋㄧㄢˇㄋㄧㄢˇㄋㄧㄢˇㄋㄧㄢˇㄋㄧㄢˇ
撚 ㄋㄧㄢˇㄋㄧㄢˇㄋㄧㄢˇㄋㄧㄢˇㄋㄧㄢˇㄋㄧㄢˇㄋㄧㄢˇㄋㄧㄢˇㄋㄧㄢˇㄋㄧㄢˇㄋㄧㄢˇㄋㄧㄢˇ
ㄋㄧㄤˋ
念 ㄋㄧㄤˋㄋㄧㄤˋㄋㄧㄤˋㄋㄧㄤˋㄋㄧㄤˋㄋㄧㄤˋㄋㄧㄤˋㄋㄧㄤˋㄋㄧㄤˋㄋㄧㄤˋㄋㄧㄤˋㄋㄧㄤˋ
廿 ㄋㄧㄤˋㄋㄧㄤˋㄋㄧㄤˋㄋㄧㄤˋㄋㄧㄤˋㄋㄧㄤˋㄋㄧㄤˋㄋㄧㄤˋㄋㄧㄤˋㄋㄧㄤˋㄋㄧㄤˋㄋㄧㄤˋ
唸 ㄋㄧㄤˋㄋㄧㄤˋㄋㄧㄤˋㄋㄧㄤˋㄋㄧㄤˋㄋㄧㄤˋㄋㄧㄤˋㄋㄧㄤˋㄋㄧㄤˋㄋㄧㄤˋㄋㄧㄤˋㄋㄧㄤˋ

FIG-11-8

FIG-11-9

流留劉硫琉榴瀏瘤旒
柳
六陸餾遛
連聯憐廉蓮簾鐮鰱
帘連璉
臉
練鍊戀煉鏈殮斂
林臨鄰淋鱗麟霖磷琳燐遴
磨
稟凜懍
吝躑藺
量良糧涼粱檃
兩倆啢
量亮諒輛
靈零陵鈴齡凌伶玲菱羚綾聆苓鴒囹
領嶺
令另
噜
爐
盧蘆廬臚瀘顱鑪
魯虜擄櫓
路陸露錄鹿碌祿麓鷺戮漉賂
羅螺蘿鑼囉邏騾籮
裸
落洛駱絡濼酪
灤巒鑾鸞
卵
囉
羅螺蘿鑼囉邏騾籮
裸
落洛駱絡濼酪
灤巒鑾鸞
卵
亂
論輪倫崙淪綸侖掄圇
論
龍隆籠嚨瓏聾朧礌聾
隴攏
壠
攏
弄
驢閭櫚
旅屢呂履鋁縷侶褸
律綠率慮濾氣
略掠
格革隔閣
畧
擰
淋
嘎
噶軋
尬
哥歌割鴿擱胳戈疙
改
概蓋丐溉鈣
給
高
骼蛤膈
合葛
個各箇鉻
該垓
改
概蓋丐溉鈣
給
高

FIG-11-10

王18-11-11

ㄘㄜˋ 喀 ㄘㄜㄏㄇㄅ
ㄘㄞˋ 慙 ㄘㄜㄨㄟㄌ
ㄎㄞ 開 ㄎㄞㄇㄝ
ㄎㄞˇ 慨 ㄎㄞㄏㄨㄟ
ㄎㄞˋ 愷 ㄎㄞㄏㄩㄅㄧ
ㄎㄞˋ 慨 ㄎㄞㄏㄩㄅㄧ
ㄎㄞˋ 愾 ㄎㄞㄏㄨㄟㄅㄧ
ㄎㄠˇ 考 ㄎㄠㄘㄅㄅ
ㄎㄠˋ 烤 ㄎㄠㄘㄅㄅ
ㄎㄠˋ 攷 ㄎㄠㄘㄅㄅ
ㄎㄠˋ 靠 ㄎㄠㄅㄅㄅㄅ
ㄎㄠˋ 犒 ㄎㄠㄅㄅㄅㄅ
ㄎㄠˋ 銬 ㄎㄠㄅㄅㄅㄅ
ㄎㄡ 摳 ㄎㄡㄈ
ㄎㄡˋ 口 ㄎㄡㄅ

ㄎㄨㄣ 扣 ㄎㄨㄣㄅㄅ
ㄎㄨㄣˋ 寇 ㄎㄨㄣㄅㄅ
ㄎㄨㄣˋ 筘 ㄎㄨㄣㄅㄅ
ㄎㄨㄣˋ 叩 ㄎㄨㄣㄅㄅ
ㄎㄨㄣˋ 釦 ㄎㄨㄣㄅㄅ
ㄎㄢ 看 ㄎㄢㄅㄅㄅ
ㄎㄢˋ 刊 ㄎㄢㄅㄅㄅ
ㄎㄢˋ 堪 ㄎㄢㄅㄅㄅ
ㄎㄢˋ 戡 ㄎㄢㄅㄅㄅ
ㄎㄢˋ 勘 ㄎㄢㄅㄅㄅ
ㄎㄢˋ 砍 ㄎㄢㄅㄅㄅ
ㄎㄢˋ 侃 ㄎㄢㄅㄅㄅ
ㄎㄢˋ 坎 ㄎㄢㄅㄅㄅ
ㄎㄢˋ 崁 ㄎㄢㄅㄅㄅ
ㄎㄢˋ 檻 ㄎㄢㄅㄅㄅ
ㄎㄢˋ 看 ㄎㄢㄅㄅㄅ
ㄎㄢˋ 瞰 ㄎㄢㄅㄅㄅ
ㄎㄢˋ 勘 ㄎㄢㄅㄅㄅ
ㄎㄣˇ 肯 ㄎㄣㄅㄅ
ㄎㄣˋ 墾 ㄎㄣㄅㄅ
ㄎㄣˋ 懇 ㄎㄣㄅㄅ

ㄎㄤ 啃 ㄎㄤㄅㄅㄅ
ㄎㄤˋ 康 ㄎㄤㄅㄅ
ㄎㄤˋ 慷 ㄎㄤㄅㄅ
ㄎㄤˋ 糠 ㄎㄤㄅㄅ
ㄎㄤˋ 扛 ㄎㄤㄅㄅ
ㄎㄤˋ 慷 ㄎㄤㄅㄅ
ㄎㄤˋ 抗 ㄎㄤㄅㄅ
ㄎㄤˋ 伉 ㄎㄤㄅㄅ
ㄎㄤˋ 炕 ㄎㄤㄅㄅ
ㄎㄤ 坑 ㄎㄤㄅㄅ
ㄎㄤ 鏗 ㄎㄤㄅㄅ
ㄎㄨ 哭 ㄎㄨㄅㄅ
ㄎㄨ 枯 ㄎㄨㄅㄅ
ㄎㄨ 窟 ㄎㄨㄅㄅ
ㄎㄨ 骷 ㄎㄨㄅㄅ
ㄎㄨˇ 苦 ㄎㄨㄅㄅ
ㄎㄨˋ 庫 ㄎㄨㄅㄅ

ㄎㄨㄟ 褲 ㄎㄨㄟㄅㄅ
ㄎㄨㄟ 酷 ㄎㄨㄟㄅㄅ
ㄎㄨㄚ 誇 ㄎㄨㄚㄅㄅ
ㄎㄨㄚˇ 夸 ㄎㄨㄚㄅㄅ
ㄎㄨㄚˇ 垮 ㄎㄨㄚㄅㄅ
ㄎㄨㄚˋ 跨 ㄎㄨㄚㄅㄅ
ㄎㄨㄛ 括 ㄎㄨㄛㄅㄅ
ㄎㄨㄛˋ 擴 ㄎㄨㄛㄅㄅ
ㄎㄨㄛˋ 闊 ㄎㄨㄛㄅㄅ
ㄎㄨㄛˋ 廓 ㄎㄨㄛㄅㄅ
ㄎㄨㄛˋ 濶 ㄎㄨㄛㄅㄅ
ㄎㄨㄞˋ 會 ㄎㄨㄞㄅㄅ
ㄎㄨㄞˋ 快 ㄎㄨㄞㄅㄅ
ㄎㄨㄞˋ 塊 ㄎㄨㄞㄅㄅ
ㄎㄨㄞˋ 筷 ㄎㄨㄞㄅㄅ
ㄎㄨㄞˋ 檜 ㄎㄨㄞㄅㄅ
ㄎㄨㄞˋ 澮 ㄎㄨㄞㄅㄅ
ㄎㄨㄟ 劊 ㄎㄨㄟㄅㄅ
ㄎㄨㄟˋ 盔 ㄎㄨㄟㄅㄅ

ㄎㄨㄣ 窺 ㄎㄨㄣㄅㄅ
ㄎㄨㄣˋ 逵 ㄎㄨㄣㄅㄅ
ㄎㄨㄣˋ 魁 ㄎㄨㄣㄅㄅ
ㄎㄨㄣˋ 奎 ㄎㄨㄣㄅㄅ
ㄎㄨㄣˋ 夔 ㄎㄨㄣㄅㄅ
ㄎㄨㄣˋ 葵 ㄎㄨㄣㄅㄅ
ㄎㄨㄣˋ 睽 ㄎㄨㄣㄅㄅ
ㄎㄨㄥˇ 傀 ㄎㄨㄥㄅㄅ
ㄎㄨㄥˋ 愧 ㄎㄨㄥㄅㄅ
ㄎㄨㄥˋ 潰 ㄎㄨㄥㄅㄅ
ㄎㄨㄥˋ 匱 ㄎㄨㄥㄅㄅ
ㄎㄨㄥˋ 簣 ㄎㄨㄥㄅㄅ
ㄎㄨㄥˋ 喟 ㄎㄨㄥㄅㄅ
ㄎㄨㄢ 寬 ㄎㄨㄢㄅㄅ
ㄎㄨㄢˇ 款 ㄎㄨㄢㄅㄅ
ㄎㄨㄣ 昆 ㄎㄨㄣㄅㄅ
ㄎㄨㄣ 崑 ㄎㄨㄣㄅㄅ
ㄎㄨㄣ 坤 ㄎㄨㄣㄅㄅ
ㄎㄨㄣ 錕 ㄎㄨㄣㄅㄅ

ㄎㄨㄣ 焜 ㄎㄨㄣㄅㄅ
ㄎㄨㄣ 堃 ㄎㄨㄣㄅㄅ
ㄎㄨㄣ 琨 ㄎㄨㄣㄅㄅ
ㄎㄨㄣˇ 綑 ㄎㄨㄣㄅㄅ
ㄎㄨㄣˋ 捆 ㄎㄨㄣㄅㄅ
ㄎㄨㄣˋ 悃 ㄎㄨㄣㄅㄅ
ㄎㄨㄣˋ 梱 ㄎㄨㄣㄅㄅ
ㄎㄨㄣˋ 困 ㄎㄨㄣㄅㄅ
ㄎㄨㄣˋ 睏 ㄎㄨㄣㄅㄅ
ㄎㄨㄤ 匡 ㄎㄨㄤㄅㄅ
ㄎㄨㄤ 筐 ㄎㄨㄤㄅㄅ
ㄎㄨㄤˋ 劻 ㄎㄨㄤㄅㄅ
ㄎㄨㄤˋ 狂 ㄎㄨㄤㄅㄅ
ㄎㄨㄤˋ 誑 ㄎㄨㄤㄅㄅ
ㄎㄨㄤˋ 況 ㄎㄨㄤㄅㄅ
ㄎㄨㄤˋ 礦 ㄎㄨㄤㄅㄅ
ㄎㄨㄤ 眶 ㄎㄨㄤㄅㄅ
ㄎㄨㄤ 框 ㄎㄨㄤㄅㄅ
ㄎㄨㄤˋ 曠 ㄎㄨㄤㄅㄅ
ㄎㄨㄤˋ 壙 ㄎㄨㄤㄅㄅ

ㄎㄨㄥ 空 ㄎㄨㄥㄅㄅ
ㄎㄨㄥ 崆 ㄎㄨㄥㄅㄅ
ㄎㄨㄥˇ 恐 ㄎㄨㄥㄅㄅ
ㄎㄨㄥˇ 孔 ㄎㄨㄥㄅㄅ
ㄎㄨㄥˋ 空 ㄎㄨㄥㄅㄅ
ㄎㄨㄥˋ 控 ㄎㄨㄥㄅㄅ
ㄏㄚ 哈 ㄏㄚㄅㄅㄅ
ㄏㄚˇ 蝦 ㄏㄚㄅㄅ
ㄏㄜ 喝 ㄏㄜㄅㄅ
ㄏㄜ 呵 ㄏㄜㄅㄅ
ㄏㄜˋ 和 ㄏㄜㄅㄅ
ㄏㄜˋ 合 ㄏㄜㄅㄅ
ㄏㄜˋ 河 ㄏㄜㄅㄅ
ㄏㄜˋ 何 ㄏㄜㄅㄅ
ㄏㄜˋ 荷 ㄏㄜㄅㄅ
ㄏㄜˋ 核 ㄏㄜㄅㄅ
ㄏㄜˋ 盒 ㄏㄜㄅㄅ
ㄏㄜˋ 褐 ㄏㄜㄅㄅ
ㄏㄜˋ 劾 ㄏㄜㄅㄅ

ㄏㄜ 禾 ㄏㄜㄅㄅ
ㄏㄜ 闔 ㄏㄜㄅㄅ
ㄏㄜ 龢 ㄏㄜㄅㄅ
ㄏㄜ 涸 ㄏㄜㄅㄅ
ㄏㄜ 紇 ㄏㄜㄅㄅ
ㄏㄜ 滆 ㄏㄜㄅㄅ
ㄏㄜ 閣 ㄏㄜㄅㄅ
ㄏㄜ 覈 ㄏㄜㄅㄅ
ㄏㄜˋ 和 ㄏㄜㄅㄅ
ㄏㄜˋ 喝 ㄏㄜㄅㄅ
ㄏㄜˋ 荷 ㄏㄜㄅㄅ
ㄏㄜˋ 嚇 ㄏㄜㄅㄅ
ㄏㄜˋ 賀 ㄏㄜㄅㄅ
ㄏㄜˋ 赫 ㄏㄜㄅㄅ
ㄏㄜˋ 鶴 ㄏㄜㄅㄅ
ㄏㄜˋ 郝 ㄏㄜㄅㄅ
ㄏㄞ 咳 ㄏㄞㄅㄅ
ㄏㄞ 嗨 ㄏㄞㄅㄅ
ㄏㄞˋ 還 ㄏㄞㄅㄅ
ㄏㄞˋ 孩 ㄏㄞㄅㄅ
ㄏㄞˋ 骸 ㄏㄞㄅㄅ

ㄏㄠˇ 海 ㄏㄠㄅㄅ
ㄏㄠˋ 害 ㄏㄠㄅㄅ
ㄏㄠˋ 亥 ㄏㄠㄅㄅ
ㄏㄠˋ 駭 ㄏㄠㄅㄅ
ㄏㄠˋ 氦 ㄏㄠㄅㄅ
ㄏㄟ 黑 ㄏㄟㄅㄅ
ㄏㄟ 嘿 ㄏㄟㄅㄅ
ㄏㄠ 蒿 ㄏㄠㄅㄅ
ㄏㄠˋ 號 ㄏㄠㄅㄅ
ㄏㄠˋ 毫 ㄏㄠㄅㄅ
ㄏㄠˋ 豪 ㄏㄠㄅㄅ
ㄏㄠˋ 濠 ㄏㄠㄅㄅ
ㄏㄠˋ 壕 ㄏㄠㄅㄅ
ㄏㄠˋ 嚎 ㄏㄠㄅㄅ
ㄏㄠˋ 嚎 ㄏㄠㄅㄅ
ㄏㄠˋ 嗥 ㄏㄠㄅㄅ
ㄏㄠˋ 好 ㄏㄠㄅㄅ
ㄏㄠˋ 好 ㄏㄠㄅㄅ
ㄏㄠˋ 號 ㄏㄠㄅㄅ
ㄏㄠ 耗 ㄏㄠㄅㄅ

ㄏㄡ 浩 ㄏㄡㄅㄅ
ㄏㄡ 皓 ㄏㄡㄅㄅ
ㄏㄡ 鎬 ㄏㄡㄅㄅ
ㄏㄡ 号 ㄏㄡㄅㄅ
ㄏㄡˇ 昊 ㄏㄡㄅㄅ
ㄏㄡˋ 猴 ㄏㄡㄅㄅ
ㄏㄡˋ 侯 ㄏㄡㄅㄅ
ㄏㄡˋ 喉 ㄏㄡㄅㄅ
ㄏㄡˋ 吼 ㄏㄡㄅㄅ
ㄏㄡˋ 後 ㄏㄡㄅㄅ
ㄏㄡˋ 候 ㄏㄡㄅㄅ
ㄏㄡˋ 厚 ㄏㄡㄅㄅ
ㄏㄡˋ 后 ㄏㄡㄅㄅ
ㄏㄢ 蚶 ㄏㄢㄅㄅ
ㄏㄢ 酣 ㄏㄢㄅㄅ
ㄏㄢˋ 鼾 ㄏㄢㄅㄅ
ㄏㄢˋ 含 ㄏㄢㄅㄅ
ㄏㄢˋ 寒 ㄏㄢㄅㄅ
ㄏㄢˋ 汗 ㄏㄢㄅㄅ
ㄏㄢˋ 韓 ㄏㄢㄅㄅ

王18-11-12

ㄏㄨㄛˋ
ㄏㄨㄛˋ
ㄏㄨㄛˋ

FIG-11-13

ㄐㄧㄝ
ㄐㄧㄝㄙㄊㄅ
ㄐㄧㄝㄗㄅㄉㄅ
ㄐㄧㄝㄘㄅㄉㄅ
ㄐㄧㄝㄘㄅㄉㄅ
ㄐㄧㄝㄘ

王18-11-14

泣 ㄑㄧˋ ㄅ
迄 ㄑㄧˋ ㄆ
砌 ㄑㄧˋ ㄉㄅ
緝 ㄑㄧˋ ㄊㄣㄦ
憩 ㄑㄧˋ ㄌㄝㄊ
訖 ㄑㄧˋ ㄌㄨㄟ
ㄑㄧˇ
卡 ㄑㄧㄚㄊㄊ
ㄑㄧㄚˇ
恰 ㄑㄧㄚㄉㄣ
ㄑㄧㄝ
切 ㄑㄧㄝㄉㄅ
ㄑㄧㄝˇ
茄 ㄑㄧㄝㄝㄉㄣ
伽 ㄑㄧㄝㄣㄣ
ㄑㄧㄝˇ
且 ㄑㄧㄝㄇㄧ
ㄑㄧㄝˋ
切 ㄑㄧㄝㄊㄅ
竊 ㄑㄧㄝㄇㄨㄇ
妾 ㄑㄧㄝㄅㄣ
ㄑㄧㄠ
敲 ㄑㄧㄠㄉㄇㄨㄟ
蹺 ㄑㄧㄠㄈㄦ
鍬 ㄑㄧㄠㄅㄛ

ㄑㄧˊ
琦 ㄑㄧㄨㄒㄊ
歧 ㄑㄧㄡㄨㄨ
琪 ㄑㄧㄨㄝㄉ
麒 ㄑㄧㄨㄝㄅ
臍 ㄑㄧㄩㄣㄣ
畦 ㄑㄧㄩㄈㄊㄊ
鰭 ㄑㄧㄩㄣㄊㄇㄅ
薺 ㄑㄧㄩㄝㄅㄣ
耆 ㄑㄧㄩㄝㄊㄣ
祺 ㄑㄧㄩㄅ
淇 ㄑㄧㄩㄝㄉ
ㄑㄧˇ
起 ㄑㄧㄝㄇㄅ
啟 ㄑㄧㄅㄨ
豈 ㄑㄧㄩㄅ
乞 ㄑㄧㄅㄨㄅ
啓 ㄑㄧㄅㄅㄨ
綺 ㄑㄧㄅㄣㄊ
ㄑㄧˋ
氣 ㄑㄧㄍㄨㄅ
器 ㄑㄧㄑ
汽 ㄑㄧㄅㄨㄅ
棄 ㄑㄧㄅㄉㄅ
企 ㄑㄧㄅㄣㄣ
契 ㄑㄧㄅㄨㄉㄅ

ㄑㄧㄝˊ
覺 ㄑㄧㄝㄨㄅ
決 ㄑㄧㄝㄅㄨㄉ
角 ㄑㄧㄝㄅㄣㄅ
絕 ㄑㄧㄝㄅㄣㄉㄅ
爵 ㄑㄧㄝㄅㄅㄨㄅ
掘 ㄑㄧㄝㄅㄅㄅㄨㄅ
嚼 ㄑㄧㄝㄅㄅㄅㄨㄅ
厥 ㄑㄧㄝㄅㄅㄅㄨㄅ
珏 ㄑㄧㄝㄅㄅㄅㄨㄅ
鱖 ㄑㄧㄝㄅㄅㄅㄨㄅ
訣 ㄑㄧㄝㄅㄅㄅㄨㄅ
獗 ㄑㄧㄝㄅㄅㄅㄨㄅ
蕨 ㄑㄧㄝㄅㄅㄅㄨㄅ
攫 ㄑㄧㄝㄅㄅㄅㄨㄅ
崛 ㄑㄧㄝㄅㄅㄅㄨㄅ
噱 ㄑㄧㄝㄅㄅㄅㄨㄅ
桶 ㄑㄧㄝㄅㄅㄅㄨㄅ
孓 ㄑㄧㄝㄅㄅㄅㄨㄅ
ㄑㄧㄝ
捐 ㄑㄧㄝㄅㄅㄅㄨㄅ
娟 ㄑㄧㄝㄅㄅㄅㄨㄅ
鵑 ㄑㄧㄝㄅㄅㄅㄨㄅ
涓 ㄑㄧㄝㄅㄅㄅㄨㄅ
鐫 ㄑㄧㄝㄅㄅㄅㄨㄅ

ㄑㄧㄤˊ
捲 ㄑㄧㄤㄅㄅㄅㄨㄅ
ㄑㄧㄤˇ
圈 ㄑㄧㄤㄅㄅㄅㄨㄅ
卷 ㄑㄧㄤㄅㄅㄅㄨㄅ
倦 ㄑㄧㄤㄅㄅㄅㄨㄅ
眷 ㄑㄧㄤㄅㄅㄅㄨㄅ
絹 ㄑㄧㄤㄅㄅㄅㄨㄅ
狷 ㄑㄧㄤㄅㄅㄅㄨㄅ
悁 ㄑㄧㄤㄅㄅㄅㄨㄅ
雋 ㄑㄧㄤㄅㄅㄅㄨㄅ
ㄑㄧㄤˋ
畢 ㄑㄧㄤㄅㄅㄅㄨㄅ
君 ㄑㄧㄤㄅㄅㄅㄨㄅ
均 ㄑㄧㄤㄅㄅㄅㄨㄅ
鈞 ㄑㄧㄤㄅㄅㄅㄨㄅ
皸 ㄑㄧㄤㄅㄅㄅㄨㄅ
ㄑㄧㄤˇ
菌 ㄑㄧㄤㄅㄅㄅㄨㄅ
郡 ㄑㄧㄤㄅㄅㄅㄨㄅ
俊 ㄑㄧㄤㄅㄅㄅㄨㄅ
峻 ㄑㄧㄤㄅㄅㄅㄨㄅ
竣 ㄑㄧㄤㄅㄅㄅㄨㄅ
濬 ㄑㄧㄤㄅㄅㄅㄨㄅ
浚 ㄑㄧㄤㄅㄅㄅㄨㄅ
駿 ㄑㄧㄤㄅㄅㄅㄨㄅ

ㄑㄧㄥˊ
窘 ㄑㄧㄥㄅㄅㄅㄨㄅ
炯 ㄑㄧㄥㄅㄅㄅㄨㄅ
煢 ㄑㄧㄥㄅㄅㄅㄨㄅ
ㄑㄧ
七 ㄑㄧㄅㄅㄅㄨㄅ
妻 ㄑㄧㄅㄅㄅㄨㄅ
欺 ㄑㄧㄅㄅㄅㄨㄅ
戚 ㄑㄧㄅㄅㄅㄨㄅ
漆 ㄑㄧㄅㄅㄅㄨㄅ
柒 ㄑㄧㄅㄅㄅㄨㄅ
棲 ㄑㄧㄅㄅㄅㄨㄅ
凄 ㄑㄧㄅㄅㄅㄨㄅ
悽 ㄑㄧㄅㄅㄅㄨㄅ
萋 ㄑㄧㄅㄅㄅㄨㄅ
ㄑㄧˇ
其 ㄑㄧㄅㄅㄅㄨㄅ
期 ㄑㄧㄅㄅㄅㄨㄅ
齊 ㄑㄧㄅㄅㄅㄨㄅ
奇 ㄑㄧㄅㄅㄅㄨㄅ
旗 ㄑㄧㄅㄅㄅㄨㄅ
騎 ㄑㄧㄅㄅㄅㄨㄅ
祈 ㄑㄧㄅㄅㄅㄨㄅ
棋 ㄑㄧㄅㄅㄅㄨㄅ
祁 ㄑㄧㄅㄅㄅㄨㄅ
崎 ㄑㄧㄅㄅㄅㄨㄅ

ㄑㄧㄥˋ
琦 ㄑㄧㄥㄅㄅㄅㄨㄅ
歧 ㄑㄧㄥㄅㄅㄅㄨㄅ
琪 ㄑㄧㄥㄅㄅㄅㄨㄅ
麒 ㄑㄧㄥㄅㄅㄅㄨㄅ
臍 ㄑㄧㄥㄅㄅㄅㄨㄅ
畦 ㄑㄧㄥㄅㄅㄅㄨㄅ
鰭 ㄑㄧㄥㄅㄅㄅㄨㄅ
薺 ㄑㄧㄥㄅㄅㄅㄨㄅ
耆 ㄑㄧㄥㄅㄅㄅㄨㄅ
祺 ㄑㄧㄥㄅㄅㄅㄨㄅ
淇 ㄑㄧㄥㄅㄅㄅㄨㄅ
ㄑㄧㄥˇ
起 ㄑㄧㄥㄅㄅㄅㄨㄅ
啟 ㄑㄧㄥㄅㄅㄅㄨㄅ
豈 ㄑㄧㄥㄅㄅㄅㄨㄅ
乞 ㄑㄧㄥㄅㄅㄅㄨㄅ
啓 ㄑㄧㄥㄅㄅㄅㄨㄅ
綺 ㄑㄧㄥㄅㄅㄅㄨㄅ
ㄑㄧㄥˋ
氣 ㄑㄧㄥㄅㄅㄅㄨㄅ
器 ㄑㄧㄥㄅㄅㄅㄨㄅ
汽 ㄑㄧㄥㄅㄅㄅㄨㄅ
棄 ㄑㄧㄥㄅㄅㄅㄨㄅ
企 ㄑㄧㄥㄅㄅㄅㄨㄅ
契 ㄑㄧㄥㄅㄅㄅㄨㄅ

ㄑㄧㄤˊ
泣 ㄑㄧㄤㄅㄅㄅㄨㄅ
迄 ㄑㄧㄤㄅㄅㄅㄨㄅ
砌 ㄑㄧㄤㄅㄅㄅㄨㄅ
緝 ㄑㄧㄤㄅㄅㄅㄨㄅ
憩 ㄑㄧㄤㄅㄅㄅㄨㄅ
訖 ㄑㄧㄤㄅㄅㄅㄨㄅ
ㄑㄧㄤˇ
卡 ㄑㄧㄤㄅㄅㄅㄨㄅ
ㄑㄧㄤˋ
恰 ㄑㄧㄤㄅㄅㄅㄨㄅ
ㄑㄧㄤ
切 ㄑㄧㄤㄅㄅㄅㄨㄅ
ㄑㄧㄤˇ
茄 ㄑㄧㄤㄅㄅㄅㄨㄅ
伽 ㄑㄧㄤㄅㄅㄅㄨㄅ
ㄑㄧㄤˇ
且 ㄑㄧㄤㄅㄅㄅㄨㄅ
ㄑㄧㄤˋ
切 ㄑㄧㄤㄅㄅㄅㄨㄅ
竊 ㄑㄧㄤㄅㄅㄅㄨㄅ
妾 ㄑㄧㄤㄅㄅㄅㄨㄅ
ㄑㄧㄤ
敲 ㄑㄧㄤㄅㄅㄅㄨㄅ
蹺 ㄑㄧㄤㄅㄅㄅㄨㄅ
鍬 ㄑㄧㄤㄅㄅㄅㄨㄅ

ㄑㄧㄤˊ
琦 ㄑㄧㄤㄅㄅㄅㄨㄅ
歧 ㄑㄧㄤㄅㄅㄅㄨㄅ
琪 ㄑㄧㄤㄅㄅㄅㄨㄅ
麒 ㄑㄧㄤㄅㄅㄅㄨㄅ
臍 ㄑㄧㄤㄅㄅㄅㄨㄅ
畦 ㄑㄧㄤㄅㄅㄅㄨㄅ
鰭 ㄑㄧㄤㄅㄅㄅㄨㄅ
薺 ㄑㄧㄤㄅㄅㄅㄨㄅ
耆 ㄑㄧㄤㄅㄅㄅㄨㄅ
祺 ㄑㄧㄤㄅㄅㄅㄨㄅ
淇 ㄑㄧㄤㄅㄅㄅㄨㄅ
ㄑㄧㄤˇ
起 ㄑㄧㄤㄅㄅㄅㄨㄅ
啟 ㄑㄧㄤㄅㄅㄅㄨㄅ
豈 ㄑㄧㄤㄅㄅㄅㄨㄅ
乞 ㄑㄧㄤㄅㄅㄅㄨㄅ
啓 ㄑㄧㄤㄅㄅㄅㄨㄅ
綺 ㄑㄧㄤㄅㄅㄅㄨㄅ
ㄑㄧㄤˋ
氣 ㄑㄧㄤㄅㄅㄅㄨㄅ
器 ㄑㄧㄤㄅㄅㄅㄨㄅ
汽 ㄑㄧㄤㄅㄅㄅㄨㄅ
棄 ㄑㄧㄤㄅㄅㄅㄨㄅ
企 ㄑㄧㄤㄅㄅㄅㄨㄅ
契 ㄑㄧㄤㄅㄅㄅㄨㄅ

ㄑㄧㄥˊ
琦 ㄑㄧㄥㄅㄅㄅㄨㄅ
歧 ㄑㄧㄥㄅㄅㄅㄨㄅ
琪 ㄑㄧㄥㄅㄅㄅㄨㄅ
麒 ㄑㄧㄥㄅㄅㄅㄨㄅ
臍 ㄑㄧㄥㄅㄅㄅㄨㄅ
畦 ㄑㄧㄥㄅㄅㄅㄨㄅ
鰭 ㄑㄧㄥㄅㄅㄅㄨㄅ
薺 ㄑㄧㄥㄅㄅㄅㄨㄅ
耆 ㄑㄧㄥㄅㄅㄅㄨㄅ
祺 ㄑㄧㄥㄅㄅㄅㄨㄅ
淇 ㄑㄧㄥㄅㄅㄅㄨㄅ
ㄑㄧㄥˇ
起 ㄑㄧㄥㄅㄅㄅㄨㄅ
啟 ㄑㄧㄥㄅㄅㄅㄨㄅ
豈 ㄑㄧㄥㄅㄅㄅㄨㄅ
乞 ㄑㄧㄥㄅㄅㄅㄨㄅ
啓 ㄑㄧㄥㄅㄅㄅㄨㄅ
綺 ㄑㄧㄥㄅㄅㄅㄨㄅ
ㄑㄧㄥˋ
氣 ㄑㄧㄥㄅㄅㄅㄨㄅ
器 ㄑㄧㄥㄅㄅㄅㄨㄅ
汽 ㄑㄧㄥㄅㄅㄅㄨㄅ
棄 ㄑㄧㄥㄅㄅㄅㄨㄅ
企 ㄑㄧㄥㄅㄅㄅㄨㄅ
契 ㄑㄧㄥㄅㄅㄅㄨㄅ

ㄑㄧㄥˊ
泣 ㄑㄧㄥㄅㄅㄅㄨㄅ
迄 ㄑㄧㄥㄅㄅㄅㄨㄅ
砌 ㄑㄧㄥㄅㄅㄅㄨㄅ
緝 ㄑㄧㄥㄅㄅㄅㄨㄅ
憩 ㄑㄧㄥㄅㄅㄅㄨㄅ
訖 ㄑㄧㄥㄅㄅㄅㄨㄅ
ㄑㄧㄥˇ
卡 ㄑㄧㄥㄅㄅㄅㄨㄅ
ㄑㄧㄥˋ
恰 ㄑㄧㄥㄅㄅㄅㄨㄅ
ㄑㄧㄥ
切 ㄑㄧㄥㄅㄅㄅㄨㄅ
ㄑㄧㄥˇ
茄 ㄑㄧㄥㄅㄅㄅㄨㄅ
伽 ㄑㄧㄥㄅㄅㄅㄨㄅ
ㄑㄧㄥˇ
且 ㄑㄧㄥㄅㄅㄅㄨㄅ
ㄑㄧㄥˋ
切 ㄑㄧㄥㄅㄅㄅㄨㄅ
竊 ㄑㄧㄥㄅㄅㄅㄨㄅ
妾 ㄑㄧㄥㄅㄅㄅㄨㄅ
ㄑㄧㄥ
敲 ㄑㄧㄥㄅㄅㄅㄨㄅ
蹺 ㄑㄧㄥㄅㄅㄅㄨㄅ
鍬 ㄑㄧㄥㄅㄅㄅㄨㄅ

ㄑㄧㄥˊ
琦 ㄑㄧㄥㄅㄅㄅㄨㄅ
歧 ㄑㄧㄥㄅㄅㄅㄨㄅ
琪 ㄑㄧㄥㄅㄅㄅㄨㄅ
麒 ㄑㄧㄥㄅㄅㄅㄨㄅ
臍 ㄑㄧㄥㄅㄅㄅㄨㄅ
畦 ㄑㄧㄥㄅㄅㄅㄨㄅ
鰭 ㄑㄧㄥㄅㄅㄅㄨㄅ
薺 ㄑㄧㄥㄅㄅㄅㄨㄅ
耆 ㄑㄧㄥㄅㄅㄅㄨㄅ
祺 ㄑㄧㄥㄅㄅㄅㄨㄅ
淇 ㄑㄧㄥㄅㄅㄅㄨㄅ
ㄑㄧㄥˇ
起 ㄑㄧㄥㄅㄅㄅㄨㄅ
啟 ㄑㄧㄥㄅㄅㄅㄨㄅ
豈 ㄑㄧㄥㄅㄅㄅㄨㄅ
乞 ㄑㄧㄥㄅㄅㄅㄨㄅ
啓 ㄑㄧㄥㄅㄅㄅㄨㄅ
綺 ㄑㄧㄥㄅㄅㄅㄨㄅ
ㄑㄧㄥˋ
氣 ㄑㄧㄥㄅㄅㄅㄨㄅ
器 ㄑㄧㄥㄅㄅㄅㄨㄅ
汽 ㄑㄧㄥㄅㄅㄅㄨㄅ
棄 ㄑㄧㄥㄅㄅㄅㄨㄅ
企 ㄑㄧㄥㄅㄅㄅㄨㄅ
契 ㄑㄧㄥㄅㄅㄅㄨㄅ

ㄑㄧㄤˊ
泣 ㄑㄧㄤㄅㄅㄅㄨㄅ
迄 ㄑㄧㄤㄅㄅㄅㄨㄅ
砌 ㄑㄧㄤㄅㄅㄅㄨㄅ
緝 ㄑㄧㄤㄅㄅㄅㄨㄅ
憩 ㄑㄧㄤㄅㄅㄅㄨㄅ
訖 ㄑㄧㄤㄅㄅㄅㄨㄅ
ㄑㄧㄤˇ
卡 ㄑㄧㄤㄅㄅㄅㄨㄅ
ㄑㄧㄤˋ
恰 ㄑㄧㄤㄅㄅㄅㄨㄅ
ㄑㄧㄤ
切 ㄑㄧㄤㄅㄅㄅㄨㄅ
ㄑㄧㄤˇ
茄 ㄑㄧㄤㄅㄅㄅㄨㄅ
伽 ㄑㄧㄤㄅㄅㄅㄨㄅ
ㄑㄧㄤˇ
且 ㄑㄧㄤㄅㄅㄅㄨㄅ
ㄑㄧㄤˋ
切 ㄑㄧㄤㄅㄅㄅㄨㄅ
竊 ㄑㄧㄤㄅㄅㄅㄨㄅ
妾 ㄑㄧㄤㄅㄅㄅㄨㄅ
ㄑㄧㄤ
敲 ㄑㄧㄤㄅㄅㄅㄨㄅ
蹺 ㄑㄧㄤㄅㄅㄅㄨㄅ
鍬 ㄑㄧㄤㄅㄅㄅㄨㄅ

ㄑㄧㄤˊ
琦 ㄑㄧㄤㄅㄅㄅㄨㄅ
歧 ㄑㄧㄤㄅㄅㄅㄨㄅ
琪 ㄑㄧㄤㄅㄅㄅㄨㄅ
麒 ㄑㄧㄤㄅㄅㄅㄨㄅ
臍 ㄑㄧㄤㄅㄅㄅㄨㄅ
畦 ㄑㄧㄤㄅㄅㄅㄨㄅ
鰭 ㄑㄧㄤㄅㄅㄅㄨㄅ
薺 ㄑㄧㄤㄅㄅㄅㄨㄅ
耆 ㄑㄧㄤㄅㄅㄅㄨㄅ
祺 ㄑㄧㄤㄅㄅㄅㄨㄅ
淇 ㄑㄧㄤㄅㄅㄅㄨㄅ
ㄑㄧㄤˇ
起 ㄑㄧㄤㄅㄅㄅㄨㄅ
啟 ㄑㄧㄤㄅㄅㄅㄨㄅ
豈 ㄑㄧㄤㄅㄅㄅㄨㄅ
乞 ㄑㄧㄤㄅㄅㄅㄨㄅ
啓 ㄑㄧㄤㄅㄅㄅㄨㄅ
綺 ㄑㄧㄤㄅㄅㄅㄨㄅ
ㄑㄧㄤˋ
氣 ㄑㄧㄤㄅㄅㄅㄨㄅ
器 ㄑㄧㄤㄅㄅㄅㄨㄅ
汽 ㄑㄧㄤㄅㄅㄅㄨㄅ
棄 ㄑㄧㄤㄅㄅㄅㄨㄅ
企 ㄑㄧㄤㄅㄅㄅㄨㄅ
契 ㄑㄧㄤ

王18-11-15

ㄑㄧㄥˋ 蜻 ㄑㄧㄥ 蜻 ㄑㄧㄥˊ 情 ㄑㄧㄥˇ 晴 ㄑㄧㄥˋ 擎 ㄑㄧㄥˇ 請 ㄑㄧㄥˋ 頃 ㄑㄧㄥˋ 慶 ㄑㄩ 區 ㄑㄩˇ 曲 ㄑㄩ 屈 ㄑㄩ 驅 ㄑㄩ 趨 ㄑㄩ 軀 ㄑㄩ 嶇 ㄑㄩ 蛆 ㄑㄩˋ 渠 ㄑㄩㄢˊ 麴 ㄑㄩㄢˋ 螺 ㄑㄩㄢˇ 璩 ㄑㄩㄢˋ 瞿

ㄑㄧˇ 沁 ㄑㄧㄤ 鎗 ㄑㄧㄤ 槍 ㄑㄧㄤ 腔 ㄑㄧㄤ 羌 ㄑㄧㄤˇ 強 ㄑㄧㄤˊ 牆 ㄑㄧㄤˊ 強 ㄑㄧㄤˊ 蔷 ㄑㄧㄤˊ 墻 ㄑㄧㄤˋ 戕 ㄑㄧㄤˇ 強 ㄑㄧㄤˇ 搶 ㄑㄧㄤˋ 嗆 ㄑㄧㄥ 清 ㄑㄧㄥ 青 ㄑㄧㄥ 輕 ㄑㄧㄥ 傾 ㄑㄧㄥ 卿 ㄑㄧㄥ 氫

ㄑㄧㄢˋ 虔 ㄑㄧㄢˋ 捐 ㄑㄧㄢˋ 乾 ㄑㄧㄢˋ 遣 ㄑㄧㄢˋ 淺 ㄑㄧㄢˋ 譴 ㄑㄧㄢˋ 欠 ㄑㄧㄢˋ 歉 ㄑㄧㄢˋ 倩 ㄑㄧㄣ 親 ㄑㄧㄣ 侵 ㄑㄧㄣ 欽 ㄑㄧㄣ 蔡 ㄑㄧㄣˊ 勤 ㄑㄧㄣˊ 琴 ㄑㄧㄣˊ 秦 ㄑㄧㄣˊ 禽 ㄑㄧㄣˊ 擒 ㄑㄧㄣˊ 噙 ㄑㄧㄣˇ 寢

ㄑㄧㄡˊ 求 ㄑㄧㄡˊ 球 ㄑㄧㄡˊ 囚 ㄑㄧㄡˊ 酋 ㄑㄧㄡˊ 裘 ㄑㄧㄡˋ 逑 ㄑㄧㄢ 千 ㄑㄧㄢ 鉛 ㄑㄧㄢ 遷 ㄑㄧㄢ 簽 ㄑㄧㄢ 牽 ㄑㄧㄢ 籤 ㄑㄧㄢ 嵌 ㄑㄧㄢ 謙 ㄑㄧㄢ 騫 ㄑㄧㄢ 韆 ㄑㄧㄢˋ 仟 ㄑㄧㄢˋ 阡 ㄑㄧㄢˋ 鵮 ㄑㄧㄢˊ 前 ㄑㄧㄢˊ 錢 ㄑㄧㄢˊ 潛 ㄑㄧㄢˊ 黔 ㄑㄧㄢˊ 鉗

ㄑㄧㄠ 橇 ㄑㄧㄠˋ 橋 ㄑㄧㄠ 瞧 ㄑㄧㄠ 僑 ㄑㄧㄠ 喬 ㄑㄧㄠ 樵 ㄑㄧㄠ 翹 ㄑㄧㄠ 憔 ㄑㄧㄠˇ 巧 ㄑㄧㄠ 悄 ㄑㄧㄠˋ 俏 ㄑㄧㄠ 峭 ㄑㄧㄠ 峭 ㄑㄧㄠ 窱 ㄑㄧㄠ 鞘 ㄑㄧㄠ 橇 ㄑㄧㄡ 秋 ㄑㄧㄡ 邱 ㄑㄧㄡ 丘 ㄑㄧㄡ 鞦 ㄑㄧㄡ 蚯 ㄑㄧㄡ 鰍

ㄑㄧㄤˋ 蟑 ㄑㄧㄤˋ 蟑 ㄑㄧㄤˋ 蟑

王18-11-16

ㄒㄧㄝˊ 脅 ㄒㄧㄝㄉㄨㄥ
ㄒㄧㄝㄈㄨㄟ 挾
ㄒㄧㄝㄅㄧㄢˋ 諧
ㄒㄧㄝㄉㄨㄛˋ 頡
ㄒㄧㄝㄅㄧㄥˊ 邪
ㄒㄧㄝㄅㄧㄢˋ 偕
ㄒㄧㄝˇ 寫
ㄒㄧㄝㄈㄛˋ 血
ㄒㄧㄝˋ 謝
ㄒㄧㄝㄅㄧㄢˋ 蟹
ㄒㄧㄝㄅㄧㄥˊ 械
ㄒㄧㄝㄈㄟˊ 肩
ㄒㄧㄝㄅㄧㄥˋ 泄
ㄒㄧㄝㄅㄨㄥˋ 洩
ㄒㄧㄝㄈㄨㄟˋ 瀉
ㄒㄧㄝㄅㄧㄢˋ 懈
ㄒㄧㄝㄈㄨㄟˋ 卸
ㄒㄧㄝㄅㄨㄥˋ 榭
ㄒㄧㄠ
ㄒㄧㄠㄅㄧㄢˋ 消
ㄒㄧㄠㄅㄧㄢˋ 銷
ㄒㄧㄠㄅㄧㄢˋ 削
ㄒㄧㄠㄈㄨㄥˋ 蕭

ㄒㄧㄠ
ㄒㄧㄠㄈㄨㄥˋ 宵
ㄒㄧㄠㄈㄨㄥˋ 硝
ㄒㄧㄠㄈㄨㄥˋ 霄
ㄒㄧㄠㄈㄨㄥˋ 罩
ㄒㄧㄠㄈㄨㄥˋ 逍
ㄒㄧㄠㄈㄨㄥˋ 簫
ㄒㄧㄠㄈㄨㄥˋ 驍
ㄒㄧㄠㄈㄨㄥˋ 瀟
ㄒㄧㄠ 肖
ㄒㄧㄠˋ 學
ㄒㄧㄠˋ 小
ㄒㄧㄠ 曉
ㄒㄧㄠˋ 校
ㄒㄧㄠㄈㄨㄥˋ 笑
ㄒㄧㄠㄈㄨㄥˋ 效
ㄒㄧㄠㄈㄨㄥˋ 孝
ㄒㄧㄠㄈㄨㄥˋ 酵
ㄒㄧㄠㄈㄨㄥˋ 嘯
ㄒㄧㄠㄈㄨㄥˋ 効
ㄒㄧㄠㄈㄨㄥˋ 哮
ㄒㄧㄡ 修

ㄒㄧㄡ
ㄒㄧㄡㄅㄧㄢˋ 休
ㄒㄧㄡㄅㄨㄥˋ 羞
ㄒㄧㄡㄅㄨㄥˋ 咻
ㄒㄧㄡˇ
ㄒㄧㄡㄅㄨㄥˋ 朽
ㄒㄧㄡˇ
ㄒㄧㄡㄅㄨㄥˋ 秀
ㄒㄧㄡㄅㄨㄥˋ 袖
ㄒㄧㄡㄅㄨㄥˋ 繡
ㄒㄧㄡㄅㄨㄥˋ 嗅
ㄒㄧㄡㄅㄨㄥˋ 綉
ㄒㄧㄡㄅㄨㄥˋ 銹
ㄒㄧㄡㄅㄨㄥˋ 誘
ㄒㄧㄡㄅㄨㄥˋ 岫
ㄒㄧㄡ
ㄒㄧㄡㄅㄨㄥˋ 先
ㄒㄧㄡㄅㄨㄥˋ 鮮
ㄒㄧㄡㄅㄨㄥˋ 仙
ㄒㄧㄡㄅㄨㄥˋ 纖
ㄒㄧㄡㄅㄨㄥˋ 遲
ㄒㄧㄡㄅㄨㄥˋ 掀
ㄒㄧㄡˇ
ㄒㄧㄡㄅㄨㄥˋ 賢
ㄒㄧㄡㄅㄨㄥˋ 閒
ㄒㄧㄡㄅㄨㄥˋ 嫌

ㄒㄧㄢˊ
ㄒㄧㄢˊㄅㄧㄢˋ 咸
ㄒㄧㄢˊㄅㄨㄥˋ 鹹
ㄒㄧㄢˊㄅㄨㄥˋ 絃
ㄒㄧㄢˊㄅㄨㄥˋ 銜
ㄒㄧㄢˊㄅㄨㄥˋ 弦
ㄒㄧㄢˊㄅㄨㄥˋ 閑
ㄒㄧㄢˋ 涎
ㄒㄧㄢˋ 啣
ㄒㄧㄢˋ 嫻
ㄒㄧㄢˋ
險
ㄒㄧㄢˋㄅㄨㄥˋ 顯
ㄒㄧㄢˋㄅㄨㄥˋ 鮮
ㄒㄧㄢˋㄅㄨㄥˋ 癬
ㄒㄧㄢˋㄅㄨㄥˋ 蘚
ㄒㄧㄢˋ
見
ㄒㄧㄢˋㄅㄨㄥˋ 現
ㄒㄧㄢˋㄅㄨㄥˋ 縣
ㄒㄧㄢˋㄅㄨㄥˋ 線
ㄒㄧㄢˋㄅㄨㄥˋ 限
ㄒㄧㄢˋㄅㄨㄥˋ 憲
ㄒㄧㄢˋㄅㄨㄥˋ 獻
ㄒㄧㄢˋㄅㄨㄥˋ 陷
ㄒㄧㄢˋㄅㄨㄥˋ 羨

ㄒㄧㄢ
ㄒㄧㄢㄅㄨㄥˋ 綫
ㄒㄧㄢㄅㄨㄥˋ 腺
ㄒㄧㄢㄅㄨㄥˋ 獻
ㄒㄧㄢㄅㄨㄥˋ 餡
ㄒㄧㄢㄅㄨㄥˋ 莧
ㄒㄧㄣ
心
ㄒㄧㄣˋ
新
ㄒㄧㄣˋㄅㄨㄥˋ 辛
ㄒㄧㄣˋㄅㄨㄥˋ 薪
ㄒㄧㄣˋㄅㄨㄥˋ 欣
ㄒㄧㄣˋㄅㄨㄥˋ 鮮
ㄒㄧㄣˋㄅㄨㄥˋ 馨
ㄒㄧㄣˋㄅㄨㄥˋ 鑫
ㄒㄧㄣˋㄅㄨㄥˋ 忻
ㄒㄧㄣˋㄅㄨㄥˋ 炘
ㄒㄧㄥ
信
ㄒㄧㄥˋㄅㄨㄥˋ 釁
ㄒㄧㄤ
相
ㄒㄧㄤㄅㄨㄥˋ 鄉
ㄒㄧㄤㄅㄨㄥˋ 香
ㄒㄧㄤㄅㄨㄥˋ 箱
ㄒㄧㄤㄅㄨㄥˋ 湘

ㄒㄧㄤ
ㄒㄧㄤˋ 襄
ㄒㄧㄤˋㄅㄨㄥˋ 鑲
ㄒㄧㄤˋ
降
ㄒㄧㄤˋㄅㄨㄥˋ 詳
ㄒㄧㄤˋㄅㄨㄥˋ 祥
ㄒㄧㄤˋㄅㄨㄥˋ 翔
ㄒㄧㄤˋ
想
ㄒㄧㄤˋㄅㄨㄥˋ 響
ㄒㄧㄤˋㄅㄨㄥˋ 享
ㄒㄧㄤˋㄅㄨㄥˋ 响
ㄒㄧㄤˋㄅㄨㄥˋ 餉
ㄒㄧㄤˋ
向
ㄒㄧㄤˋㄅㄨㄥˋ 相
ㄒㄧㄤˋㄅㄨㄥˋ 像
ㄒㄧㄤˋㄅㄨㄥˋ 項
ㄒㄧㄤˋㄅㄨㄥˋ 象
ㄒㄧㄤˋㄅㄨㄥˋ 橡
ㄒㄧㄤˋㄅㄨㄥˋ 巷
ㄒㄧㄤˋㄅㄨㄥˋ 嚮
ㄒㄧㄤˋㄅㄨㄥˋ 珦
ㄒㄧㄥ
興
ㄒㄧㄥ
星
ㄒㄧㄥㄅㄧ 猩
ㄒㄧㄥㄅㄨㄥˋ 腥
ㄒㄧㄥㄅㄨㄥˋ 惺
ㄒㄧㄥˋ
行
ㄒㄧㄥˋㄅㄨㄥˋ 形
ㄒㄧㄥˋㄅㄨㄥˋ 型
ㄒㄧㄥˋㄅㄨㄥˋ 刑
ㄒㄧㄥˋㄅㄨㄥˋ 邢
ㄒㄧㄥˋ
省
ㄒㄧㄥˋㄅㄨㄥˋ 醒
ㄒㄧㄥˋ
行
ㄒㄧㄥˋㄅㄨㄥˋ 興
ㄒㄧㄥˋㄅㄨㄥˋ 性
ㄒㄧㄥˋㄅㄨㄥˋ 幸
ㄒㄧㄥˋㄅㄨㄥˋ 姓
ㄒㄧㄥˋㄅㄨㄥˋ 杏
ㄒㄧㄥˋㄅㄨㄥˋ 倖
ㄒㄧㄥˋㄅㄨㄥˋ 悻
ㄒㄧㄥ
須
ㄒㄧㄥˋㄅㄨㄥˋ 需

ㄒㄩ
虛
ㄒㄩㄅㄧㄢˋ 鬚
ㄒㄩㄅㄨㄥˋ 噓
ㄒㄩˋ
戌
ㄒㄩˋ
徐
ㄒㄩˋ
許
ㄒㄩˋㄅㄨㄥˋ 煦
ㄒㄩˋㄅㄨㄥˋ 昫
ㄒㄩˋ
續
ㄒㄩˋㄅㄨㄥˋ 序
ㄒㄩˋㄅㄨㄥˋ 緒
ㄒㄩˋㄅㄨㄥˋ 蓄
ㄒㄩˋㄅㄨㄥˋ 敍
ㄒㄩˋㄅㄨㄥˋ 絮
ㄒㄩˋㄅㄨㄥˋ 旭
ㄒㄩˋㄅㄨㄥˋ 卹
ㄒㄩˋㄅㄨㄥˋ 恤
ㄒㄩˋㄅㄨㄥˋ 酗
ㄒㄩˋㄅㄨㄥˋ 婿
ㄒㄩˋㄅㄨㄥˋ 勖
ㄒㄩˋㄅㄨㄥˋ 畜

ㄒㄩㄝ
薛
ㄒㄩㄝㄅㄧㄢˋ 靴
ㄒㄩㄝˋ
學
ㄒㄩㄝˋㄅㄨㄥˋ
ㄒㄩㄝˋ
雪
ㄒㄩㄝˋㄅㄨㄥˋ
血
ㄒㄩㄝˋㄅㄨㄥˋ 雪
ㄒㄩㄝˋㄅㄨㄥˋ 穴
ㄒㄩㄝ
宣
ㄒㄩㄝㄅㄧㄢˋ 軒
ㄒㄩㄝㄅㄧㄢˋ 喧
ㄒㄩㄝㄅㄧㄢˋ 瑄
ㄒㄩㄝㄅㄧㄢˋ 萱
ㄒㄩㄝˋ
旋
ㄒㄩㄝˋㄅㄨㄥˋ 懸
ㄒㄩㄝˋㄅㄨㄥˋ 玄
ㄒㄩㄝˋㄅㄨㄥˋ 漩
ㄒㄩㄝˋ
選
ㄒㄩㄝˋㄅㄨㄥˋ
ㄒㄩㄝˋ
旋
ㄒㄩㄝˋㄅㄨㄥˋ

ㄒㄩㄣ
眩
ㄒㄩㄣㄈㄨㄥˋ
絢
ㄒㄩㄣㄅㄨㄥˋ
炫
ㄒㄩㄣㄅㄨㄥˋ
ㄒㄩㄣ
勳
ㄒㄩㄣㄅㄨㄥˋ 薰
ㄒㄩㄣㄅㄨㄥˋ 勛
ㄒㄩㄣㄅㄨㄥˋ 燻
ㄒㄩㄣㄅㄨㄥˋ 醺
ㄒㄩㄣˋ
尋
ㄒㄩㄣˋㄅㄨㄥˋ 巡
ㄒㄩㄣˋㄅㄨㄥˋ 詢
ㄒㄩㄣˋㄅㄨㄥˋ 循
ㄒㄩㄣˋㄅㄨㄥˋ 旬
ㄒㄩㄣˋㄅㄨㄥˋ 潯
ㄒㄩㄣˋㄅㄨㄥˋ 馴
ㄒㄩㄣˋㄅㄨㄥˋ 珣
ㄒㄩㄣˋㄅㄨㄥˋ 蟳
ㄒㄩㄣˋ
訊
ㄒㄩㄣˋㄅㄨㄥˋ 訓
ㄒㄩㄣˋㄅㄨㄥˋ 迅
ㄒㄩㄣˋㄅㄨㄥˋ 遜
ㄒㄩㄣˋㄅㄨㄥˋ 蕈

FIG-11-17

仗帳障賬漲脹杖幛 正爭蒸徵征睜箏掙猙錚 整拯 政正

診枕疹 鎮陣振震賬朕 張章彰漳璋樟麞 長掌漲幛 丈

盞斬嶄 戰站暫占佔棧蘸顫湛 真針珍貞偵禎砧甄斟榛槙

粥 軸 帚肘 晝宙皺紂咒呪胄 詹粘沾瞻氈霑鱣 展輾

朝招昭釗 着著 找爪沼 照 召趙罩兆肇詔 周州洲週舟

者赭 這浙蔗 着著螫 摘齋 擇宅翟 窄 債寨 着著

絮扎札閘 眨 炸搾詐乍蚱栅 遮 折摘哲摺轍輒懾囁

至 治制志製質致置智秩誌稚峙緻幟窒滯摯雉炙 查渣 炸

蜘梔 直職質値植執殖擲姪躑蹠蟄 尺 指紙止旨址趾祉

殉巽 兄兇胸匈凶洶 雄熊 之 知隻織氏支枝祇汁芝肢脂

劇 諂 懺 顫 琛 陳 晨 臣 沉 沈 塵 辰 忱 宸 趁 襯 昌 猖 鯧 娼

籌 綢 酬 稠 紬 丑 醜 臭 攙 纏 蟬 禪 饞 讒 孱 澶 嬋 產 鏟 闡

轍 掣 坼 差 拆 柴 超 鈔 抄 朝 潮 巢 嘲 吵 炒 抽 愁 仇

差 插 喳 叉 察 茶 查 搽 詹 差 剎 岔 詫 汊 車 扯 拆 撤 徹 澈

嗤 持 池 遲 馳 匙 弛 尺 齒 恥 呎 侈 耻 褫 赤 翅 斥 飭 叱 熾 啻

狀 壯 撞 中 鐘 終 忠 鍾 衷 忪 種 腫 塚 踵 中 種 重 衆 仲 吃 蚩

專 甎 磚 顓 轉 囀 傳 轉 賺 撰 篆 準 准 裝 莊 樁 妝 粧 奘

作 桌 捉 涿 着 卓 濯 濁 酌 灼 啄 擢 鐲 拙 茁 拽 追 椎 雖 綴 墜

主 煮 囑 貯 渚 矚 住 著 注 助 祝 駐 柱 註 苧 蛀 鑄 杼 抓 撾 爪

證 鄭 症 証 諸 豬 珠 朱 株 猪 蛛 硃 誅 銖 茱 竹 築 逐 燭 竺 求 躅

FIG-11-19

梢 韶 杓 勺 少 少 紹 哨 邵 牧 熟 手 首 守 受 獸 售 壽

甚 折 蛇 舌 舍 捨 社 設 射 涉 舍 攝 赦 篩 曬 晒 誰 燒 稍

嗜 仕 柿 弑 拭 噬 匙 殺 沙 紗 砂 莎 痧 傻 煞 廈 霎 奢 什

始 史 駛 矢 屎 是 事 市 世 士 勢 識 試 室 示 視 式 氏 適 釋 飾 侍 誓 逝

崇 寵 師 失 施 詩 獅 濕 屍 溼 蝨 尸 十 時 實 食 石 拾 蝕 使

尊 蠢 創 窗 瘡 牀 床 幢 闖 創 闖 充 衝 沖 幢 舂 重 蟲

垂 錘 槌 陲 穿 川 傳 船 喘 串 釧 春 椿 純 唇 醇 淳 脣

廚 鋤 雛 櫥 芻 蝓 處 楚 礎 杵 處 畜 觸 黜 矗 戳 綽 婼 吹 炊

城 程 盛 承 乘 誠 呈 懲 澄 丞 橙 澂 逞 騁 稱 秤 出 初 齣 除 儲

閭 長 常 場 嘗 腸 償 嫦 廠 敞 唱 倡 暢 悵 稱 撑 撐 瞠 蟶 成

FIG-11-20

ㄅㄨˋ ㄅㄨㄣ
肉 唇
ㄅㄨˋ ㄅㄨㄣˋ
褥 若
ㄅㄨˋ ㄅㄨㄣˋ
弱 箬
ㄅㄨˋ ㄅㄨㄣˋ
蕊 瑞
ㄅㄨˋ ㄅㄨㄣˋ
銳 芮
ㄅㄨㄣˋ ㄅㄨㄣˋ
宥 軟
ㄅㄨㄣˋ ㄅㄨㄣˋ
阮 輭
ㄅㄨㄣˋ ㄅㄨㄣˋ
蠕 潤
ㄅㄨㄣˋ ㄅㄨㄣˋ
閏 容
ㄅㄨㄣˋ ㄅㄨㄣˋ
榮

ㄅㄨㄣˋ ㄅㄨㄣˋ
軟 飪
ㄅㄨㄣˋ ㄅㄨㄣˋ
攘 壤
ㄅㄨㄣˋ ㄅㄨㄣˋ
嚷 讓
ㄅㄨㄣˋ ㄅㄨㄣˋ
扔 仍
ㄅㄨㄣˋ ㄅㄨㄣˋ
如 儒
ㄅㄨㄣˋ ㄅㄨㄣˋ
孺 茹
ㄅㄨㄣˋ ㄅㄨㄣˋ
嚅 乳
ㄅㄨㄣˋ ㄅㄨㄣˋ
汝 月
ㄅㄨㄣˋ ㄅㄨㄣˋ
入

ㄅㄨㄣˋ ㄅㄨㄣˋ
柔 揉
ㄅㄨㄣˋ ㄅㄨㄣˋ
鞣 蹂
ㄅㄨㄣˋ ㄅㄨㄣˋ
肉 然
ㄅㄨㄣˋ ㄅㄨㄣˋ
燃 髯
ㄅㄨㄣˋ ㄅㄨㄣˋ
染 冉
ㄅㄨㄣˋ ㄅㄨㄣˋ
人 任
ㄅㄨㄣˋ ㄅㄨㄣˋ
仁 壬
ㄅㄨㄣˋ ㄅㄨㄣˋ
忍 任
ㄅㄨㄣˋ ㄅㄨㄣˋ
認 靭
ㄅㄨㄣˋ ㄅㄨㄣˋ
刃

ㄅㄨㄣˋ ㄅㄨㄣˋ
栓 涮
ㄅㄨㄣˋ ㄅㄨㄣˋ
順 舜
ㄅㄨㄣˋ ㄅㄨㄣˋ
瞬 雙
ㄅㄨㄣˋ ㄅㄨㄣˋ
霜 双
ㄅㄨㄣˋ ㄅㄨㄣˋ
爽 日
ㄅㄨㄣˋ ㄅㄨㄣˋ
惹 熱
ㄅㄨㄣˋ ㄅㄨㄣˋ
饒 擾
ㄅㄨㄣˋ ㄅㄨㄣˋ
繞

ㄅㄨㄣˋ ㄅㄨㄣˋ
要 說
ㄅㄨㄣˋ ㄅㄨㄣˋ
朔 爍
ㄅㄨㄣˋ ㄅㄨㄣˋ
碩 衰
ㄅㄨㄣˋ ㄅㄨㄣˋ
摔 甩
ㄅㄨㄣˋ ㄅㄨㄣˋ
率 帥
ㄅㄨㄣˋ ㄅㄨㄣˋ
蟀 誰
ㄅㄨㄣˋ ㄅㄨㄣˋ
水 說
ㄅㄨㄣˋ ㄅㄨㄣˋ
睡 稅
ㄅㄨㄣˋ ㄅㄨㄣˋ
蛻

ㄅㄨㄣˋ ㄅㄨㄣˋ
數 鼠
ㄅㄨㄣˋ ㄅㄨㄣˋ
屬 暑
ㄅㄨㄣˋ ㄅㄨㄣˋ
署 薯
ㄅㄨㄣˋ ㄅㄨㄣˋ
蜀 藷
ㄅㄨㄣˋ ㄅㄨㄣˋ
黍 樹
ㄅㄨㄣˋ ㄅㄨㄣˋ
數 術
ㄅㄨㄣˋ ㄅㄨㄣˋ
述 束
ㄅㄨㄣˋ ㄅㄨㄣˋ
署 豎
ㄅㄨㄣˋ ㄅㄨㄣˋ
漱 恕
ㄅㄨㄣˋ ㄅㄨㄣˋ
庶 曙
ㄅㄨㄣˋ ㄅㄨㄣˋ
墅 澍
ㄅㄨㄣˋ ㄅㄨㄣˋ
刷

ㄅㄨㄣˋ ㄅㄨㄣˋ
勝 盛
ㄅㄨㄣˋ ㄅㄨㄣˋ
乘 聖
ㄅㄨㄣˋ ㄅㄨㄣˋ
剩 賸
ㄅㄨㄣˋ ㄅㄨㄣˋ
書 輸
ㄅㄨㄣˋ ㄅㄨㄣˋ
舒 殊
ㄅㄨㄣˋ ㄅㄨㄣˋ
梳 疏
ㄅㄨㄣˋ ㄅㄨㄣˋ
蔬 樞
ㄅㄨㄣˋ ㄅㄨㄣˋ
疎 抒
ㄅㄨㄣˋ ㄅㄨㄣˋ
姝 叔
ㄅㄨㄣˋ ㄅㄨㄣˋ
熟 淑
ㄅㄨㄣˋ ㄅㄨㄣˋ
塾 贖
ㄅㄨㄣˋ ㄅㄨㄣˋ
孰

ㄅㄨㄣˋ ㄅㄨㄣˋ
傷 上
ㄅㄨㄣˋ ㄅㄨㄣˋ
賞 向
ㄅㄨㄣˋ ㄅㄨㄣˋ
上 尚
ㄅㄨㄣˋ ㄅㄨㄣˋ
裳 生
ㄅㄨㄣˋ ㄅㄨㄣˋ
聲 勝
ㄅㄨㄣˋ ㄅㄨㄣˋ
升 牲
ㄅㄨㄣˋ ㄅㄨㄣˋ
昇 甥
ㄅㄨㄣˋ ㄅㄨㄣˋ
陞 笙
ㄅㄨㄣˋ ㄅㄨㄣˋ
繩 省

ㄅㄨㄣˋ ㄅㄨㄣˋ
膳 訕
ㄅㄨㄣˋ ㄅㄨㄣˋ
疝 身
ㄅㄨㄣˋ ㄅㄨㄣˋ
參 深
ㄅㄨㄣˋ ㄅㄨㄣˋ
伸 申
ㄅㄨㄣˋ ㄅㄨㄣˋ
呻 紳
ㄅㄨㄣˋ ㄅㄨㄣˋ
神 審
ㄅㄨㄣˋ ㄅㄨㄣˋ
沈 瀋
ㄅㄨㄣˋ ㄅㄨㄣˋ
嬸 甚
ㄅㄨㄣˋ ㄅㄨㄣˋ
慎 腎
ㄅㄨㄣˋ ㄅㄨㄣˋ
滲 商

ㄅㄨㄣˋ ㄅㄨㄣˋ
授 瘦
ㄅㄨㄣˋ ㄅㄨㄣˋ
狩 山
ㄅㄨㄣˋ ㄅㄨㄣˋ
衫 杉
ㄅㄨㄣˋ ㄅㄨㄣˋ
珊 煽
ㄅㄨㄣˋ ㄅㄨㄣˋ
刪 羶
ㄅㄨㄣˋ ㄅㄨㄣˋ
跚 潸
ㄅㄨㄣˋ ㄅㄨㄣˋ
姍 閃
ㄅㄨㄣˋ ㄅㄨㄣˋ
陝 善
ㄅㄨㄣˋ ㄅㄨㄣˋ
扇 汕
ㄅㄨㄣˋ ㄅㄨㄣˋ
禪 擅
ㄅㄨㄣˋ ㄅㄨㄣˋ
鄯 繕

曹 ㄘㄠˊ
嘈 ㄘㄠˊ
槽 ㄘㄠˊ
鰽 ㄘㄠˊ
草 ㄘㄠˇ
湊 ㄘㄡˋ
參 ㄘㄢ
餐 ㄘㄢ
蠶 ㄘㄢˊ
殘 ㄘㄢˊ
慚 ㄘㄢˊ
慘 ㄘㄢˇ
燦 ㄘㄢˋ
參 ㄘㄣ
蒼 ㄘㄤ
倉 ㄘㄤ
滄 ㄘㄤ

策 ㄘㄜˋ
測 ㄘㄜˋ
側 ㄘㄜˋ
廁 ㄘㄜˋ
猜 ㄘㄞ
才 ㄘㄞˊ
財 ㄘㄞˊ
纔 ㄘㄞˊ
材 ㄘㄞˊ
裁 ㄘㄞˊ
採 ㄘㄞˇ
彩 ㄘㄞˇ
采 ㄘㄞˇ
踩 ㄘㄞˇ
綵 ㄘㄞˇ
睬 ㄘㄞˇ
萊 ㄘㄞˊ
蔡 ㄘㄞˋ
操 ㄘㄠ
糙 ㄘㄠ

粽 ㄘㄨㄥˋ
綜 ㄘㄨㄥ
差 ㄘㄚ
雌 ㄘˊ
疵 ㄘˊ
詞 ㄘˊ
辭 ㄘˊ
慈 ㄘˊ
磁 ㄘˊ
瓷 ㄘˊ
祠 ㄘˊ
茨 ㄘˊ
此 ㄘˇ
次 ㄘˋ
刺 ㄘˋ
賜 ㄘˋ
伺 ㄘˋ
ㄘˋ
擦 ㄘㄚ
ㄘㄚˋ
冊 ㄘㄜ

鑽 ㄘㄨㄢˋ
攢 ㄘㄨㄢˊ
纘 ㄘㄨㄢˊ
尊 ㄘㄨㄣ
遵 ㄘㄨㄣ
樽 ㄘㄨㄣ
撙 ㄘㄨㄣˇ
圳 ㄘㄨㄣˋ
宗 ㄘㄨㄥ
縱 ㄘㄨㄥ
蹤 ㄘㄨㄥ
棕 ㄘㄨㄥ
蹤 ㄘㄨㄥ
樅 ㄘㄨㄥ
鬃 ㄘㄨㄥ
總 ㄘㄨㄥˇ
總 ㄘㄨㄥˇ
從 ㄘㄨㄥˊ
縱 ㄘㄨㄥˋ

噪 ㄘㄠˋ
ㄘㄠˋ
昨 ㄘㄨㄛˊ
ㄘㄨㄛˊ
左 ㄘㄨㄛˇ
佐 ㄘㄨㄛˇ
作 ㄘㄨㄛˋ
做 ㄘㄨㄛˋ
坐 ㄘㄨㄛˋ
座 ㄘㄨㄛˋ
鑿 ㄘㄨㄛˋ
柞 ㄘㄨㄛˋ
祚 ㄘㄨㄛˋ
嘴 ㄘㄨㄟˇ
最 ㄘㄨㄟˋ
罪 ㄘㄨㄟˋ
醉 ㄘㄨㄟˋ
鑽 ㄘㄨㄢˋ
纂 ㄘㄨㄢˋ

髒 ㄗㄤ
贓 ㄗㄤ
藏 ㄗㄤˊ
臟 ㄗㄤˊ
葬 ㄗㄤˋ
曾 ㄗㄥ
增 ㄗㄥ
憎 ㄗㄥ
贈 ㄗㄥˋ
甑 ㄗㄥˋ
租 ㄗㄨ
足 ㄗㄨˊ
族 ㄗㄨˊ
卒 ㄗㄨˊ
嗾 ㄗㄨˋ
組 ㄗㄨˇ
祖 ㄗㄨˇ
阻 ㄗㄨˇ

噪 ㄗㄠˋ
竈 ㄗㄠˋ
灶 ㄗㄠˋ
鄒 ㄗㄡ
邹 ㄗㄡ
鄒 ㄗㄡ
走 ㄗㄡˇ
奏 ㄗㄡˋ
驟 ㄗㄡˋ
揍 ㄗㄡˋ
糌 ㄗㄢ
咱 ㄗㄢˊ
鏨 ㄗㄢˋ
贊 ㄗㄢˋ
暫 ㄗㄢˋ
讚 ㄗㄢˋ
怎 ㄗㄣˇ

載 ㄗㄞˇ
仔 ㄗㄞ
宰 ㄗㄞˇ
在 ㄗㄞˋ
再 ㄗㄞˋ
載 ㄗㄞˋ
賊 ㄗㄟˊ
遭 ㄗㄠ
糟 ㄗㄠ
鑿 ㄗㄠˊ
早 ㄗㄠˇ
棗 ㄗㄠˇ
澡 ㄗㄠˇ
藻 ㄗㄠˇ
蚤 ㄗㄠˇ
造 ㄗㄠˋ
皂 ㄗㄠˋ
燥 ㄗㄠˋ
躁 ㄗㄠˋ

自 ㄗˋ
字 ㄗˋ
漬 ㄗˋ
子 ㄗˇ
紫 ㄗˇ
匝 ㄗˊ
咂 ㄗˊ
雜 ㄗㄚˊ
砸 ㄗㄚˊ
則 ㄗㄜˊ
責 ㄗㄜˊ
賊 ㄗㄜˊ
擇 ㄗㄜˊ
澤 ㄗㄜˊ
昃 ㄗㄜˋ
災 ㄗㄞ
栽 ㄗㄞ
哉 ㄗㄞ

融 ㄖㄨㄥˊ
溶 ㄖㄨㄥˊ
絨 ㄖㄨㄥˊ
熔 ㄖㄨㄥˊ
戎 ㄖㄨㄥˊ
蓉 ㄖㄨㄥˊ
鎔 ㄖㄨㄥˊ
羢 ㄖㄨㄥˊ
榕 ㄖㄨㄥˊ
資 ㄗ
茲 ㄗ
滋 ㄗ
姿 ㄗ
吱 ㄗ
咨 ㄗ
孜 ㄗ
輜 ㄗ
齜 ㄗ
子 ㄗˇ
紫 ㄗˇ
籽 ㄗˇ
梓 ㄗˇ
滓 ㄗˇ

王18-11-22

ㄅㄨˋ
ㄅㄨㄣ
ㄅㄨㄥˊ
ㄅㄨㄥˇ
ㄅㄨㄥˋ
ㄅㄨㄥ
ㄅㄨㄤˋ
ㄅㄨㄤ
ㄅㄨㄟˋ
ㄅㄨㄟ
ㄅㄨㄟˇ
ㄅㄨㄞˋ
ㄅㄨㄞ
ㄅㄨㄚˋ
ㄅㄨㄚ
ㄅㄨㄛˋ
ㄅㄨㄛ
ㄅㄨㄛˇ
ㄅㄨㄚˇ
ㄅㄨㄢˋ
ㄅㄨㄢ
ㄅㄨㄢˇ
ㄅㄨㄣˋ
ㄅㄨㄣ
ㄅㄨㄣˇ
ㄅㄨㄥˋ
ㄅㄨㄥ
ㄅㄨㄥˇ
ㄅㄨㄤˋ
ㄅㄨㄤ
ㄅㄨㄤˇ
ㄅㄨㄟˋ
ㄅㄨㄟ
ㄅㄨㄟˇ
ㄅㄨㄞˋ
ㄅㄨㄞ
ㄅㄨㄞˇ
ㄅㄨㄚˋ
ㄅㄨㄚ
ㄅㄨㄚˇ
ㄅㄨㄛˋ
ㄅㄨㄛ
ㄅㄨㄛ

ㄅㄠˋ 姚 ㄅㄠˋ 洮 ㄅㄠˋ 瑤 ㄅㄠˋ 傜 ㄅㄠˋ 咬 ㄅㄠˋ 舀 ㄅㄠˋ 杳 ㄅㄠˋ 窈 ㄅㄠˋ 要 ㄅㄠˋ 藥 ㄅㄠˋ 耀 ㄅㄠˋ 鑰 ㄅㄠˋ 約 ㄅㄠˋ 鷂 ㄅㄡˋ 優 ㄅㄡˋ 憂 ㄅㄡˋ 幽 ㄅㄡˋ 悠 ㄅㄡˋ 由 ㄅㄡˋ 遊 ㄅㄡˋ 油

ㄅㄝˋ 冶 ㄅㄝˋ 業 ㄅㄝˋ 葉 ㄅㄝˋ 夜 ㄅㄝˋ 液 ㄅㄝˋ 頁 ㄅㄝˋ 咽 ㄅㄝˋ 謁 ㄅㄝˋ 燁 ㄅㄢˋ 崖 ㄅㄢˋ 要 ㄅㄢˋ 腰 ㄅㄢˋ 邀 ㄅㄢˋ 妖 ㄅㄢˋ 喲 ㄅㄢˋ 吆 ㄅㄢˋ 搖 ㄅㄢˋ 謠 ㄅㄢˋ 堯 ㄅㄢˋ 窰 ㄅㄢˋ 遙

ㄅㄚˋ 押 ㄅㄚˋ 蚜 ㄅㄚˋ 涯 ㄅㄚˋ 埡 ㄅㄚˋ 亞 ㄅㄚˋ 雅 ㄅㄚˋ 啞 ㄅㄚˋ 氬 ㄅㄚˋ 亞 ㄅㄚˋ 軋 ㄅㄚˋ 訝 ㄅㄚˋ 研 ㄅㄚˋ 硏 ㄅㄚˋ 唷 ㄅㄝˋ 耶 ㄅㄝˋ 爺 ㄅㄝˋ 椰 ㄅㄝˋ 琊 ㄅㄝˋ 也 ㄅㄝˋ 野

ㄅㄞˋ 驛 ㄅㄞˋ 斁 ㄅㄞˋ 溢 ㄅㄞˋ 曳 ㄅㄞˋ 奕 ㄅㄞˋ 蜴 ㄅㄞˋ 縊 ㄅㄞˋ 懿 ㄅㄞˋ 刈 ㄅㄞˋ 腋 ㄅㄞˋ 翊 ㄅㄞˋ 詣 ㄅㄞˋ 挹 ㄅㄞˋ 益 ㄅㄞˋ 呀 ㄅㄞˋ 壓 ㄅㄞˋ 鴨 ㄅㄞˋ 鴉 ㄅㄞˋ 押 ㄅㄞˋ 牙 ㄅㄞˋ 芽 ㄅㄞˋ 衙

ㄅㄟˋ 倚 ㄅㄟˋ 踦 ㄅㄟˋ 意 ㄅㄟˋ 義 ㄅㄟˋ 議 ㄅㄟˋ 易 ㄅㄟˋ 亦 ㄅㄟˋ 益 ㄅㄟˋ 異 ㄅㄟˋ 藝 ㄅㄟˋ 譯 ㄅㄟˋ 役 ㄅㄟˋ 憶 ㄅㄟˋ 億 ㄅㄟˋ 翼 ㄅㄟˋ 疫 ㄅㄟˋ 羿 ㄅㄟˋ 誼 ㄅㄟˋ 毅 ㄅㄟˋ 逸 ㄅㄟˋ 邑 ㄅㄟˋ 肄 ㄅㄟˋ 抑 ㄅㄟˋ 掖

ㄅㄟˋ 遺 ㄅㄟˋ 疑 ㄅㄟˋ 移 ㄅㄟˋ 宜 ㄅㄟˋ 儀 ㄅㄟˋ 姨 ㄅㄟˋ 夷 ㄅㄟˋ 胰 ㄅㄟˋ 貽 ㄅㄟˋ 咦 ㄅㄟˋ 怡 ㄅㄟˋ 詒 ㄅㄟˋ 沂 ㄅㄟˋ 頤 ㄅㄟˋ 犀 ㄅㄟˋ 飴 ㄅㄟˋ 痍 ㄅㄟˋ 以 ㄅㄟˋ 已 ㄅㄟˋ 尾 ㄅㄟˋ 乙 ㄅㄟˋ 椅 ㄅㄟˋ 蟻 ㄅㄟˋ 矣

ㄅㄢˋ 盎 ㄅㄢˋ 兒 ㄅㄢˋ 而 ㄅㄢˋ 爾 ㄅㄢˋ 耳 ㄅㄢˋ 尔 ㄅㄢˋ 洱 ㄅㄢˋ 餌 ㄅㄢˋ 邇 ㄅㄢˋ 二 ㄅㄢˋ 貳 ㄅㄢˋ 一 ㄅㄢˋ 衣 ㄅㄢˋ 醫 ㄅㄢˋ 依 ㄅㄢˋ 伊 ㄅㄢˋ 壹 ㄅㄢˋ 揖 ㄅㄢˋ 漪 ㄅㄢˋ 黟

ㄅㄢˋ 耦 ㄅㄢˋ 安 ㄅㄢˋ 鞍 ㄅㄢˋ 菴 ㄅㄢˋ 庵 ㄅㄢˋ 諳 ㄅㄢˋ 鮟 ㄅㄢˋ 氨 ㄅㄢˋ 暗 ㄅㄢˋ 案 ㄅㄢˋ 岸 ㄅㄢˋ 按 ㄅㄢˋ 黯 ㄅㄢˋ 恩 ㄅㄢˋ 嗯 ㄅㄢˋ 摁 ㄅㄢˋ 骯 ㄅㄢˋ 昂 ㄅㄢˋ 昂

ㄅㄠˋ 凹 ㄅㄠˋ 熬 ㄅㄠˋ 嗷 ㄅㄠˋ 熬 ㄅㄠˋ 鼇 ㄅㄠˋ 敖 ㄅㄠˋ 鏖 ㄅㄠˋ 遨 ㄅㄠˋ 襖 ㄅㄠˋ 拗 ㄅㄠˋ 澳 ㄅㄠˋ 奧 ㄅㄠˋ 傲 ㄅㄠˋ 懊 ㄅㄡˋ 歐 ㄅㄡˋ 甌 ㄅㄡˋ 毆 ㄅㄡˋ 偶 ㄅㄡˋ 藕 ㄅㄡˋ 嘔

ㄅㄣˋ 顎 ㄅㄣˋ 愕 ㄅㄣˋ 呃 ㄅㄣˋ 鶚 ㄅㄣˋ 唉 ㄅㄣˋ 哀 ㄅㄣˋ 埃 ㄅㄣˋ 挨 ㄅㄣˋ 哎 ㄅㄣˋ 捱 ㄅㄣˋ 矮 ㄅㄣˋ 藹 ㄅㄣˋ 靄 ㄅㄣˋ 噯 ㄅㄣˋ 愛 ㄅㄣˋ 礙 ㄅㄣˋ 艾 ㄅㄣˋ 瓔 ㄅㄣˋ 隘 ㄅㄣˋ 碍

王18-11-23

王18-11-24

王18-11-25

Fig-13

Coding of Symbols for Time-Sharing General Purpose and Built-In Internal Computer Programs

| Symbol | Code | Key# | Symbol | Code | Key# |
|---|---|---|---|---|---|
| ㄉ | 1 | J | ㄋ | 26 | S |
| ㄐ | 2 | E | ㄊ | 27 | C |
| ㄓ | 3 | A | ㄌ | 28 | F |
| ㄒ | 4 | W | ㄍ | 29 | G |
| ㄗ | 5 | Y | ㄎ | 30 | X |
| ㄍ | 6 | ; | ㄏ | 31 | B |
| ㄊ | 7 | U | ㄑ | 32 | , |
| ㄇ | 8 | P | ㄙ | 33 | R |
| ㄑ | 9 | 4 | ㄔ | 34 | T |
| ㄅ | 10 | 0 | ㄟ | 35 | 9 |
| ㄈ | 11 | M | ㄝ | 36 | Q |
| ㄕ | 12 | I | ㄦ | 37 | 3 |
| ㄔ | 13 | L | ˋ | 38* | |
| ㄙ | 14 | Z | ( - ) | 39 | space bar |
| ㄚ | 15 | O | ˊ | 40* | |
| ㄛ | 16 | H | ˇ | 41* | |
| ㄞ | 17 | . | ˙ | 42* | |
| ㄤ | 18 | ' | , | 43 | |
| ㄢ | 19 | 8 | . | 44 | 6 |
| ㄣ | 20 | 2 | ˋ | 45 | 7 |
| ㄠ | 21 | / | ; | 46 | ½ |
| ㄧ | 22 | K | : | 47 | - |
| ㄨ | 23 | D | ? | 48 | = |
| ㄩ | 24 | N | ! | 49 | 1 |
| ㄚ | 25 | V | " | 50* | |

| Function | Code |
|---|---|
| correcting key | 51 |
| clearing key | 52 |
| back space | 53 |
| skip a space | 54 |
| change line | 55 |
| repeat character | 56 |

Definition of Sets

PH:{1, 2, ... , 37}

SP:{43, 44, ... , 50}

CR:{51}

CL:{52}

SF:{53, 54, 55, 56}

For the keyboard of Fig. 1.

* not used in the Optimal Phonemetype II

METHOD AND APPARATUS FOR REPRODUCING DESIRED IDEOGRAPHS

The present invention relates in general to a method and apparatus for typing Chinese ideographs and the more specifically relates to such a method and apparatus for use with a computer having a conventional input keyboard terminal.

Prior known devices for printing the Chinese characters have been complex because the basic spoken language is written in more than 10 thousand characters. Because of the large number of characters required to print the Chinese language it is apparent that a conventional typewriter as is used for the English language cannot be used to print the Chinese language since it would require in excess of 10 thousand keys with a single key for each word that is to be printed. The prior known devices have been limited by their inability to define a code using only knowledge which is normally acquired by the operator so that the code may be easily memorized and quickly used with little training to select any ideographic character from the entire list available for the language.

The transmission of telegrams illustrates the difficulty of having so many characters. One telegraphic system utilizes a code book which lists about 9 thousand characters and indexes each character with a 4 digit number whereby the 4 digit number is transmitted on a telegram with the telegram translated back to ideographic characters using the four digit number to find the corresponding characters in a vocabulary list at the receiving facility. The authors of telegrams are restricted to using those characters listed in the code book for it is obvious that a character which is not included cannot be transmitted.

One currently available typewriter includes trays of moveable type from which one character at a time is selected, struck against typewriter paper, and returned to its original storage position. The character selected is manipulated with a single selection lever which is moved over the tray of type. The major difficulty in using this typewriter is that it requires memorization of thousands of locations of type to be efficiently operated. Another currently available Chinese type setting machine utilizes a keyboard having 27 columns and 44 rows of keys each of which controls two characters to provide a vocabulary list containing 2,376 characters. This system has a one to one correspondence between the keys and a vocabulary list and therefore an operator must memorize the location of each character.

Another machine used for translating Chinese has all of the characters in the vocubulary list divided into two parts and the radicals which appear in the upper and lower parts of each character are used to define groups of characters all of which have these two parts in common. These groups are displayed optically, and the final selection is made by selection from a visual display. Thus, only three key strokes are required to identify any character in the vocubulary with two to display the group which includes the desired character and a third to select and print the character. This system is expensive and operators would require extensive training to become efficient because the indexing system is not based on common knowledge.

Another Chinese typewriter has been developed which is based on an indexing system which uses the sequence of standard brush strokes normally used in writing a character. The key sequence used to draw the strokes of the character is inputed digital computer which matches the sequence of strokes to the character in a vocabulary list. These machines usually require an optical output to resolve ambiguities and for final verification of the character selected since the typist might not be certain of the sequence of strokes required or may have made errors in keying the stroke sequence.

Mandarin is used by millions of Chinese who have no difficulty in understanding the spoken word and their speech may be recorded faithfully by use of a Chinese phonetic alphabet which is widely known. The Council on Unifying Chinese Pronunciation has promoted the use of the Chinese phonetic alphabet since 1932 when it published the first edition of a list of standard pronunciation of Chinese characters.

Unfortunately, indexing Chinese characters phonetically does not produce a unique character because Chinese characters have simple pronunciations with none of them being more than three phonemes long which makes homonyms much more common in Mandarin than in English. The Council on Unifying Chinese Pronunciation list of standard pronunciations contains a word list of approximately ten thousand characters arranged in approximately 1300 groups of homonyms. Phonetic indexing therefore leads only to unique identification of homonym groups. While these homonym groups could be viewed optically for final selection, this approach would be expensive and would result in greatly reduced typing speeds.

Mandarin is used by millions of Chinese who have no difficulty in understanding the spoken word. The ambiguity which exists when single words are heard does not exist in normal speech because phrases of words which identify the unique sequences of words from homonym groups are heard and understood. The Chinese phonetic alphabet as described above is used in many dictionaries and is commonly learned by school children. It is so widely used in teaching that a daily newspaper is printed in which the text is written in ideographs and phonetic symbols side by side.

These prior typewriting systems have been handicapped by their slow speeds and the difficulty inherent in training an operator to perform the necessary indexing for their use.

It is therefore the object of the present invention to provide a new and improved typewriter for ideographic characters.

Another object of the present invention is to provide an ideographic typewriter using a conventional keyboard to permit the unique typing of each desired ideograph with the minimum number of key strokes on the keyboard.

It is a further object of the present invention to provide a typewriter for ideographic characters which provides the best compromise between the conflicting demands of ease of learning, brevity of key stroke sequences, uniqueness, and psychological comfort.

A still further object of the present invention is to provide codings for ideographic characters which uniquely identify each ideograph, are easy to learn, are psychologically pleasing and are efficient to use while permitting some variations in phonetic coding according to pronunciations in different dialects.

A further object of the present invention is to provide an ideographic typewriter which is completely self-contained, including within it a small fixed program special purpose computing machine and printing mechanism, which can be operated in a touch typing mode using codings easily learned, without optical displays being needed to resolve ambiguities, and which in size and form resembles a conventional typewriter.

A further purpose of the present invention is to provide a typewriter for use in Chinese which is based on principles usually learned in school and always used in daily speech.

Another object of the present invention is to produce an ideographic typewriter which is fast, efficient and inexpensive thereby being of immeasurable importance to future developments in commerce, industry and government in the Far East.

Another object of the present invention is to provide a Chinese ideographic character typewriter for indexing thousands of characters so that they may be coded in efficient and easily learned methods for rapid selection from sequences of key strokes made on a simple keyboard without the necessity of having optical displays to resolve ambiquities.

Obtainment of the objects of this invention is based on the use of a completely phonetic indexing system to identify ideographs uniquely by means of spelling the pronunciation and/or using the phonetic symbols to describe geometry, either through simplified naming or descriptions of brush strokes, naming radicals or parts of characters, or suggesting meanings of the character described.

Other objects and advantages of the invention will become more apparent to those persons having ordinary skill in the art to which the present invention pertains from the following description taken in conjunction with the accompanying drawings wherein.

Figure 1:
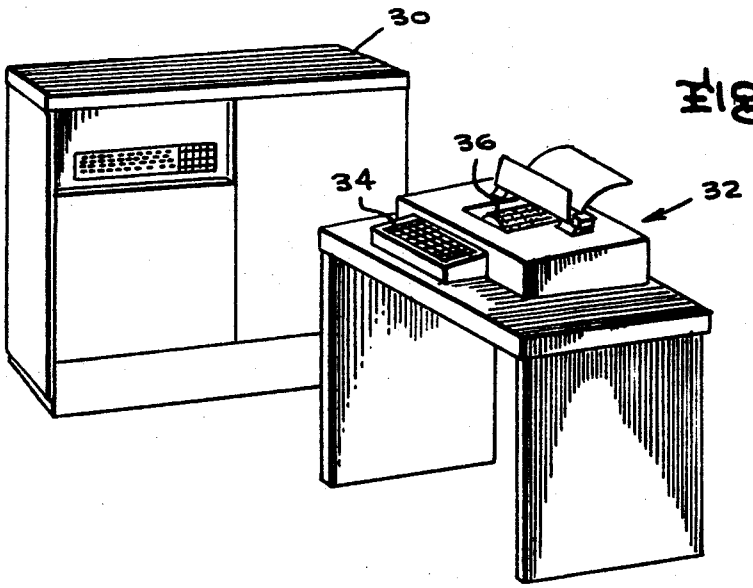
FIG. 1 is a perspective view of a system embodying the present invention.
Figures 1, 14:
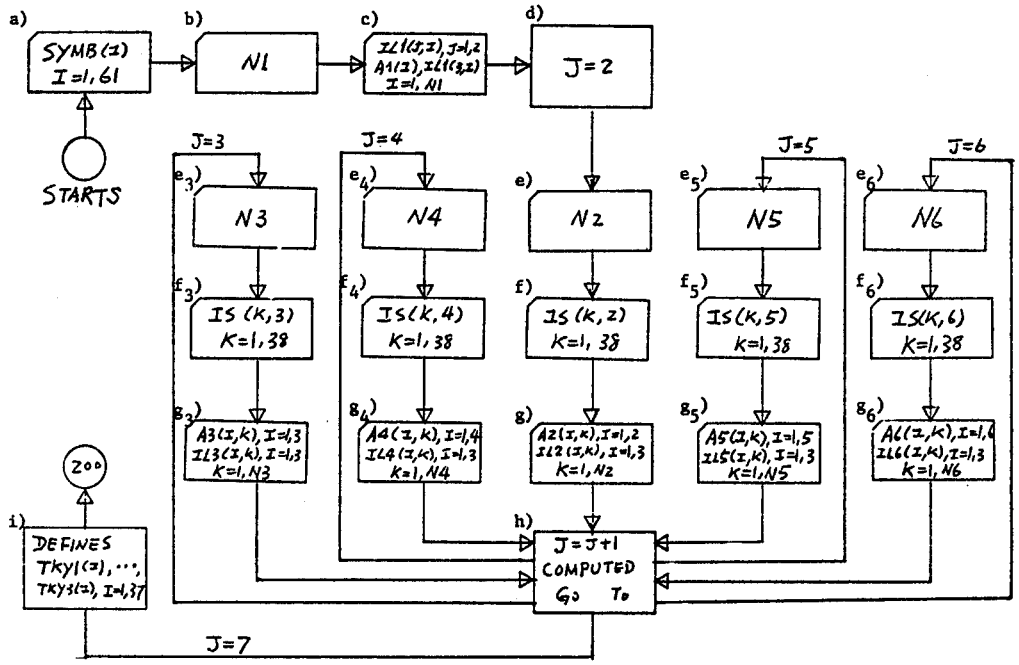
Figures 2, 14:
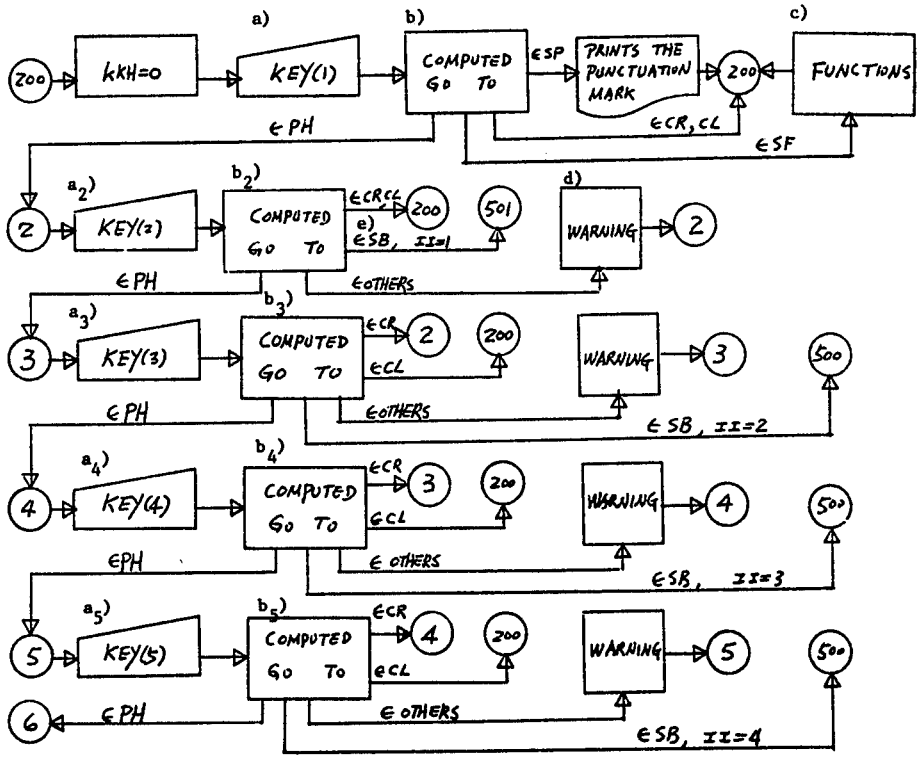
FIG. 2 illustrates the standard Chinese phonetic symbols with corresponding international phonetic alphabet and approximate English equivalents.
Figures 2, 14:
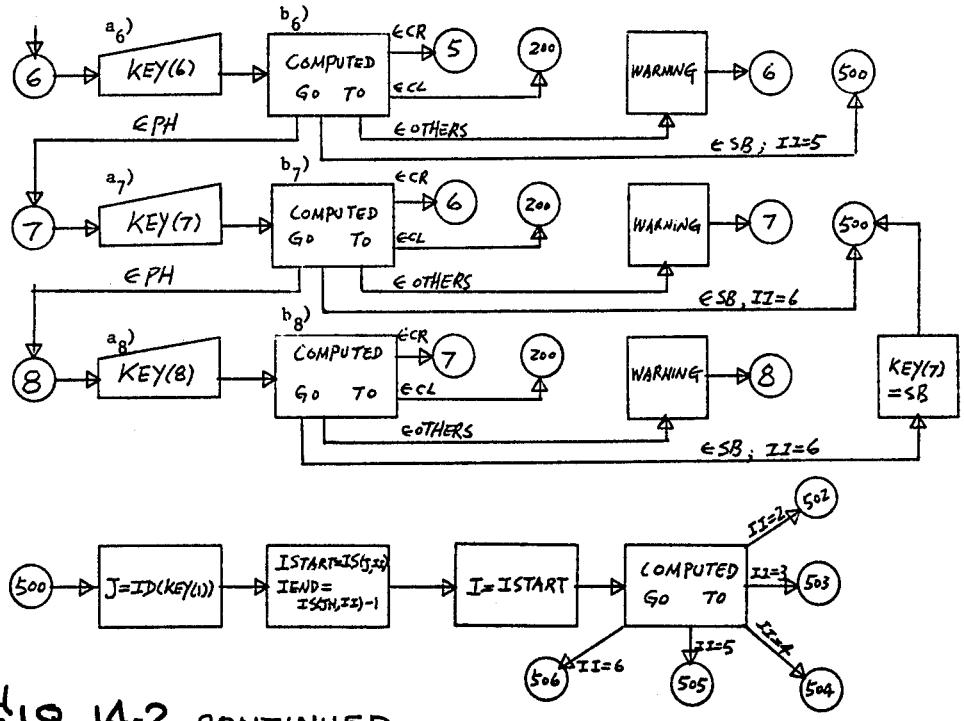
Figures 3, 14:
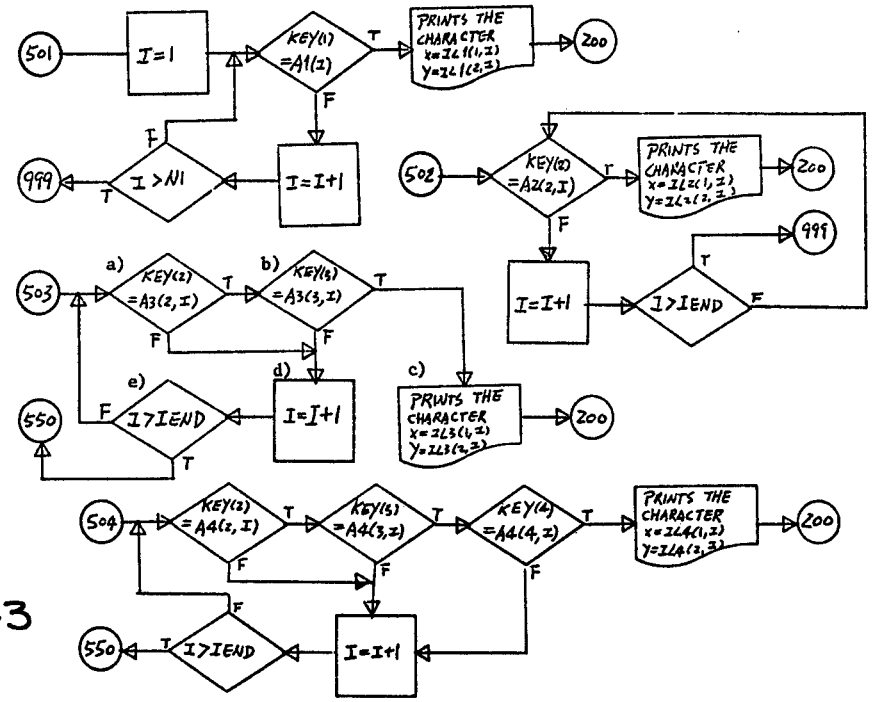
Figures 3, 14:
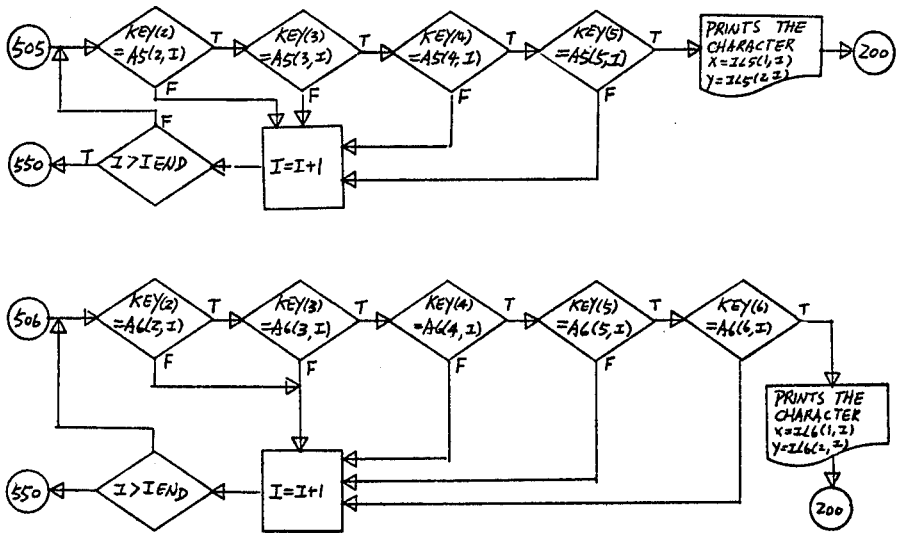
Figures 4, 14:
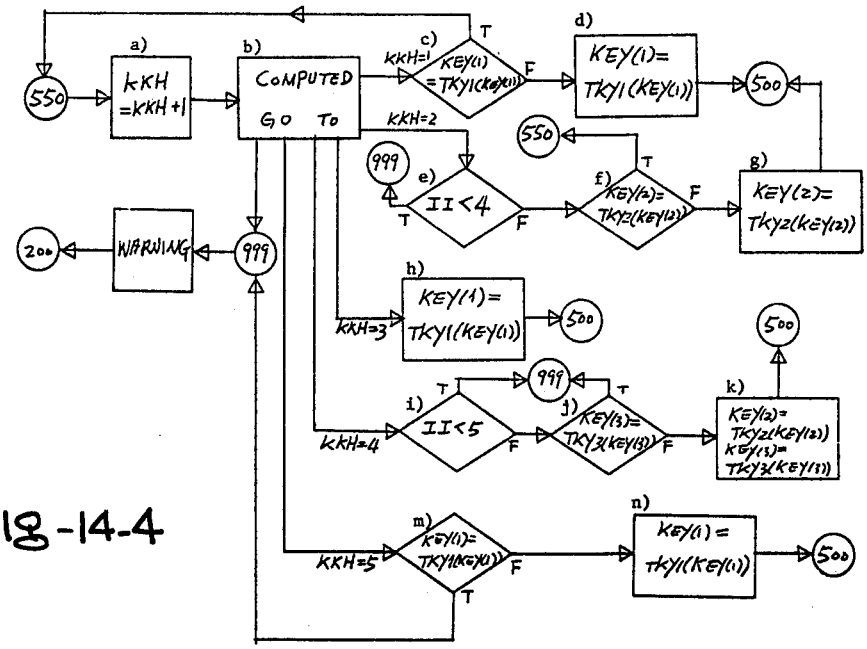

FIGS. 3-1 and -2 illustrate examples of coding for brush strokes which resemble the phonetic symbols;

FIGS. 4-1 through -4 illustrate coding when the phonetic symbol is an abbreviation of the name of the brush stroke;

FIG. 5 illustrates the characters of the special category which are coded by a single key stroke;

FIG. 6 illustrates the pronouns which are coded phonetically;

FIG. 7 illustrates the coding of characters in the exceptional category;

FIG. 8 illustrates the optional coding for frequently used characters.

Figure 12:
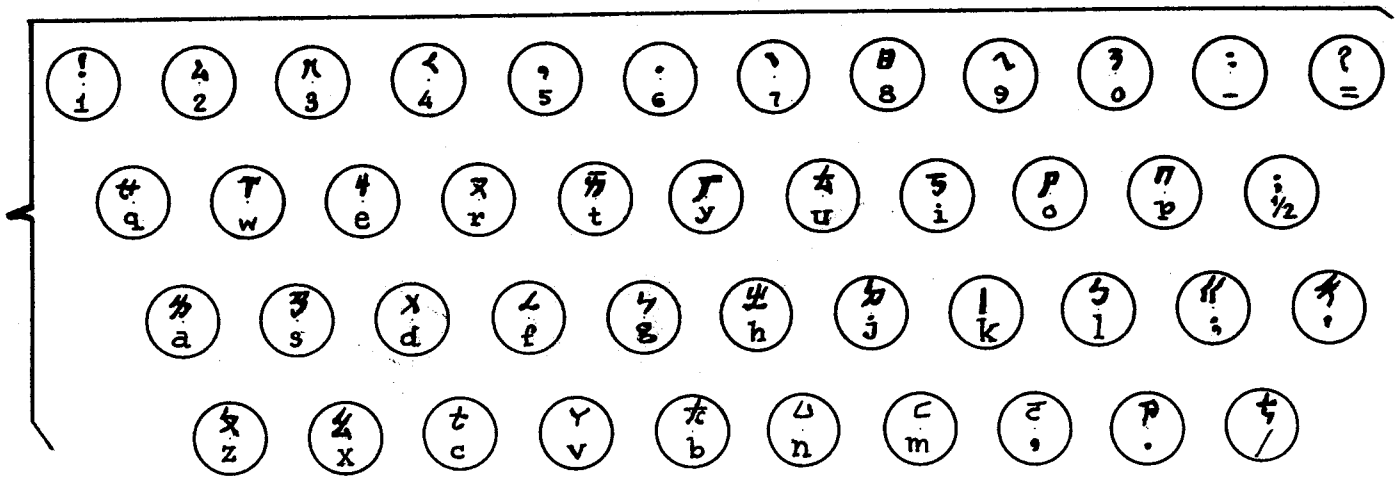
Figure 15:
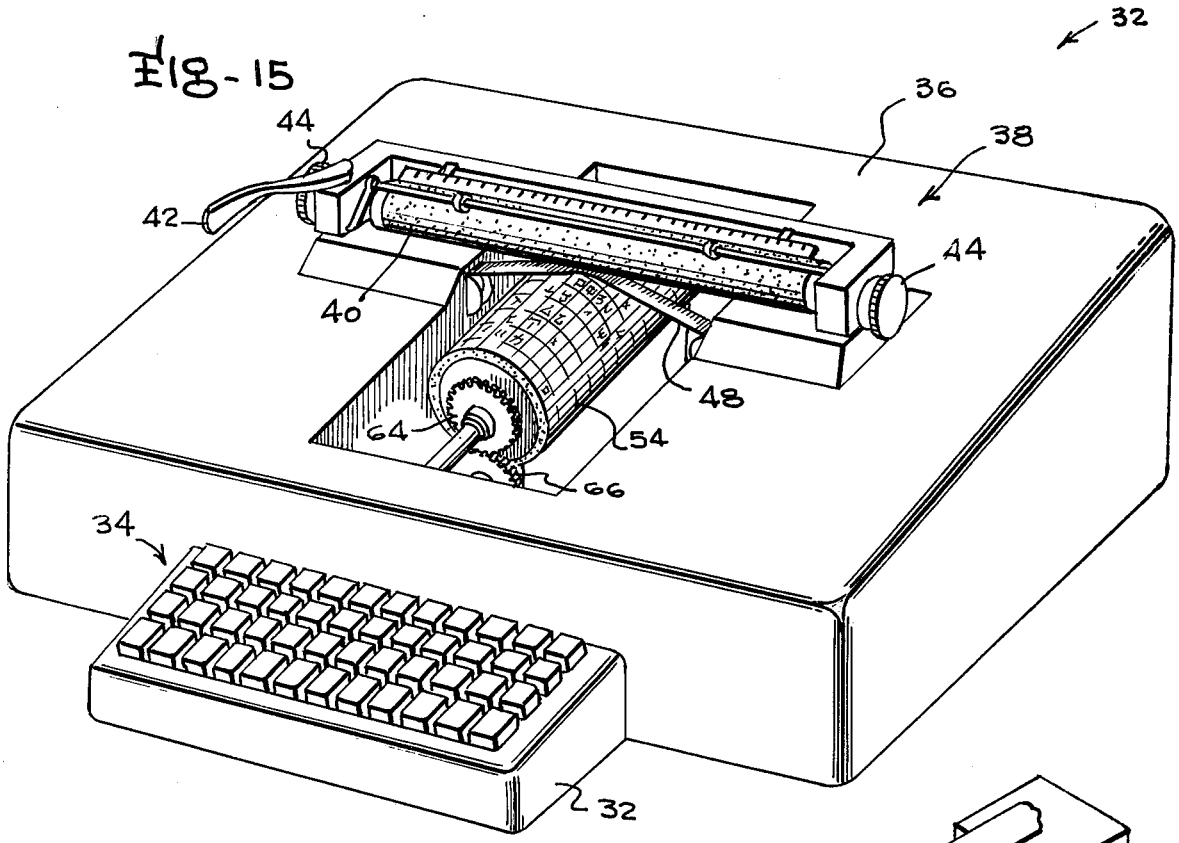
Figure 16:
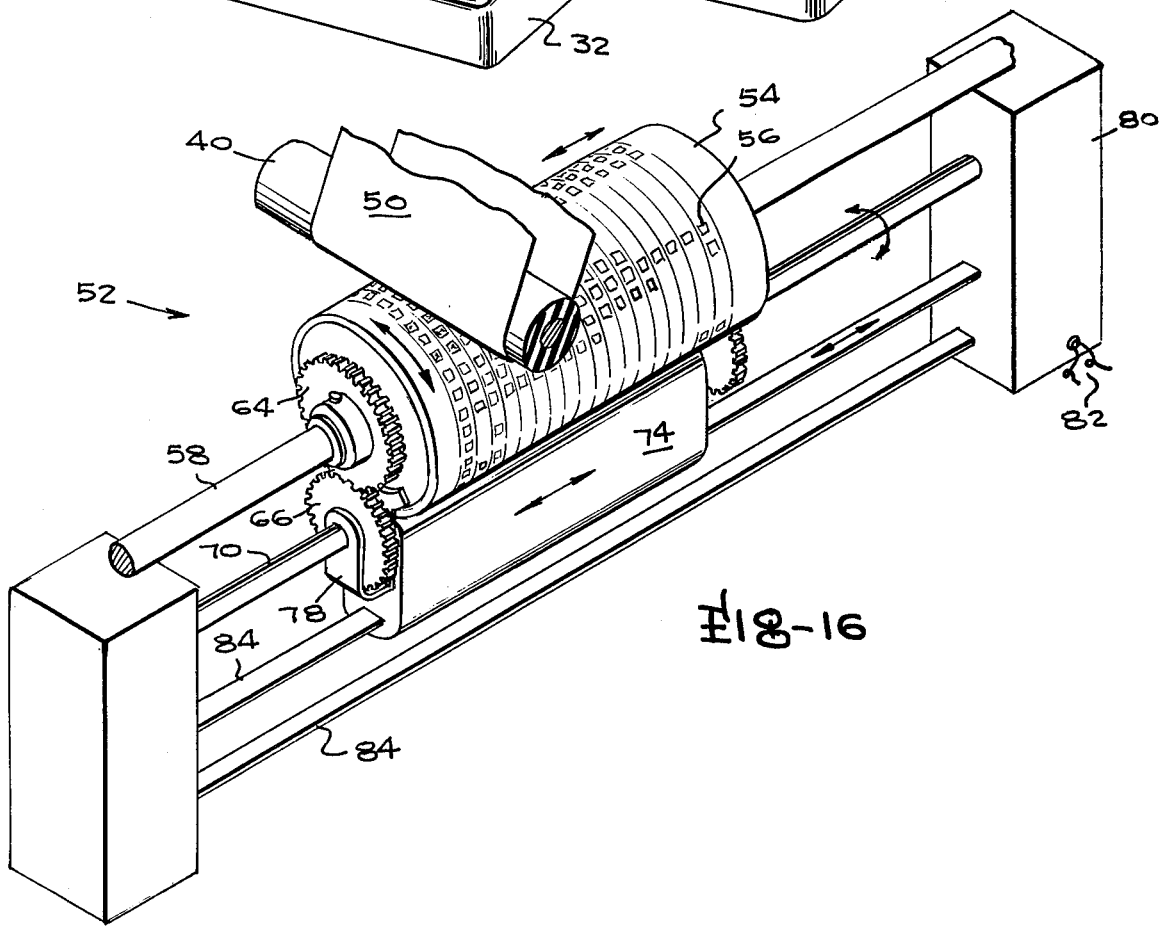
Figure 18:
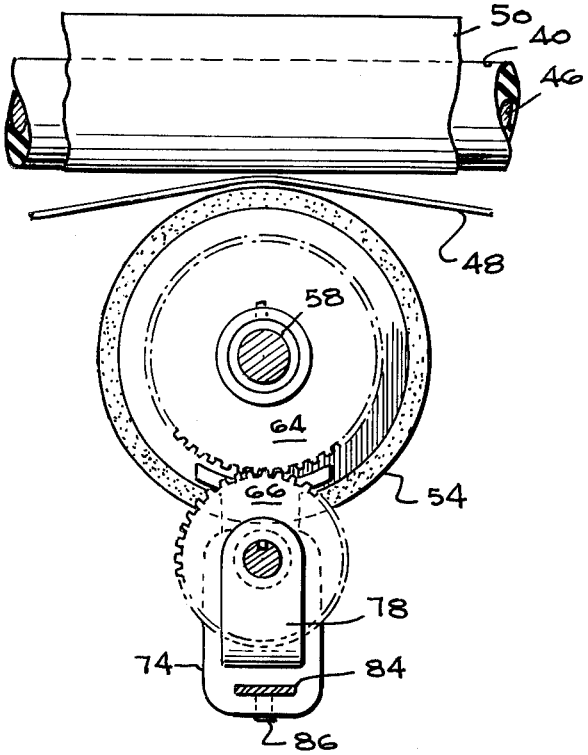
Figure 19:
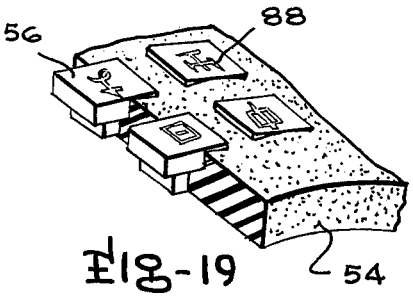
Figure 17:
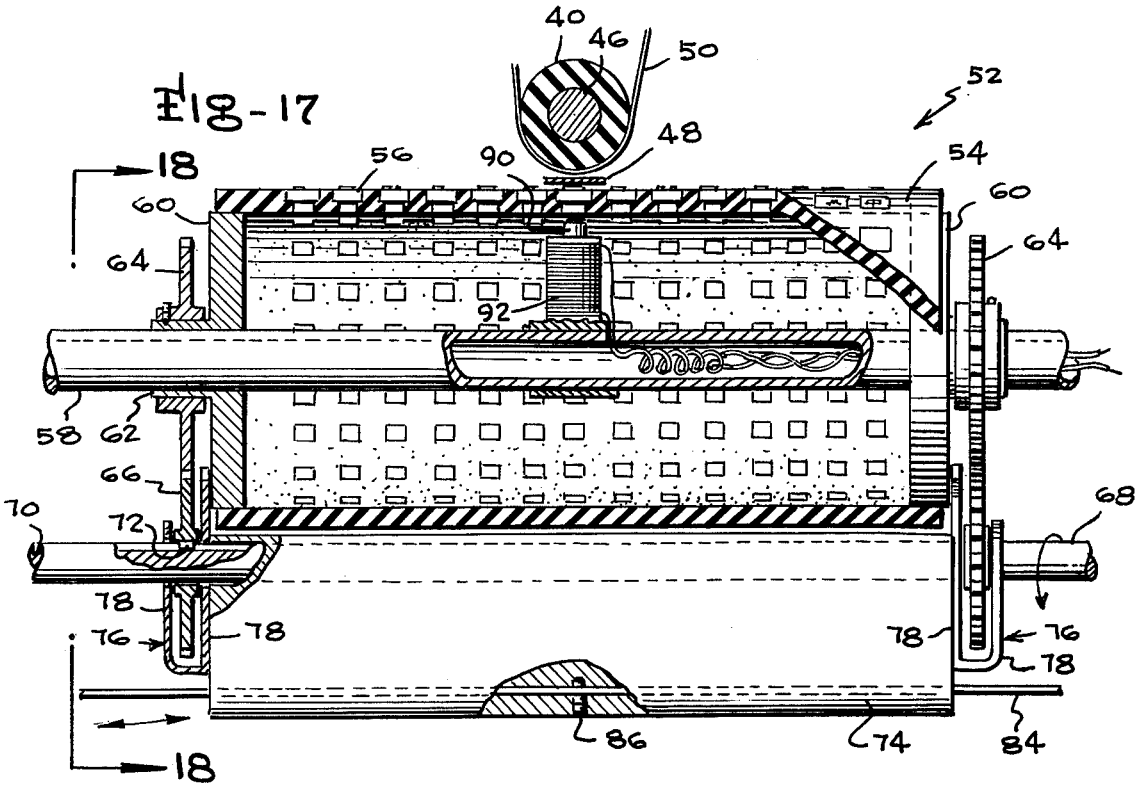

FIGS. 9-1 and -2 illustrate the nearly maximum possible optional coding list;

FIG. 10 illustrates the permissible variations in coding of the general and exceptional categories;

FIG. 11-1 through -25 illustrate the master coding list;

FIG. 12 is a diagrammatic view of the keyboard of the preferred embodiment of the present invention;

FIG. 13 illustrates the coding of symbols;

FIGS. 14-1 through -4 are the flow diagrams of the computer program for practicing the preferred method of the present invention;

FIG. 15 is a perspective view of a keyboard, input terminal and output printer of the preferred embodiment of the present invention;

FIG. 16 is a fragmentary perspective view of the paper roller and cylindrical typing head with x-y position indicator of the output printer shown in FIG. 16;

FIG. 17 is a fragmentary side elevation view of the cylindrical typing head and paper roller shown in FIG. 17;

FIG. 18 is a fragmentary end view of the paper roller and cylindrical typing head taken along line 18—18 in FIG. 17;

FIG. 19 is an enlarged fragmentary perspective view of portion of the cylindrical typing head shown in FIG. 18 with two type blocks partially exposed.

Referring first to FIG. 1 of the drawings there is illustrated a preferred embodiment for practice of the present invention, which includes a computer 30 such as an IBM 370-158 or much smaller general purpose computing machine. The computer is used in combination with an input terminal 32 with a keyboard 34 and an output printer 36. A special purpose internal computer may be provided if desired. In this case, the complete typewriter would appear as shown in FIG. 15.

To practice the present invention, all ideographs are coded using only the standard Chinese phonetic symbols. All words in Mandarin can be written phonetically using 37 different symbols with one of five tone marks to indicate the accents to be used in pronouncing them. The standard Chinese phonetic symbols are shown in FIG. 2 along with the corresponding international phonetic alphabet and approximate English equivalents.

Phonetic symbols are used in one or two sequences of from 1 to 3 symbols each. The first sequence is a coding of the pronunciation of the character according to the standard Peking dialect, without designation of tone marks. Because of the many homonym groups in which different characters have the same pronunciation, the use of phonetic coding by itself does not identify the characters uniquely. A second sequence of phonetic symbols is used to describe the geometry or descriptive characteristic of the characters to the extent necessary for unique identification. The two sequences of symbols are typed into the input terminal 32 through the keyboard 34, as shown in FIG. 12, without interruption and with the completion of the input for a single character signaled by striking the space bar.

Following are the rules for coding to produce sequences of key strokes which identify single characters so that such typing of Chinese characters is made possible in ways which make the coding unique enough to identify single ideographs, easy to learn, psychologically pleasing and efficient to use, yet permitting some variations in phonetic coding according to pronunciations in different dialects.

RULES FOR CODING

Every character is coded by a sequence of keystrokes using phonetic symbols only. All characters are divided into five categories for coding: (1) General, (2) Special, (3) Exceptional, (4) Optional, and (5) Neighboring Pronunciation categories.

(1) General Category

Most characters are in this category and are coded by typing two connected sequences of keystrokes. The first is the standard pronunciation of the character without any tone mark and the second is a coding of the geometry of the character using phonetic symbols only.

(a) All characters, except those which belong to the Special or Exceptional categories, are coded according to the following rules in the order of the steps given:

Step 1. The pronunciation of the character is coded using phonetic symbols without tone marks and using the standard Peking dialect.

Step 2. Immediately following the phonetic coding of Step 1, without a space or gap, the geometric shape of the brush stroke or strokes of the character is coded using phonetic symbols only in the order i) upper left corner, ii) upper right corner, iii) lower left corner, and iv) lower right corner.

Step 3. The coding for a given character is completed by using the space bar. This indicates that the coding for a given character has been completed, and that the next keystroke begins the coding of the next character is to be typed.

(b) After the phonetic sequence has been coded, the geometry of the brush strokes or radicals is coded using the following rules:

(i) If a brush stroke or a combination of brush strokes resembles the phonetic characters used on the keyboard, these phonetic characters are used as a coding in the geometric sequence (examples are shown in FIG. 3).

(ii) In other cases, the first phonetic symbol (consonants) or the last phonetic symbol (vowels) of the pronunciation of the name of the brush stroke or the combination of brush strokes is used (examples are shown in FIG. 4).

Note that in FIGS. 3 and 4 a standard brush stroke or strokes are followed by a sequence of derived, deformed, or related brush stroke shapes to form a subset of the system so that the typist can type the code efficiently without need of a detailed analysis of the structure of the character for which the identifying sequence is being typed.

(c) In order to achieve the highest efficiency, priorities are established in coding as follows:

(i) Coding a complicated combination of brush strokes has priority over coding a less complicated combination and coding a single brush stroke has the lowest priority in coding.

(ii) A brush stroke or a combination of brush strokes occurring in a character, except for characters containing the radical ⊓ is coded only once in the geometric coding. If a brush stroke or combination of brush strokes has been coded and occurs again in the corner currently being coded geometrically, it may not be used again, i.e., the corner currently being coded, if it is a duplication, is omitted. If it occurs again in another corner, it is again omitted. Examples are:

人(ㄖㄣ), 打(ㄉㄚㄗ), 户(ㄏㄨ), 屋(ㄨㄗ),

何(ㄏㄜㄣ), 木(ㄇㄨㄇ), 米(ㄇㄧ)

(d) Except for symmetric strokes having the coding shown, all symmetric or almost symmetric characters or parts of a character are treated as follows:

(i) For symmetric characters of the type that the left part and the right part of a character are the same (although perhaps differing slightly according to the style used in handwriting) and the central part different, only the central core (i.e., the non-symmetric core portion) is to be coded. These characters have the general form ▨ ▯ ▨. Examples are:

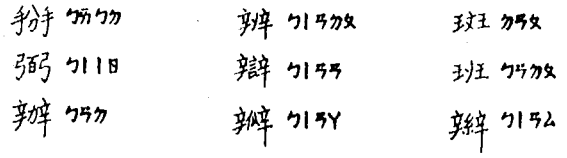

(ii) If a symmetric character has a central core which is not separable from the lower corners, only the central core is to be coded, i.e., if it has the shape 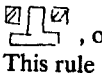 , only the part, 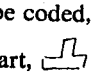 is used in the coding. This rule is also applicable to parts of a character, Examples are:

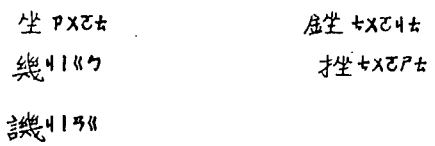

(iii) If a character has a symmetric upper part, only the left upper corner of the central part is coded in place of coding both of the upper corners. Only one key stroke for the upper corners is used in coding, i.e., if a character looks like 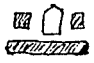 , only one keystroke of the left upper corner of ⊓ is used. This rule is also used for coding parts of characters. Examples are:

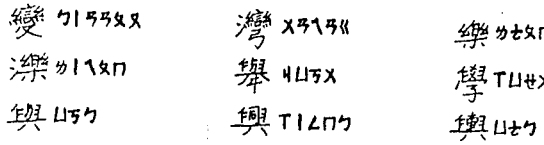

(iv) All symmetric characters without central cores are considered to be normal characters not coded by the rules of symmetry. Examples are:

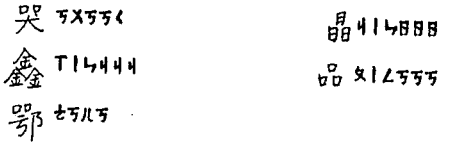

(V) Symmetric characters with identical parts not located in the corners to be coded are considered to be normal characters not coded by the rules of symmetry. Examples are:

來 ㄌㄞˊ　　乘 ㄔㄥˊ

(e) If the entire character has a box-type boundary, the box is used for coding the upper corners, and the lower corners of the part contained in the box are used for the lower corners in coding. Examples are:

國 ㄍㄨㄛˊ　　因 ㄧㄣ　　困 ㄎㄨㄣˋ

Note that if a part of a character is contained in a box, the box is considered to be a combination of brush strokes, not as an entity. Examples of this are:

掴 ㄍㄨㄛˊ　　捆 ㄎㄨㄣˋ　　茵 ㄧㄣ

In general the maximum number of key strokes for coding a character is six. Thus, if three phonetic symbols are used to code the pronunciation, only the phonetic symbols for the first three corners are used in the geometric coding. However, if the typist codes all four corners, the seventh keystroke will be ignored by the system.

(2) Special Category (a) Characters coded by a single keystroke

The five most frequently used characters are coded by a single keystroke in order to maximize typing speed. The coding is partly phonetic, and partly geometric, as shown in FIG. 5. Note that when phonetic coding is used here, only the phonetic symbol of the leading phoneme is used.

The five characters shown in FIG. 5 must be coded as shown in the Figure.

(b) Frequently used characters which are coded phonetically only.

The characters which represent personal pronouns are coded phonetically only without the use of tone marks as shown in FIG. 6.

(3) Exceptional Category

In order to avoid uniqueness problems caused by conflicts in coding when the general rules are used, a few exceptional characters which have a low frequency of use are coded as follows:

i) The phonetic coding is done as usual.

ii) The geometry is coded by using the pronunciation of the name of the radical spelled phonetically without the tone mark, or in a few exceptional cases as given in FIG. 7.

(4) Optional Category

The machine is designed so that in addition to using the regular coding, phonetic coding only without tone-mark designations can be used for coding the most frequently used characters, as given in FIG. 8. The characters in this table are arranged in order of decreasing frequency of usage. They have been selected from the most frequently used 300 characters.

Remarks on the Optional Category

All characters are indexed properly using the rules for coding given in the General, Special, and Exceptional Categories. The Optional and Neighboring Pronunciation Categories are additional codings which are provided to make the indexing faster at the option and convenience of the typist using them. As the typist becomes more familiar with the machine, his typing speeds will gradually increase because he is certain to increase the use of the shorter, optional codings provided.

A nearly maximum possible short coding list is given in FIG. 9. The characters in this figure are listed according to the standard order of the leading phonetic symbol with standard pronunciation required.

(5) Neighboring Pronunciation Category

The standard pronunciation of Chinese characters which is used in the phonetic coding of the characters is that of the Peking dialect; however, many Chinese people are accustomed to speaking their native dialects and do not ordinarily use perfect pronunciation even though they know the standard pronunciation. Certain inaccuracies are allowed in the phonetic coding of characters in order to make the coding comfortable and psychologically pleasing to more people.

Although standard pronunciation is required in the use of coding in the Optional Category, some variations in pronunciation of characters in both the General and Exceptional Categories are possible as shown in FIG. 10.

The Master Coding List

The master coding list is shown in FIG. 11. It is the coding which results when the coding rules discussed above are used with the standard pronunciation to code the basic characters or ideographs which can be typed by the system.

Although it is the list which the typist should refer to should questions of coding arise, it is not to be taken to be complete, for the list includes neither optional short codings nor neighboring sound codings, both of which are provided for in the logic of a translator in the computer 30 for the convenience of the typist.

It is clear that the list of FIG. 11 can be lengthened considerably without altering the rules for coding keystroke sequences in typing, the logic used for processing in the translator, or the basic design of the system. The optional codings provided for are not necessary, but will allow increased typing speeds as the typist becomes accustomed to and comfortable in his work.

The keyboard 34 for any typewriter or composing machine should be designed for efficiency and comfort of use. A good design for an efficient and comfortable keyboard is shown in FIG. 12 and is based on a weighted frequency account of written Mandarin coded according to the rules discussed above. The phonemes are shown located on a standard English keyboard. The spacing bar, some rarely used punctuation marks, and the special function keys are not shown.

TRANSLATOR

The preferred embodiment of the present invention is shown to include a general purpose computer since many large firms already have such computers for other purposes and could supply their office typing needs relatively inexpensively through use of the computer program to be described hereafter. A completely self-contained system can be produced if desired.

A computer program using general purpose time-sharing is described below.

COMPUTER PROGRAM FOR A TRANSLATOR USING A GENERAL PURPOSE COMPUTER

The input from the keyboard 34 on input terminal 32 to the translator in the computer 30 is the coded sequence of keystrokes typed to identify the character to be printed with each keystroke coded as shown in FIG. 13. Note that any standard coding, such as the ASC II code which is standard on keyboards which can now be purchased, can be substituted for that shown in FIG. 13 provided that the changes required to accommodate the coding of the keys are made in the program which receives the keystroke data as input.

A sequence of typed keystrokes thus forms a corresponding series of numbers which are processed arithmetically in the computing machine, a keystroke at a time to the extent possible. A keystroke sequence which has been typed is sent to a buffer memory in the translator. Within the translator, the sequence is used to identify a memory location in which the location or typing instructions are stored for the character identified.

In order to avoid searching the entire word list to find the sequence which matches that typed, the list has been divided into six major groups of words according to the number of keystrokes required to type the complete code for a single character. Each major group is divided into 37 subsets according to the leading phoneme (i.e. that of the first keystroke). Some subsets are empty because all phonemes do not occur in the leading position of a major group.

The number of keystrokes used for coding a given character is determined by counting the keystrokes up to the striking of the spacing bar, which indicates that the coding has been completed. This number is the group number to which the character belongs.

The search begins in this group at the subject of the phoneme of the leading keystroke. The keystroke sequence which has been typed is compared with each character of the subset. For efficiency in searching, the sequences stored in each subset are in descending order of use of the characters. The number of comparisons made in searching until a match is found is used to identify the sequence number of the character in the major group which contains the subset which was searched.

This sequence number locates a memory cell in which the x-y indices of the character's location in the printer 36 are stored and these indices are then sent to the printer.

If no correspondence between typed and stored keystroke sequences is found, possibilities for neighboring pronunciations are tested. If possible alternatives exist, further searches for comparisons are made. If none are found, either an error in typing has been made, or the character identified is not contained in the printer, and the typist is warned that this is the case.

A discussion of the flow charts shown in FIGS. 14-1 to 4 and a Fortran listing of a computer program for a translator using a general purpose computer follow. This program uses punched card inputs. In actual use of a general purpose computing machine for typing, however, the card input can be replaced by direct data input from the typewriter console 32.

FIG. 14-1: Read in and Store (a) This reads in and stores the list of symbols used with 61 being the maximum possible number using an IBM keypunch. The symbols listed in FIG. 13 are included.

(b) There are six groups in the master list. N1 is the number of members of the group of characters and punctuation marks which can be coded using only one keystroke.

(c) This reads in the locations of each of the members of the group in the type font, the single keystroke coding used to identify the member, and the sequence number of the member on the main list. The numbers IL1 (1,I) and IL1 (2,I) are the *x* and *y* indices, respectively, of the location in the type font of the Ith character in the first major group. A1(I) is the coding for the Ith member of the first major group. IL1 (3,I) is the sequence number of the character on the master list.

(d) J is an index number which defines the major group number. J runs from 2 to 6.

(e) This functions for group 2 as b) for group 1.

(f) For efficiency, the search is made in the major group identified by the number of keystrokes used in coding in the single subset identified by the leading phoneme of the coding. This subset is located by specifying the first and last sequence numbers of the characters of the major group which are contained in the subset. The sequence numbers of the leading characters in the second major group are identified by the numbers IS(K,2), where K is the phoneme sequence number, and 2 the major group number. For example, if K=5, the search starts at sequence number IS(5,2) and ends at (IS (6,2) - 1). Because differences are taken to determine the range to be searched, 38 numbers are required for each major group. If the differences IS (K+1,2) - IS (K,2) = 0, the Kth subset is empty.

(g) This reads the coding keystrokes, printer location indices, and master list sequence numbers into the memory. The master sequence numbers are not necessary for the functioning of the translator program. They are included here only for checking accuracy in experiments and machine construction. In the definition of A2(I,K), A stands for alpha-numeric, 2 for the second major group, I for the keystroke number (in group 2, I = 1 is the first keystroke, I = 2, the second), and K is the sequence number of the character in the second major group. In the definition of IL2(I,K), I stands for indices, L for location, 2 designates major group 2, I=1 refers to the x index, I = 2 to the y index, and I = 3 to the sequence number of the master list. K is defined as for A in the preceding sentences.

(h) This repeats reading the data into the memory for each major group in turn.

The explanations of items $e_3$), $e_4$), $e_5$) and $e_6$) for the various major groups are similar to those given for e) which were given for major group 2. Items $f_i$) and $g_i$) are treated similarly.

(i) TKY1(I), TKY2(I), and TKY2(I) are possible changes which could be made in the keystroke sequence typed according to the permissible variations in coding. See the Neighboring Pronunciation Category under the coding rules discussed earlier. In the designation TKY1(I), I is the phoneme sequence number and the number 1 means the first keystroke typed. This 1 could be a 2 or 3, in which case reference is made to the second or third keystrokes typed. Phonemes for which substitution is not possible according to FIG. 10 are redefined as themselves in this step. (i.e. the transformations TKY1(I), etc., are identity transformations in this case).

FIG. 14-2: Manual Entry of Keystroke Coding Messeges (a) KEY(1) is the entry of the first keystroke typed. The control number KKH = 0 means that no neighboring pronunciation alternatives have been searched.

(b) The machine identifies the set to which the keystroke just typed belongs. The symbols are defined as follows: E means belongs to, PH means the set of phonemes, CR means the correcting key, CL means the clear key, SP means the set of punctuation marks, and SF the set of special function keys. See FIG. 13. Because the one keystroke coding includes coding for punctuation marks and special function keys as well as the phonemes used for coding characters, it is treated separately from the multistroke coding sequences.

(c) The special functions include correcting, clearing, back space, skip a space, change a line, repeat a character, etc. See FIG. 13.

(d) A warning is given if the keystroke sequence typed to this point is logically impossible.

(e) If the keystroke typed is the spacing bar, the coding for the character has been completed, and the completed keystroke sequence goes to the searched part of the program. For the one keystroke major group this is 501.

The main features explained above for the first keystroke apply in turn to the second through the eighth keystrokes as shown on the flow chart.

The maximum number of keystrokes is eight even though a maximum of seven keystrokes including the spacing bar is all that is required. If an eighth keystroke is typed and it is not the spacing bar, a mistake has been made in typing, and a warning is given. If the eighth keystroke was the spacing bar, the seventh keystroke is replaced by the spacing bar stroke before the search is made.

500 indicates how the search is directed into one of the major groups 2 through 6 according to the calculated GO TO statement. (Recall that the search in group 1 is directed to 501 in e) above.

(f) ID(KEY (1)) identifies the subset sequence number according to the sequence number of the phoneme of the first keystroke.

(g) This defines the range to be searched in the major group selected.

(h) This defines the initial value for I. This number is the order number of the first member of the subset to be searched in the major group of interest.

(i) The computed GO TO statement directs the search to the major group identified by II.

FIG. 14-3: Search and Print

Searches made in the various major groups are similar to each other. They proceed by comparing, a keystroke at a time, the keystroke sequence which has been typed in the coding sequence stored in the memory for each character on the master list.

For efficiency in searching major groups 2 through 6, the search is made in the major group which corresponds to the number of keystrokes used in coding a character, only within the subset identified by the first keystroke of the sequence. Comparisons within this subset are made from the second keystroke on.

Explanatory remarks are made for major group 3 only. Entry is identified by 503. Here the third digit, 3, refers to major group 3, which is the 3 keystroke group.

(a) The subset being searched has been selected using the first keystroke. Comparison begins at the second keystroke. KEY(2) = A3 (2,I) compares the second stroke typed to the second keystroke of the coding which was stored in the memory for the Ith member of the 3rd major group. Note that the Ith member lies in the proper subset. For T, if the second keystroke matches the code, the third keystroke is compared. For F, if the second keystroke doesn't match, the coding of the second keystroke of the next character in the sequence stored is compared.

(b) The third keystroke is compared.

(c) If all keystrokes as typed match those stored, the character typed has been identified as the Ith member in the major group 3. The location indices IL3(1,I) and IL3(2,I), which identify the location of the character in the printer 36, are sent to the printer so that the character will be printed.

The input of the keystroke sequence for the next character starts. See FIG. 14-2.

(d) If the current comparison fails, the index number I is increased by one so that the coding of the next member of the major group can be selected for comparison.

(e) If the increased index belongs to the range being searched, a new comparison is made. If the increased index number exceeds the range being searched, the whole list has been examined, and no character has been found for the keystroke sequence just typed. In this case, either the keystroke sequence typed is for a character not included in the type font, or a mistake in typing exists. If the group number II is greater than or equal to 3, neighboring pronunciation is possible, and the search is directed to 550.

FIG. 14-4: The Search Using Neighboring Pronunciation (a) KKH = KKH + 1. This control number indicates the number of the trial search according to various neighboring sounds.

(b) Branches are made according to the KKH control number.

(c) KKH = 1. Is KEY(1) = TKY1(KEY(1)) ? This test is to see if the neighboring sound alternative for keystroke one is itself. For T, if it is, no change in this keystroke can be made, go back to 550. For F, a substitution is possible for keystroke 1, GO TO d).

(d) Keystroke 1 is replaced by its possible alternative. 500 is the beginning of the search of FIG. 14-3.

(e) KKH = 2. This asks if the number of keystrokes typed is less than 4. If it is true, no change can be made. 999 gives a warning. If there are more than 3 keystrokes, the possibility of substitution for the second keystroke is examined.

(f) This asks if there is a possible alternative for keystroke 2. If the neighboring sound alternative is itself, no change can be made, and the search goes back to 550. If an alternative is possible, the substitution is made.

(g) Keystroke 2 is replaced by its possible alternative, and the search is redirected to 500.

(h) KKH = 3. This switches keystroke 1 back to its original stroke, while leaving the second keystroke in its altered form. Another search is made.

(i) KKH = 4. First, a number of keystrokes is checked. If there are fewer than 5, a warning is given. If there are more than 4, the possibilities for changing the third keystroke while leaving the first two unchanged are examined.

(j) This asks (as in c) and f)) if a change is possible. If it is, go on.

(k) This changes keystroke 2 back to its origianl stroke, but changes keystroke 3 to its alternative, and goes back to search 500.

(m) KKH = 5. This asks if a possible alternative exists for the first keystroke. If not, a warning is given. If so, go on. In this case, the possibilities for changing the first and third keystrokes while leaving the second keystroke as originally typed are examined.

(n) The possible alternative for keystroke 1 is substituted, and the search is renewed.

A Fortran program based on Flow Charts in FIGS. 14-1 to 4 and using IBM punched cards as the input medium follows:

```
                                                    H A S P   S Y S T E M   L O G

$ 21.10.34 JOB 765 -- SPEC4865 -- BEGINNING  EXEC - PART 4 - CLASS A
$ 21.11.23 JOB 765 END EXECUTION.


//SPEC4865 JOB (XXXXXXXXX,XXXXXXXX,3,3),'KKHU',MSGLEV=L=1                    JOB 765
//     EXEC     WATFIV
XXGO      EXEC  PGM=WATFIV
XXSTEPLIB DD DSN=SYS1.XMONITOR,DISP=SHR                                     00001000
XXSYSPRINT DD  SYSOUT=A                                                     00002000
XXWATLIB DD     DSN=SYS1.WATFIV.FUNLIB,DISP=SHR                             00003000
XX       DD     DSN=SYS1.WATFIV.WATLIB,DISP=SHR                             00004000
XXWATERRS    DD DSNAME=SYS1.WATFIV.ERRTEXTS,DISP=SHR                         00005000
XXFT01F001 DD SPACE=(TRK,(1,1)),DCB=(RECFM=VS,BLKSIZE=256),UNIT=SYSDA       00006000
XXFT02F001 DD SPACE=(TRK,(1,1)),DCB=(RECFM=VS,BLKSIZE=256),UNIT=SYSDA       00007000
XXFT05F001  DD  DDNAME=SYSIN                                                00008000
XXFT06F001  DD SYSOUT=A                                                     00009000
XXFT07F001 DD  SYSOUT=B,DCB=BUFNO=1                                         00010000
//GO.SYSIN  DD  *                                                           00011000
//

KSJ0003I PARTITION SIZE -  256K, MAXIMUM CORE USED -  256K,  TIME =  21.11.23
KSJ0041 EXCP COUNT - DA 254       0,  UR 342       0,  DA 254       0,  DA 254       0,  DA 254       13,  DA 254
KSJ0041 EXCP COUNT - DA 252       0,  UR 300   1,674,  UR 343     532,  UR 390       0
KSJ0011 STEP   1 GO       EXECUTION TIME =          10.28 SEC    RETURN CODE =     1

KSJ0021 JOB SPEC4865 EXECUTION TIME =          10.28 SEC


HASP-II V3.1 JOB STATISTICS --  1,678 CARDS READ --      549 LINES PRINTED --      0 CARDS PUNCHED --  [illegible]

    $JOB            KKHU,TIME=3
1         IMPLICIT INTEGER *2(I-N)
    C        THE LENGTH OF THE LIST IS < 9999
    C        IS(I,J) DEFINES THE ORDER NUMBER OF THE LEADING ELEMENT OF THE
    C        I-TH SUBSET OF THE SET WITH J STROKES IN CODING
    C        THE NUMBER J DOES NOT INCLUDE THE SPACING BAR
    C        ID IDENTIFIES THE SEQUENCE NO. OF THE SYMBOL LIST
    C        IL1(3,J) DEFINES THE SEQUENCE NO. OF THE CHARACTER ON THE LIST
    C        THE 2ND SUBSCRIPT J IS THE ORDER NO. OF THE CHARACTER IN SET-1
    C        IL2,IL3,IL4,IL5,IL6 ARE FOR SET-2,SET-3,...,SET-6,RESPECTIVELY
    C        SET-1,SET-2,...,SET-6,REFER TO 1-STROKE,...,6-STROKES
    C        IP(J),THE I.D. NO. OF THE J-TH TYPING MESSAGE IN CODING
2         DIMENSION IS(38,6),ID(256),IL1(3,61),IL2(3,122),IL3(3,352),IL4(3,1
         1465),IL5(3,2273),IL6(3,1193),IP(8)
    C        A1, A2, ... , A6 ARE MATRICES FOR THE CODES OF THE SETS
    C        A1,A2, ...,A6,REFER TO SET-1,SET-2,...,SET-6,RESPECTIVELY
    C        TX,TY,ARE WORKING CHARACTERS
    C        SYMB IS A LIST OF SYMBOLS
    C        TYK1 DEFINES A POSSIBLE ALTERNATE KEYSTROKE FOR KEY(1)
    C        TYK2 DEFINES A POSSIBLE ALTERNATE KEYSTROKE FOR KEY(2)
    C        TYK3 DEFINES A POSSIBLE ALTERNATE KEYSTROKE FOR KEY(3)
    C        TKY1,TKY2, TKY3 ARE USED FOR SEARCHING POSSIBLE CHARACTERS
    C        KEY(J) STORES THE J-KEY MESSAGE
3         CHARACTER A1(61),A2(2,122),A3(3,352),A4(4,1465),A5(5,2273),A6(6,11
         193),TX,TY,SYMB(61),TKY1(256),TKY2(256),TKY3(256),KEY(8)
4       101 FORMAT (23X,2I3,1X,A1,44X,I4)
5       102 FORMAT (5(2A1,4X,2I3,I4))
6       103 FORMAT (5(3A1,3X,2I3,I4))
7       104 FORMAT (5(4A1,2X,2I3,I4))
8       105 FORMAT (5(5A1,1X,2I3,I4))
9       106 FORMAT (5(6A1,2I3,I4))
10      110 FORMAT (61A1)
11      115 FORMAT (5X,13I5)
12      120 FORMAT (6A1)
13      125 FORMAT (5X,'THE CHARACTER IS LOCATED AT ROW',I4,', AND COLUMN',I4,
         1',  IT IS THE ',I4,'TH ONE IN THE LIST')
14      130 FORMAT (3X,'THE CHARACTER IS NOT ON THE LIST,POSSIBLY DUE TO WRONG
         1 KEY STROKES')
    C        ENTER OF THE LIST OF SYMBOLS
15        READ (5,110) (SYMB(I),I=1,61)
16      126 FORMAT (6I5)
    C        INPUT FOR THE SIZES OF EACH SET AS INDICATED
17        READ (5,126) N1,N2,N3,N4,N5,N6
    C        N1,N2,...,N6 ARE NO. OF ELEMENTS OF SET OF 1-STROKE,2-STROKES,...
    C        MATRIX 'IS' MEMORIZES THE SEQUENCE NO. OF EACH SET
    C        READ IN THE  DATA FOR ONE STROKE SET
18        READ (5,101) (IL1(1,I),IL1(2,I),A1(I),IL1(3,I),I=1,N1)
    C        READ IN  DATA FOR OTHER SETS
19        DO 77 I=2,6
    C        I REFERS TO NO. OF STROKES
    C        IH WILL BE USED IN THE COMPUTED GO TO STATEMENT
20        IH=I-1
    C        READ IN NUMBER OF ELEMENTS OF EACH SET
21        READ,NN
    C        READ IN THE ORDER NUMBER OF LEADING ELEMENT IN EACH SUBSET
    C        THE 38-TH IS USED FOR FINDING THE SIZE OF THE 37-SUBSET
```

```
22          READ (5,115) (IS(J,I),J=1,38)
      C        READ IN LOCATION AND CODE
23          DO 11 J=1,37
      C        IS(J+1,I)=IS(J,I) IF IT IS AN EMPTY SET
24          IF (IS(J+1,I).EQ.IS(J,I)) GO TO 11
      C        II DEFINES THE NO. OF CARDS WITH 5 SETS OF DATA
25          II=(IS(J+1,I)-IS(J,I))/5
26          IF (II.EQ.0) GO TO 13
27          DO 12 IJ=1,II
28          K1=IS(J,I)+(IJ-1)*5
29          K2=K1+4
30          GO TO (62,63,64,65,66),IH
31       62 READ (5,102) (A2(1,L),A2(2,L),(IL2(K,L),K=1,3),L=K1,K2)
32          A2(1,K1)=SYMB(J)
33          GO TO 12
34       63 READ (5,103) ((A3(K,L),K=1,3),(IL3(K,L),K=1,3),L=K1,K2)
35          A3(1,K1)=SYMB(J)
36          GO TO 12
37       64 READ (5,104) ((A4(K,L),K=1,4),(IL4(K,L),K=1,3),L=K1,K2)
38          A4(1,K1)=SYMB(J)
39          GO TO 12
40       65 READ (5,105) ((A5(K,L),K=1,5),(IL5(K,L),K=1,3),L=K1,K2)
41          A5(1,K1)=SYMB(J)
42          GO TO 12
43       66 READ (5,106) ((A6(K,L),K=1,6),(IL6(K,L),K=1,3),L=K1,K2)
44          A6(1,K1)=SYMB(J)
45       12 CONTINUE
46          IF (II*5.EQ.(IS(J+1,I)-IS(J,I))) GO TO 11
      C        READ IN THE REMAINING DATA IN THE SUB SET
47       13 K1=IS(J,I)+II*5
48          K2=IS(J+1,I)-1
49          GO TO (162,163,164,165,166),IH
50      162 READ (5,102) (A2(1,L),A2(2,L),(IL2(K,L),K=1,3),L=K1,K2)
51          A2(1,K1)=SYMB(J)
52          GO TO 11
53      163 READ (5,103) ((A3(K,L),K=1,3),(IL3(K,L),K=1,3),L=K1,K2)
54          A3(1,K1)=SYMB(J)
55          GO TO 11
56      164 READ (5,104) ((A4(K,L),K=1,4),(IL4(K,L),K=1,3),L=K1,K2)
57          A4(1,K1)=SYMB(J)
58          GO TO 11
59      165 READ (5,105) ((A5(K,L),K=1,5),(IL5(K,L),K=1,3),L=K1,K2)
60          A5(1,K1)=SYMB(J)
61          GO TO 11
62      166 READ (5,106) ((A6(K,L),K=1,6),(IL6(K,L),K=1,3),L=K1,K2)
63          A6(1,K1)=SYMB(J)
64       11 CONTINUE
65       77 CONTINUE
      C        CODING FOR POSSIBLE NEIGHBORING PRONUNCIATION FOLLOWS
66          DO 20 I=1,60
67          TKY1(SYMB(I))=SYMB(I)
*EXTENSION* OTHER COMPILERS MAY NOT ALLOW SUBSCRIPTS OF TYPE COMPLEX,LOGICAL OR CHARACTER
68          TKY2(SYMB(I))=SYMB(I)
*EXTENSION* OTHER COMPILERS MAY NOT ALLOW SUBSCRIPTS OF TYPE COMPLEX,LOGICAL OR CHARACTER
69          TKY3(SYMB(I))=SYMB(I)
*EXTENSION* OTHER COMPILERS MAY NOT ALLOW SUBSCRIPTS OF TYPE COMPLEX,LOGICAL OR CHARACTER
70       20 ID(SYMB(I))=I
*EXTENSION* OTHER COMPILERS MAY NOT ALLOW SUBSCRIPTS OF TYPE COMPLEX,LOGICAL OR CHARACTER
71          TKY1('L')='-'
*EXTENSION* OTHER COMPILERS MAY NOT ALLOW SUBSCRIPTS OF TYPE COMPLEX,LOGICAL OR CHARACTER
72          TKY1('-')='L'
*EXTENSION* OTHER COMPILERS MAY NOT ALLOW SUBSCRIPTS OF TYPE COMPLEX,LOGICAL OR CHARACTER
73          TKY1('R')='/'
*EXTENSION* OTHER COMPILERS MAY NOT ALLOW SUBSCRIPTS OF TYPE COMPLEX,LOGICAL OR CHARACTER
74          TKY1('O')='E'
*EXTENSION* OTHER COMPILERS MAY NOT ALLOW SUBSCRIPTS OF TYPE COMPLEX,LOGICAL OR CHARACTER
75          TKY1('E')='O'
*EXTENSION* OTHER COMPILERS MAY NOT ALLOW SUBSCRIPTS OF TYPE COMPLEX,LOGICAL OR CHARACTER
76          TKY1('B')='Z'
*EXTENSION* OTHER COMPILERS MAY NOT ALLOW SUBSCRIPTS OF TYPE COMPLEX,LOGICAL OR CHARACTER
77          TKY1('Z')='B'
*EXTENSION* OTHER COMPILERS MAY NOT ALLOW SUBSCRIPTS OF TYPE COMPLEX,LOGICAL OR CHARACTER
78          TKY1('3')='Y'
*EXTENSION* OTHER COMPILERS MAY NOT ALLOW SUBSCRIPTS OF TYPE COMPLEX,LOGICAL OR CHARACTER
79          TKY1('Y')='3'
*EXTENSION* OTHER COMPILERS MAY NOT ALLOW SUBSCRIPTS OF TYPE COMPLEX,LOGICAL OR CHARACTER
80          TKY2('R')='V'
*EXTENSION* OTHER COMPILERS MAY NOT ALLOW SUBSCRIPTS OF TYPE COMPLEX,LOGICAL OR CHARACTER
81          TKY2('V')='R'
*EXTENSION* OTHER COMPILERS MAY NOT ALLOW SUBSCRIPTS OF TYPE COMPLEX,LOGICAL OR CHARACTER
82          TKY2('S')='7'
*EXTENSION* OTHER COMPILERS MAY NOT ALLOW SUBSCRIPTS OF TYPE COMPLEX,LOGICAL OR CHARACTER
83          TKY2('7')='S'
*EXTENSION* OTHER COMPILERS MAY NOT ALLOW SUBSCRIPTS OF TYPE COMPLEX,LOGICAL OR CHARACTER
84          TKY3('R')='V'
*EXTENSION* OTHER COMPILERS MAY NOT ALLOW SUBSCRIPTS OF TYPE COMPLEX,LOGICAL OR CHARACTER
85          TKY3('V')='R'
*EXTENSION* OTHER COMPILERS MAY NOT ALLOW SUBSCRIPTS OF TYPE COMPLEX,LOGICAL OR CHARACTER
86          TKY3('7')='C'
*EXTENSION* OTHER COMPILERS MAY NOT ALLOW SUBSCRIPTS OF TYPE COMPLEX,LOGICAL OR CHARACTER
87          TKY3('C')='D'
      C        KG IS THE CODE OF THE KEY FOR  THE END OF CODING OF A CHARACTER
*EXTENSION* OTHER COMPILERS MAY NOT ALLOW SUBSCRIPTS OF TYPE COMPLEX,LOGICAL OR CHARACTER
88          KG=ID(' ')
      C        INPUT OF TYPING MESSAGE
      C        MAX. LENGTH IS 6 STROKES EXCLUDING THE SPACING BAR
*EXTENSION* OTHER COMPILERS MAY NOT ALLOW SUBSCRIPTS OF TYPE COMPLEX,LOGICAL OR CHARACTER
89      200 READ (5,120) (KEY(I),I=1,6)
90          KKH=0
      C        KKH>0 FOR SEARCHING POSSIBLE CHARACTER DUE TO INACCURATE SOUND
      C        THE 7-TH STROKE CAN ALWAYS BE REPLACED BY ' '
91          KEY(7)=' '
      C        THE SOLBLE * IS USED AS THE SYMBLE OF END OF INPUT DATA
92          IF (KEY(1).EQ.'*') GO TO 900
*EXTENSION* A CHARACTER VARIABLE IS USED WITH A RELATIONAL OPERATOR
93          IP(1)=ID(KEY(1))
      C        ASKS IF KEY(1) IS A FUNCTION OR CODING KEY
      C        PUNCTUATION KEYS ARE CODING KEYS
*EXTENSION* OTHER COMPILERS MAY NOT ALLOW SUBSCRIPTS OF TYPE COMPLEX,LOGICAL OR CHARACTER
```

```
 94          IF (IP(I).GT.57) GO TO 650
        C       IP>57 FOR FUNCTION KEYS
        C       IP<38 FOR CODING KEYS
        C       IP <57&>37 FOR PUNCTUATION KEYS
        C       DO LOOP 10 IS USED TO FIND THE SET NO. OF THE CHARACTER
 95       25 DO 10 I=2,6
 96          IP(I)=IC(KEY(I))
*EXTENSION*  OTHER COMPILERS MAY NOT ALLOW SUBSCRIPTS OF TYPE COMPLEX,LOGICAL OR CHARACTER
 97          IF(IP(I).EQ.KS) GO TO 21
 98       10 CONTINUE
        C       II IDENTIFIES THE SET NO.
 99       21 II=I-1
        C       ICH DEFINES THE SUB SET NO. ACCORDING TO IP(1)
100          ICH=IP(1)
101          IST=IS(ICH,II)
102          IEND=IS(ICH+1,II)-1
        C       ICH DEFINES THE SUBSET NO. ACCORDING IP VALUE
        C       IST & IEND DEFINE THE RANGE TO BE SEARCHED
103          GO TO (31,32,33,34,35,36),II
        C       THE CHARACTER IS SOUGHT IN SETS ACCORDING TO II
104       31 DO 51 I=1,31
105          IF (KEY(1).EQ.A1(I)) GO TO 52
*EXTENSION*  A CHARACTER VARIABLE IS USED WITH A RELATIONAL OPERATOR
106       51 CONTINUE
107          GO TO 999
108       52 WRITE (6,125) IL1(1,I),IL1(2,I),IL1(3,I)
109          GO TO 200
110       32 DO 42 I=IST,IEND
111          IF (KEY(2).NE.A2(2,I)) GO TO 42
*EXTENSION*  A CHARACTER VARIABLE IS USED WITH A RELATIONAL OPERATOR
112          WRITE (6,125) IL2(1,I),IL2(2,I),IL2(3,I)
113          GO TO 200
114       42 CONTINUE
115          GO TO 999
116       33 DO 43 I=IST,IEND
117          IF (KEY(2).NE.A3(2,I)) GO TO 43
*EXTENSION*  A CHARACTER VARIABLE IS USED WITH A RELATIONAL OPERATOR
118          IF (KEY(3).NE.A3(3,I)) GO TO 43
*EXTENSION*  A CHARACTER VARIABLE IS USED WITH A RELATIONAL OPERATOR
119          WRITE (6,125) IL3(1,I),IL3(2,I),IL3(3,I)
120          GO TO 200
121       43 CONTINUE
        C       NO CHARACTER ON THE LIST IS CORRESPONDING TO THE KEYSTROKES
        C       THE SEARCH CONTINUES USING POSSIBLE NEIGHBORING PRONUNCIATIONS
122       55 KKH=KKH+1
        C       KKH=6 THE SEARCH ACCORDING TO NEIGHBORING PRONUNCIATIONS FAILED
123          GO TO(44,45,46,47,148,999),KKH
        C       KKH=1 ONLY THE 1ST KEY IS CHANGED
124       44 IF (KEY(1).EQ.TKY1(KEY(1))) GO TO 55
*EXTENSION*  A CHARACTER VARIABLE IS USED WITH A RELATIONAL OPERATOR
*EXTENSION*  OTHER COMPILERS MAY NOT ALLOW SUBSCRIPTS OF TYPE COMPLEX,LOGICAL OR CHARACTER
125          KEY(1)=TKY1(KEY(1))
*EXTENSION*  OTHER COMPILERS MAY NOT ALLOW SUBSCRIPTS OF TYPE COMPLEX,LOGICAL OR CHARACTER
126          GO TO 25
        C       KKH=2 THE 1ST AND 2ND KEYS ARE CHANGED
127       45 IF (II.EQ.3) GO TO 999
128          IF (KEY(2).EQ.TKY2(KEY(2))) GO TO 55
*EXTENSION*  A CHARACTER VARIABLE IS USED WITH A RELATIONAL OPERATOR
*EXTENSION*  OTHER COMPILERS MAY NOT ALLOW SUBSCRIPTS OF TYPE COMPLEX,LOGICAL OR CHARACTER
129          KEY(2)=TKY2(KEY(2))
*EXTENSION*  OTHER COMPILERS MAY NOT ALLOW SUBSCRIPTS OF TYPE COMPLEX,LOGICAL OR CHARACTER
130          GO TO 25
        C       KKH=3 THE 1ST KEY IS CHANGED BACK THE 2ND KEY RAMAINS CHANGED
131       46 KEY(1)=TKY1(KEY(1))
*EXTENSION*  OTHER COMPILERS MAY NOT ALLOW SUBSCRIPTS OF TYPE COMPLEX,LOGICAL OR CHARACTER
132          GO TO 25
        C       KKH=4 ONLY THE 3RD KEY IS CHANGED
133       47 IF (II.LT.5) GO TO 999
134          IF (KEY(3).EQ.TKY3(KEY(3))) GO TO 999
*EXTENSION*  A CHARACTER VARIABLE IS USED WITH A RELATIONAL OPERATOR
*EXTENSION*  OTHER COMPILERS MAY NOT ALLOW SUBSCRIPTS OF TYPE COMPLEX,LOGICAL OR CHARACTER
135          KEY(2)=TKY2(KEY(2))
*EXTENSION*  OTHER COMPILERS MAY NOT ALLOW SUBSCRIPTS OF TYPE COMPLEX,LOGICAL OR CHARACTER
136          KEY(3)=TKY3(KEY(3))
*EXTENSION*  OTHER COMPILERS MAY NOT ALLOW SUBSCRIPTS OF TYPE COMPLEX,LOGICAL OR CHARACTER
137          GO TO 25
        C       KKH=5 THE 1ST & 3RD KEYS ARE CHANGED
138      148 IF (KEY(1).EQ.TKY1(KEY(1))) GO TO 999
*EXTENSION*  A CHARACTER VARIABLE IS USED WITH A RELATIONAL OPERATOR
*EXTENSION*  OTHER COMPILERS MAY NOT ALLOW SUBSCRIPTS OF TYPE COMPLEX,LOGICAL OR CHARACTER
139          KEY(1)=TKY1(KEY(1))
*EXTENSION*  OTHER COMPILERS MAY NOT ALLOW SUBSCRIPTS OF TYPE COMPLEX,LOGICAL OR CHARACTER
140          GO TO 25
141       34 DO 48 I=IST,IEND
142          IF (KEY(2).NE.A4(2,I)) GO TO 48
*EXTENSION*  A CHARACTER VARIABLE IS USED WITH A RELATIONAL OPERATOR
143          IF (KEY(3).NE.A4(3,I)) GO TO 48
*EXTENSION*  A CHARACTER VARIABLE IS USED WITH A RELATIONAL OPERATOR
144          IF (KEY(4).NE.A4(4,I)) GO TO 48
*EXTENSION*  A CHARACTER VARIABLE IS USED WITH A RELATIONAL OPERATOR
145          WRITE (6,125) IL4(1,I),IL4(2,I),IL4(3,I)
146          GO TO 200
147       48 CONTINUE
148          GO TO 55
149       35 DO 49 I=IST,IEND
150          IF (KEY(2).NE.A5(2,I)) GO TO 49
*EXTENSION*  A CHARACTER VARIABLE IS USED WITH A RELATIONAL OPERATOR
151          IF (KEY(3).NE.A5(3,I)) GO TO 49
*EXTENSION*  A CHARACTER VARIABLE IS USED WITH A RELATIONAL OPERATOR
152          IF (KEY(4).NE.A5(4,I)) GO TO 49
*EXTENSION*  A CHARACTER VARIABLE IS USED WITH A RELATIONAL OPERATOR
153          IF (KEY(5).NE.A5(5,I)) GO TO 49
*EXTENSION*  A CHARACTER VARIABLE IS USED WITH A RELATIONAL OPERATOR
154          WRITE (6,125) IL5(1,I),IL5(2,I),IL5(3,I)
155          GO TO 200
156       49 CONTINUE
157          GO TO 55
158       36 DO 50 I=IST,IEND
159          IF (KEY(2).NE.A6(2,I)) GO TO 50
```

```
*EXTENSION*  A CHARACTER VARIABLE IS USED WITH A RELATIONAL OPERATOR
  160          IF (KEY(3).NE.A6(3,I)) GO TO 50
*EXTENSION*  A CHARACTER VARIABLE IS USED WITH A RELATIONAL OPERATOR
  161          IF (KEY(4).NE.A6(4,I)) GO TO 50
*EXTENSION*  A CHARACTER VARIABLE IS USED WITH A RELATIONAL OPERATOR
  162          IF (KEY(5).NE.A6(5,I)) GO TO 50
*EXTENSION*  A CHARACTER VARIABLE IS USED WITH A RELATIONAL OPERATOR
  163          IF (KEY(6).NE.A6(6,I)) GO TO 50
*EXTENSION*  A CHARACTER VARIABLE IS USED WITH A RELATIONAL OPERATOR
  164          WRITE (6,125) IL6(1,I),IL6(2,I),IL6(3,I)
  165          GO TO 200
  166       50 CONTINUE
  167          GO TO 55
  168      999 WRITE (6,130)
  169          GO TO 200
  170      650 K3=IP(1)-57
  171          IF (K3.GT.5) GO TO 655
  172          GO TO (651,652,653,654),K3
  173      651 PRINT,'   BACK UP A POSITION AND ERASE THE LAST CHARACTER'
  174          GO TO 200
  175      652 PRINT,'   SKIP ONE POSITION'
  176          GO TO 200
  177      653 PRINT,'   SKIP TO THE THIRD POSITION OF NEXT LINE'
  178          GO TO 200
  179      654 PRINT,'   REPEAT THE LAST CHARACTER'
  180          GO TO 200
  181      655 PRINT,'   THIS FUNCTION KEY IS NOT USED IN THIS PROGRAM'
  182          GO TO 200
  183      900 STOP
  184          END
        $ENTRY
THE CHARACTER IS LOCATED AT ROW   1, AND COLUMN  -2,  IT IS THE   16TH ONE IN THE LIST
THE CHARACTER IS LOCATED AT ROW   6, AND COLUMN   0,  IT IS THE  117TH ONE IN THE LIST
THE CHARACTER IS LOCATED AT ROW   4, AND COLUMN  -4,  IT IS THE  140TH ONE IN THE LIST
THE CHARACTER IS LOCATED AT ROW   1, AND COLUMN   2,  IT IS THE   13TH ONE IN THE LIST
THE CHARACTER IS LOCATED AT ROW   2, AND COLUMN  -5,  IT IS THE   92TH ONE IN THE LIST
THE CHARACTER IS LOCATED AT ROW   3, AND COLUMN   1,  IT IS THE   29TH ONE IN THE LIST
THE CHARACTER IS LOCATED AT ROW  -5, AND COLUMN  -1,  IT IS THE   86TH ONE IN THE LIST
THE CHARACTER IS LOCATED AT ROW  -2, AND COLUMN   2,  IT IS THE   19TH ONE IN THE LIST
THE CHARACTER IS LOCATED AT ROW   0, AND COLUMN   2,  IT IS THE    9TH ONE IN THE LIST
THE CHARACTER IS LOCATED AT ROW   2, AND COLUMN  -1,  IT IS THE   15TH ONE IN THE LIST
THE CHARACTER IS LOCATED AT ROW  -3, AND COLUMN  -2,  IT IS THE   41TH ONE IN THE LIST
THE CHARACTER IS LOCATED AT ROW   1, AND COLUMN  -3,  IT IS THE   31TH ONE IN THE LIST
THE CHARACTER IS LOCATED AT ROW   7, AND COLUMN  -2,  IT IS THE  169TH ONE IN THE LIST
THE CHARACTER IS LOCATED AT ROW  -3, AND COLUMN   1,  IT IS THE   26TH ONE IN THE LIST
THE CHARACTER IS LOCATED AT ROW  -4, AND COLUMN   3,  IT IS THE   65TH ONE IN THE LIST
THE CHARACTER IS LOCATED AT ROW  -8, AND COLUMN  -2,  IT IS THE  228TH ONE IN THE LIST
THE CHARACTER IS LOCATED AT ROW  -2, AND COLUMN   1,  IT IS THE   11TH ONE IN THE LIST
THE CHARACTER IS LOCATED AT ROW  -7, AND COLUMN   2,  IT IS THE  165TH ONE IN THE LIST
THE CHARACTER IS LOCATED AT ROW  -1, AND COLUMN -11,  IT IS THE  433TH ONE IN THE LIST
THE CHARACTER IS LOCATED AT ROW   2, AND COLUMN   1,  IT IS THE   14TH ONE IN THE LIST
THE CHARACTER IS LOCATED AT ROW -14, AND COLUMN   9,  IT IS THE  716TH ONE IN THE LIST
THE CHARACTER IS LOCATED AT ROW   4, AND COLUMN   1,  IT IS THE   52TH ONE IN THE LIST
THE CHARACTER IS LOCATED AT ROW  -2, AND COLUMN   0,  IT IS THE    8TH ONE IN THE LIST
THE CHARACTER IS LOCATED AT ROW   2, AND COLUMN   3,  IT IS THE   36TH ONE IN THE LIST
THE CHARACTER IS LOCATED AT ROW  -8, AND COLUMN   7,  IT IS THE  261TH ONE IN THE LIST
THE CHARACTER IS LOCATED AT ROW  -1, AND COLUMN  -1,  IT IS THE    7TH ONE IN THE LIST
THE CHARACTER IS LOCATED AT ROW  -6, AND COLUMN   6,  IT IS THE  152TH ONE IN THE LIST
THE CHARACTER IS LOCATED AT ROW   1, AND COLUMN  -1,  IT IS THE    6TH ONE IN THE LIST
THE CHARACTER IS LOCATED AT ROW   9, AND COLUMN   1,  IT IS THE  230TH ONE IN THE LIST
THE CHARACTER IS LOCATED AT ROW  -1, AND COLUMN  -4,  IT IS THE   55TH ONE IN THE LIST
THE CHARACTER IS LOCATED AT ROW   9, AND COLUMN -34,  IT IS THE 4588TH ONE IN THE LIST
THE CHARACTER IS LOCATED AT ROW   1, AND COLUMN  -4,  IT IS THE   54TH ONE IN THE LIST
THE CHARACTER IS LOCATED AT ROW -10, AND COLUMN   8,  IT IS THE  403TH ONE IN THE LIST
THE CHARACTER IS LOCATED AT ROW   0, AND COLUMN   3,  IT IS THE   24TH ONE IN THE LIST
THE CHARACTER IS LOCATED AT ROW   9, AND COLUMN   3,  IT IS THE  276TH ONE IN THE LIST
THE CHARACTER IS LOCATED AT ROW   3, AND COLUMN  -5,  IT IS THE  100TH ONE IN THE LIST
THE CHARACTER IS LOCATED AT ROW  -2, AND COLUMN  -1,  IT IS THE   18TH ONE IN THE LIST
THE CHARACTER IS LOCATED AT ROW  -3, AND COLUMN   6,  IT IS THE  131TH ONE IN THE LIST
THE CHARACTER IS LOCATED AT ROW   4, AND COLUMN   0,  IT IS THE   49TH ONE IN THE LIST
THE CHARACTER IS LOCATED AT ROW  -1, AND COLUMN   2,  IT IS THE   12TH ONE IN THE LIST
THE CHARACTER IS LOCATED AT ROW  27, AND COLUMN  11,  IT IS THE 2944TH ONE IN THE LIST
THE CHARACTER IS LOCATED AT ROW  -2, AND COLUMN  -3,  IT IS THE   40TH ONE IN THE LIST
THE CHARACTER IS LOCATED AT ROW  -3, AND COLUMN  -4,  IT IS THE   71TH ONE IN THE LIST
THE CHARACTER IS LOCATED AT ROW  -9, AND COLUMN   2,  IT IS THE  295TH ONE IN THE LIST
THE CHARACTER IS LOCATED AT ROW   3, AND COLUMN  -1,  IT IS THE   30TH ONE IN THE LIST
THE CHARACTER IS LOCATED AT ROW  -9, AND COLUMN  -1,  IT IS THE  284TH ONE IN THE LIST
THE CHARACTER IS LOCATED AT ROW   1, AND COLUMN   4,  IT IS THE   51TH ONE IN THE LIST
THE CHARACTER IS LOCATED AT ROW   3, AND COLUMN   7,  IT IS THE  175TH ONE IN THE LIST
THE CHARACTER IS LOCATED AT ROW   4, AND COLUMN   4,  IT IS THE   74TH ONE IN THE LIST
THE CHARACTER IS LOCATED AT ROW   9, AND COLUMN  24,  IT IS THE 2334TH ONE IN THE LIST
THE CHARACTER IS LOCATED AT ROW  -7, AND COLUMN   7,  IT IS THE  205TH ONE IN THE LIST
THE CHARACTER IS LOCATED AT ROW  -2, AND COLUMN   1,  IT IS THE   11TH ONE IN THE LIST
THE CHARACTER IS LOCATED AT ROW -32, AND COLUMN  22,  IT IS THE 3965TH ONE IN THE LIST
THE CHARACTER IS LOCATED AT ROW   3, AND COLUMN   0,  IT IS THE   25TH ONE IN THE LIST
THE CHARACTER IS LOCATED AT ROW -10, AND COLUMN  29,  IT IS THE 4288TH ONE IN THE LIST
THE CHARACTER IS LOCATED AT ROW   4, AND COLUMN   1,  IT IS THE   50TH ONE IN THE LIST
THE CHARACTER IS LOCATED AT ROW   5, AND COLUMN  30,  IT IS THE 4116TH ONE IN THE LIST
THE CHARACTER IS LOCATED AT ROW  -2, AND COLUMN   0,  IT IS THE    8TH ONE IN THE LIST
THE CHARACTER IS LOCATED AT ROW   0, AND COLUMN  29,  IT IS THE 3435TH ONE IN THE LIST
THE CHARACTER IS LOCATED AT ROW   4, AND COLUMN  -3,  IT IS THE   69TH ONE IN THE LIST
THE CHARACTER IS LOCATED AT ROW   0, AND COLUMN   0,  IT IS THE 3116TH ONE IN THE LIST
THE CHARACTER IS LOCATED AT ROW  -3, AND COLUMN  -5,  IT IS THE  101TH ONE IN THE LIST
THE CHARACTER IS LOCATED AT ROW  19, AND COLUMN  27,  IT IS THE 2968TH ONE IN THE LIST
THE CHARACTER IS LOCATED AT ROW  -1, AND COLUMN   3,  IT IS THE   27TH ONE IN THE LIST
THE CHARACTER IS LOCATED AT ROW   2, AND COLUMN  10,  IT IS THE  357TH ONE IN THE LIST
THE CHARACTER IS LOCATED AT ROW  -2, AND COLUMN -34,  IT IS THE 4977TH ONE IN THE LIST
THE CHARACTER IS LOCATED AT ROW  -2, AND COLUMN   4,  IT IS THE   58TH ONE IN THE LIST
THE CHARACTER IS LOCATED AT ROW  30, AND COLUMN  15,  IT IS THE 3430TH ONE IN THE LIST
THE CHARACTER IS LOCATED AT ROW   0, AND COLUMN   6,  IT IS THE  116TH ONE IN THE LIST
THE CHARACTER IS LOCATED AT ROW -16, AND COLUMN  25,  IT IS THE 4687TH ONE IN THE LIST
THE CHARACTER IS LOCATED AT ROW  12, AND COLUMN  -9,  IT IS THE  583TH ONE IN THE LIST
THE CHARACTER IS LOCATED AT ROW  -3, AND COLUMN   8,  IT IS THE  230TH ONE IN THE LIST
THE CHARACTER IS LOCATED AT ROW  10, AND COLUMN -11,  IT IS THE  504TH ONE IN THE LIST
THE CHARACTER IS LOCATED AT ROW -20, AND COLUMN -27,  IT IS THE 2851TH ONE IN THE LIST
THE CHARACTER IS LOCATED AT ROW -20, AND COLUMN  20,  IT IS THE 1498TH ONE IN THE LIST
THE CHARACTER IS LOCATED AT ROW  21, AND COLUMN  -6,  IT IS THE 1728TH ONE IN THE LIST
THE CHARACTER IS LOCATED AT ROW -27, AND COLUMN  22,  IT IS THE 4350TH ONE IN THE LIST
THE CHARACTER IS LOCATED AT ROW  -3, AND COLUMN -34,  IT IS THE 4576TH ONE IN THE LIST
```

THE CHARACTER IS LOCATED AT ROW -26, AND COLUMN -7, IT IS THE 2614TH ONE IN THE LIST
THE CHARACTER IS LOCATED AT ROW 4, AND COLUMN 15, IT IS THE 872TH ONE IN THE LIST
THE CHARACTER IS LOCATED AT ROW 7, AND COLUMN -21, IT IS THE 1412TH ONE IN THE LIST
THE CHARACTER IS LOCATED AT ROW -2, AND COLUMN -2, IT IS THE 72TH ONE IN THE LIST
THE CHARACTER IS LOCATED AT ROW 0, AND COLUMN 0, IT IS THE 3117TH ONE IN THE LIST
THE CHARACTER IS LOCATED AT ROW 1, AND COLUMN -2, IT IS THE 16TH ONE IN THE LIST
THE CHARACTER IS LOCATED AT ROW 25, AND COLUMN 34, IT IS THE 4672TH ONE IN THE LIST
THE CHARACTER IS LOCATED AT ROW 32, AND COLUMN -19, IT IS THE 6TH ONE IN THE LIST
THE CHARACTER IS LOCATED AT ROW 33, AND COLUMN 14, IT IS THE 4333TH ONE IN THE LIST
THE CHARACTER IS LOCATED AT ROW 1, AND COLUMN 2, IT IS THE 13TH ONE IN THE LIST
THE CHARACTER IS LOCATED AT ROW -30, AND COLUMN 13, IT IS THE 4526TH ONE IN THE LIST
THE CHARACTER IS LOCATED AT ROW -2, AND COLUMN -1, IT IS THE 18TH ONE IN THE LIST
THE CHARACTER IS LOCATED AT ROW 0, AND COLUMN 0, IT IS THE 3417TH ONE IN THE LIST
THE CHARACTER IS LOCATED AT ROW 3, AND COLUMN 1, IT IS THE 29TH ONE IN THE LIST
THE CHARACTER IS LOCATED AT ROW -33, AND COLUMN -17, IT IS THE 4262TH ONE IN THE LIST
THE CHARACTER IS LOCATED AT ROW -7, AND COLUMN 2, IT IS THE 19TH ONE IN THE LIST
THE CHARACTER IS LOCATED AT ROW -34, AND COLUMN -21, IT IS THE 4532TH ONE IN THE LIST
THE CHARACTER IS LOCATED AT ROW 8, AND COLUMN 33, IT IS THE 0TH ONE IN THE LIST
THE CHARACTER IS LOCATED AT ROW -25, AND COLUMN 35, IT IS THE 4760TH ONE IN THE LIST
THE CHARACTER IS LOCATED AT ROW 2, AND COLUMN -1, IT IS THE 15TH ONE IN THE LIST
THE CHARACTER IS LOCATED AT ROW 34, AND COLUMN 20, IT IS THE 4657TH ONE IN THE LIST
THE CHARACTER IS LOCATED AT ROW -3, AND COLUMN -2, IT IS THE 41TH ONE IN THE LIST
THE CHARACTER IS LOCATED AT ROW -29, AND COLUMN 3, IT IS THE 3258TH ONE IN THE LIST
THE CHARACTER IS LOCATED AT ROW 1, AND COLUMN -3, IT IS THE 31TH ONE IN THE LIST
THE CHARACTER IS LOCATED AT ROW -34, AND COLUMN -12, IT IS THE 4523TH ONE IN THE LIST
THE CHARACTER IS LOCATED AT ROW -3, AND COLUMN 1, IT IS THE 26TH ONE IN THE LIST
THE CHARACTER IS LOCATED AT ROW -19, AND COLUMN -26, IT IS THE 4714TH ONE IN THE LIST
THE CHARACTER IS LOCATED AT ROW -1, AND COLUMN 1, IT IS THE 4TH ONE IN THE LIST
THE CHARACTER IS LOCATED AT ROW 34, AND COLUMN 25, IT IS THE 4570TH ONE IN THE LIST
THE CHARACTER IS LOCATED AT ROW 10, AND COLUMN 9, IT IS THE 414TH ONE IN THE LIST
THE CHARACTER IS LOCATED AT ROW -35, AND COLUMN -20, IT IS THE 4805TH ONE IN THE LIST
THE CHARACTER IS LOCATED AT ROW -1, AND COLUMN -3, IT IS THE 32TH ONE IN THE LIST
THE CHARACTER IS LOCATED AT ROW -21, AND COLUMN -35, IT IS THE 4834TH ONE IN THE LIST
THE CHARACTER IS LOCATED AT ROW 2, AND COLUMN 1, IT IS THE 14TH ONE IN THE LIST
THE CHARACTER IS LOCATED AT ROW -18, AND COLUMN -33, IT IS THE 4293TH ONE IN THE LIST
THE CHARACTER IS LOCATED AT ROW 0, AND COLUMN 5, IT IS THE 78TH ONE IN THE LIST
THE CHARACTER IS LOCATED AT ROW -17, AND COLUMN -34, IT IS THE 4562TH ONE IN THE LIST
THE CHARACTER IS LOCATED AT ROW 2, AND COLUMN 5, IT IS THE 70TH ONE IN THE LIST
THE CHARACTER IS LOCATED AT ROW -27, AND COLUMN -30, IT IS THE 3528TH ONE IN THE LIST
THE CHARACTER IS LOCATED AT ROW -2, AND COLUMN 3, IT IS THE 36TH ONE IN THE LIST
THE CHARACTER IS LOCATED AT ROW 1, AND COLUMN -33, IT IS THE 4312TH ONE IN THE LIST
THE CHARACTER IS LOCATED AT ROW -11, AND COLUMN 5, IT IS THE 459TH ONE IN THE LIST
THE CHARACTER IS LOCATED AT ROW -14, AND COLUMN 1, IT IS THE 724TH ONE IN THE LIST
THE CHARACTER IS LOCATED AT ROW -8, AND COLUMN 25, IT IS THE 2977TH ONE IN THE LIST
THE CHARACTER IS LOCATED AT ROW -1, AND COLUMN -1, IT IS THE 7TH ONE IN THE LIST
THE CHARACTER IS LOCATED AT ROW 3, AND COLUMN -34, IT IS THE 4592TH ONE IN THE LIST
THE CHARACTER IS LOCATED AT ROW 3, AND COLUMN 5, IT IS THE 97TH ONE IN THE LIST
THE CHARACTER IS LOCATED AT ROW 28, AND COLUMN 33, IT IS THE 4406TH ONE IN THE LIST
THE CHARACTER IS LOCATED AT ROW -7, AND COLUMN -6, IT IS THE 0TH ONE IN THE LIST
THE CHARACTER IS LOCATED AT ROW -35, AND COLUMN 24, IT IS THE 4749TH ONE IN THE LIST
THE CHARACTER IS LOCATED AT ROW 31, AND COLUMN -13, IT IS THE 3949TH ONE IN THE LIST
THE CHARACTER IS LOCATED AT ROW -14, AND COLUMN 12, IT IS THE 713TH ONE IN THE LIST
THE CHARACTER IS LOCATED AT ROW 23, AND COLUMN 14, IT IS THE 4371TH ONE IN THE LIST
THE CHARACTER IS LOCATED AT ROW 18, AND COLUMN 1, IT IS THE 1256TH ONE IN THE LIST
THE CHARACTER IS LOCATED AT ROW -3, AND COLUMN 30, IT IS THE 3772TH ONE IN THE LIST
THE CHARACTER IS LOCATED AT ROW 0, AND COLUMN 0, IT IS THE 3217TH ONE IN THE LIST
THE CHARACTER IS LOCATED AT ROW -2, AND COLUMN -20, IT IS THE 1637TH ONE IN THE LIST
THE CHARACTER IS LOCATED AT ROW 7, AND COLUMN 29, IT IS THE 3442TH ONE IN THE LIST
THE CHARACTER IS LOCATED AT ROW 16, AND COLUMN -22, IT IS THE 1936TH ONE IN THE LIST
THE CHARACTER IS LOCATED AT ROW 19, AND COLUMN 24, IT IS THE 2343TH ONE IN THE LIST
THE CHARACTER IS LOCATED AT ROW -18, AND COLUMN 22, IT IS THE 1919TH ONE IN THE LIST
THE CHARACTER IS LOCATED AT ROW 6, AND COLUMN -9, IT IS THE 258TH ONE IN THE LIST
THE CHARACTER IS LOCATED AT ROW -22, AND COLUMN -21, IT IS THE 3553TH ONE IN THE LIST
THE CHARACTER IS LOCATED AT ROW -27, AND COLUMN -20, IT IS THE 3281TH ONE IN THE LIST
THE CHARACTER IS LOCATED AT ROW -1, AND COLUMN 0, IT IS THE 1TH ONE IN THE LIST
THE CHARACTER IS LOCATED AT ROW -33, AND COLUMN 35, IT IS THE 4752TH ONE IN THE LIST
THE CHARACTER IS LOCATED AT ROW 3, AND COLUMN 3, IT IS THE 43TH ONE IN THE LIST
THE CHARACTER IS LOCATED AT ROW 7, AND COLUMN 34, IT IS THE 4722TH ONE IN THE LIST
THE CHARACTER IS LOCATED AT ROW 3, AND COLUMN -5, IT IS THE 100TH ONE IN THE LIST
THE CHARACTER IS LOCATED AT ROW -6, AND COLUMN 24, IT IS THE 4709TH ONE IN THE LIST
THE CHARACTER IS LOCATED AT ROW -3, AND COLUMN 3, IT IS THE 42TH ONE IN THE LIST
THE CHARACTER IS LOCATED AT ROW 34, AND COLUMN 34, IT IS THE 4681TH ONE IN THE LIST
THE CHARACTER IS LOCATED AT ROW 3, AND COLUMN 1, IT IS THE 29TH ONE IN THE LIST
THE CHARACTER IS LOCATED AT ROW -35, AND COLUMN 5, IT IS THE 4780TH ONE IN THE LIST
THE CHARACTER IS LOCATED AT ROW 4, AND COLUMN 0, IT IS THE 48TH ONE IN THE LIST
THE CHARACTER IS LOCATED AT ROW -3, AND COLUMN 34, IT IS THE 4712TH ONE IN THE LIST
THE CHARACTER IS LOCATED AT ROW -29, AND COLUMN 35, IT IS THE 0TH ONE IN THE LIST
THE CHARACTER IS LOCATED AT ROW -25, AND COLUMN 26, IT IS THE 4704TH ONE IN THE LIST
THE CHARACTER IS LOCATED AT ROW -3, AND COLUMN -4, IT IS THE 71TH ONE IN THE LIST
THE CHARACTER IS LOCATED AT ROW -35, AND COLUMN -26, IT IS THE 4811TH ONE IN THE LIST
THE CHARACTER IS LOCATED AT ROW 3, AND COLUMN -1, IT IS THE 30TH ONE IN THE LIST
THE CHARACTER IS LOCATED AT ROW -15, AND COLUMN 34, IT IS THE 4730TH ONE IN THE LIST
THE CHARACTER IS LOCATED AT ROW 1, AND COLUMN 4, IT IS THE 51TH ONE IN THE LIST
THE CHARACTER IS LOCATED AT ROW 26, AND COLUMN -11, IT IS THE 4535TH ONE IN THE LIST
THE CHARACTER IS LOCATED AT ROW 34, AND COLUMN -14, IT IS THE 4631TH ONE IN THE LIST
THE CHARACTER IS LOCATED AT ROW -4, AND COLUMN 3, IT IS THE 65TH ONE IN THE LIST
THE CHARACTER IS LOCATED AT ROW -35, AND COLUMN -8, IT IS THE 4703TH ONE IN THE LIST
THE CHARACTER IS LOCATED AT ROW -7, AND COLUMN 7, IT IS THE 205TH ONE IN THE LIST
THE CHARACTER IS LOCATED AT ROW -35, AND COLUMN -22, IT IS THE 4807TH ONE IN THE LIST
THE CHARACTER IS LOCATED AT ROW 3, AND COLUMN -2, IT IS THE 38TH ONE IN THE LIST
THE CHARACTER IS LOCATED AT ROW -6, AND COLUMN -33, IT IS THE 4305TH ONE IN THE LIST
THE CHARACTER IS LOCATED AT ROW 2, AND COLUMN -3, IT IS THE 39TH ONE IN THE LIST
THE CHARACTER IS LOCATED AT ROW -22, AND COLUMN -34, IT IS THE 4557TH ONE IN THE LIST
THE CHARACTER IS LOCATED AT ROW 17, AND COLUMN -32, IT IS THE 0TH ONE IN THE LIST
THE CHARACTER IS LOCATED AT ROW -3, AND COLUMN -35, IT IS THE 4852TH ONE IN THE LIST
THE CHARACTER IS LOCATED AT ROW -5, AND COLUMN -3, IT IS THE 102TH ONE IN THE LIST
THE CHARACTER IS LOCATED AT ROW 29, AND COLUMN -13, IT IS THE 4308TH ONE IN THE LIST
THE CHARACTER IS LOCATED AT ROW 4, AND COLUMN -3, IT IS THE 69TH ONE IN THE LIST
THE CHARACTER IS LOCATED AT ROW -6, AND COLUMN -34, IT IS THE 4573TH ONE IN THE LIST
THE CHARACTER IS LOCATED AT ROW -9, AND COLUMN 14, IT IS THE 744TH ONE IN THE LIST
THE CHARACTER IS LOCATED AT ROW 27, AND COLUMN -20, IT IS THE 4507TH ONE IN THE LIST
THE CHARACTER IS LOCATED AT ROW 3, AND COLUMN 4, IT IS THE 67TH ONE IN THE LIST
THE CHARACTER IS LOCATED AT ROW -35, AND COLUMN 28, IT IS THE 4745TH ONE IN THE LIST
THE CHARACTER IS LOCATED AT ROW 4, AND COLUMN 9, IT IS THE 303TH ONE IN THE LIST
THE CHARACTER IS LOCATED AT ROW -35, AND COLUMN 26, IT IS THE 4747TH ONE IN THE LIST
THE CHARACTER IS LOCATED AT ROW -3, AND COLUMN -10, IT IS THE 369TH ONE IN THE LIST
THE CHARACTER IS LOCATED AT ROW -25, AND COLUMN 23, IT IS THE 3986TH ONE IN THE LIST
THE CHARACTER IS LOCATED AT ROW 25, AND COLUMN -26, IT IS THE 2684TH ONE IN THE LIST
THE CHARACTER IS LOCATED AT ROW 31, AND COLUMN -19, IT IS THE 3950TH ONE IN THE LIST
THE CHARACTER IS LOCATED AT ROW 24, AND COLUMN 23, IT IS THE 2332TH ONE IN THE LIST
THE CHARACTER IS LOCATED AT ROW 3, AND COLUMN 25, IT IS THE 4316TH ONE IN THE LIST

```
THE CHARACTER IS LOCATED AT ROW  -2, AND COLUMN  20,  IT IS THE 1598TH ONE IN THE LIST
THE CHARACTER IS LOCATED AT ROW   5, AND COLUMN  -3,  IT IS THE   99TH ONE IN THE LIST
THE CHARACTER IS LOCATED AT ROW -30, AND COLUMN  35,  IT IS THE 4755TH ONE IN THE LIST
THE CHARACTER IS LOCATED AT ROW   0, AND COLUMN   3,  IT IS THE   24TH ONE IN THE LIST
THE CHARACTER IS LOCATED AT ROW   8, AND COLUMN   8,  IT IS THE  270TH ONE IN THE LIST
THE CHARACTER IS LOCATED AT ROW  32, AND COLUMN  34,  IT IS THE 4679TH ONE IN THE LIST
THE CHARACTER IS LOCATED AT ROW  -4, AND COLUMN   9,  IT IS THE  302TH ONE IN THE LIST
THE CHARACTER IS LOCATED AT ROW -11, AND COLUMN -35,  IT IS THE 4944TH ONE IN THE LIST
THE CHARACTER IS LOCATED AT ROW  -5, AND COLUMN   1,  IT IS THE   80TH ONE IN THE LIST
THE CHARACTER IS LOCATED AT ROW -12, AND COLUMN  54,  IT IS THE 4733TH ONE IN THE LIST
THE CHARACTER IS LOCATED AT ROW   6, AND COLUMN -31,  IT IS THE    6TH ONE IN THE LIST
THE CHARACTER IS LOCATED AT ROW  29, AND COLUMN  34,  IT IS THE 4676TH ONE IN THE LIST
THE CHARACTER IS LOCATED AT ROW  -1, AND COLUMN   2,  IT IS THE   12TH ONE IN THE LIST
THE CHARACTER IS LOCATED AT ROW  22, AND COLUMN  32,  IT IS THE 4171TH ONE IN THE LIST
THE CHARACTER IS LOCATED AT ROW  -3, AND COLUMN  -7,  IT IS THE  179TH ONE IN THE LIST
THE CHARACTER IS LOCATED AT ROW  15, AND COLUMN -34,  IT IS THE 4596TH ONE IN THE LIST
THE CHARACTER IS LOCATED AT ROW   7, AND COLUMN   9,  IT IS THE  327TH ONE IN THE LIST
THE CHARACTER IS LOCATED AT ROW -35, AND COLUMN  -3,  IT IS THE 4782TH ONE IN THE LIST
THE CHARACTER IS LOCATED AT ROW  -5, AND COLUMN   3,  IT IS THE   95TH ONE IN THE LIST
THE CHARACTER IS LOCATED AT ROW  -3, AND COLUMN  33,  IT IS THE 4440TH ONE IN THE LIST
THE CHARACTER IS LOCATED AT ROW   4, AND COLUMN  -4,  IT IS THE   75TH ONE IN THE LIST
THE CHARACTER IS LOCATED AT ROW   4, AND COLUMN -13,  IT IS THE 4503TH ONE IN THE LIST
THE CHARACTER IS LOCATED AT ROW  10, AND COLUMN -10,  IT IS THE  421TH ONE IN THE LIST
THE CHARACTER IS LOCATED AT ROW  33, AND COLUMN -17,  IT IS THE 4364TH ONE IN THE LIST
THE CHARACTER IS LOCATED AT ROW -10, AND COLUMN   5,  IT IS THE  379TH ONE IN THE LIST
THE CHARACTER IS LOCATED AT ROW  22, AND COLUMN   4,  IT IS THE 3455TH ONE IN THE LIST
THE CHARACTER IS LOCATED AT ROW -10, AND COLUMN   9,  IT IS THE    6TH ONE IN THE LIST
THE CHARACTER IS LOCATED AT ROW  31, AND COLUMN  12,  IT IS THE 3879TH ONE IN THE LIST
THE CHARACTER IS LOCATED AT ROW  -3, AND COLUMN  -5,  IT IS THE  101TH ONE IN THE LIST
THE CHARACTER IS LOCATED AT ROW  30, AND COLUMN  -7,  IT IS THE 3622TH ONE IN THE LIST
THE CHARACTER IS LOCATED AT ROW  14, AND COLUMN  14,  IT IS THE  767TH ONE IN THE LIST
THE CHARACTER IS LOCATED AT ROW  28, AND COLUMN  12,  IT IS THE 3165TH ONE IN THE LIST
THE CHARACTER IS LOCATED AT ROW  -3, AND COLUMN -19,  IT IS THE 1476TH ONE IN THE LIST
THE CHARACTER IS LOCATED AT ROW -21, AND COLUMN -25,  IT IS THE 2434TH ONE IN THE LIST

CORE USAGE      OBJECT CODE=    9640 BYTES,ARRAY AREA=    60241 BYTES,TOTAL AREA AVAILABLE=  174096  BYTES

DIAGNOSTICS       NUMBER OF ERRORS=       0, NUMBER OF WARNINGS=       0, NUMBER OF EXTENSIONS=      55

COMPILE TIME=    0.90 SEC,EXECUTION TIME=    9.22 SEC,  WATFIV - JUL 1973 V114     21.11.15     TUESDAY     22 APR 75
```

The input could be direct from a typewriter console, from magnetic tape previously coded by typing keystroke sequences, or from punched paper tapes prepared by a Flexowriter or similar machine.

PRINTER

The input to the printer 36 from the computer 30 is the binary coded x-y location of the character to be printed. This coding can be used to position a rectangular flat, cylindrical or belted array of type so that the character selected is located below the place on the paper which is to be typed. A hammer mechanism can then strike the type to force it to print the image by transferring ink from a ribbon to the paper in the usual manner. Additionally, a printer such as that shown in U.S. Pat. No. 3,820,644 to Chan-Hue Yeh which converts a digitalized character to 120 hexadecimal digit code units may be utilized.

An example of a printer which may be utilized with the present system is shown in FIGS. 16 through 19.

The output printer 36 as shown in FIGS. 15 through 19 is integral with the input terminal 32 and keyboard 34. A conventional moving electrical carriage 38 includes a paper roller 40, a spacer lever 42 and manual advance knobs 44. Control of the carriage position is achieved by the conventional control keys on the keyboard 34. The paper roller 40 is of conventional rubber construction having a support shaft 46 as shown in FIGS. 17 and 18. A typewriter ribbon 48 passes below the paper roller 40 to permit imprinting a character onto a sheet of paper 50 which is being transported by the carriage 38 in the manner of conventional typewriters.

A typing head assembly 52 provides the desired ideograph and positions it under the typing location at the intersection of the paper roller 40 and a cylindrical typing head 54 which has angularly spaced apart rows of ideograph image blocks 56 embedded therein. A hollow stationary support shaft 58 permits the cylindrical typing head 54 to translate and rotate under the paper roller 40 as indicated in FIGS. 16, 17 and 18. The cylindrical typing head 54 is formed of a relatively flexible elastomeric material such as polyvinyl or a silicone rubber and is mounted at its opposite end on support flanges 60 with bores 62 as shown in FIG. 17 to provide a bearing surface which slides back and forth and rotates on the stationary shaft 58.

Driven gears 64 are fixed to the support flanges 60 and are positioned by driving gears 66 mounted on rotatable shaft 68. A longitudinal slot 70 on the outer surface of the rotatable shaft permits splines 72 on the driving gears 66 as shown in FIG. 17 to be translated axially along the shaft while causing the driving gears to rotate with the shaft. Translation of the driving gears along the rotatable shaft 68 is caused by a carrier 74 having clips 76 mounted at the ends thereof and having arms 78 which extend along opposite sides of the driving gears to cause the driving gears to translate as the carrier is translated.

A conventional x-y position indicator 80 rotates the rotatable shaft 68 to the desired position in accordance with a binary input from the computer 30 through lead-in wires 82 and translates the carrier 74 with a continuous flexible ribbon 84 which is fixed to the carrier by a set screw 86 shown in FIGS. 17 and 18. The flexible ribbon 84 is translated to the desired position by a binary input from the computer 30.

As shown in FIG. 19, the ideograph blocks 56 are generally square and have the desired ideograph type 88 on their upper surfaces which can be positioned under the paper 50 on which the image is desired by rotation and translation of the cylindrical typing head 54. The ideograph blocks are retained in the cylindrical typing head by friction or adhesives and are pressed against the typing ribbon 48 by a plunger 90 when a solenoid 92 is actuated after the desired type is positioned as shown in FIG. 17. The flexibility of the cylindrical typing head 54 permits the individual type to be pressed against the paper without causing any of the adjacent type to strike the paper. The ideograph blocks may be formed of metalized plastic or light metal type to reduce the inertia of the system and increase the typing speed of the machine.

The x-y position indicator 80 may include two binary digit locators which receive a twelve binary bit from the computer 30 and through appropriate gearing drive the rotatable shaft 68 to the desired angular position and drive the continuous flexible ribbon 84 to its desired axial position thereby positioning the desired ideograph in the typing position where the plunger 90 may strike the back of the ideograph block to force it against the paper 50.

The operation of the printer includes placing the sheet of paper 50 in the carriage 38 in the normal fashion. Printing will, however, occur on the bottom of the roller rather than on the front as on a conventional typewriter. A sequence of keystrokes is typed on keyboard 34 as described earlier to identify the desired ideographic character uniquely. When this has been achieved, the computer 30 will provide a binary signal to the x-y position indicator 80 which will rotate the rotatable shaft 68 to the column of type containing the desired character and will translate the flexible ribbon 84 to move the carrier 74 and therefore the cylindrical type head until the type containing the desired character is positioned in the typing position over the plunger 90. The solenoid 92 is then actuated to force the desired ideograph block 56 against the ribbon 48 thereby imprinting the paper 50 with the desired character. The characters are typed on their sides from left to right; therefore, when the paper has been removed, they will read from top to bottom, right to left. After the desired characters have been typed, the paper may be removed from the typewriter.

From the foregoing detailed description, it will be evident that there are a number of changes, adaptations and modifications of the present invention which will come within the providence of those skilled in the art. However, it is intended that all such variations not departing from the spirit of the invention be considered as within the scope thereof and as limited solely by the appended claims.

I claim:

1. An input-output typing machine for selecting and printing desired ideographs from a list of available ideographs comprising means for storing information representing at least a portion of the phonetic spelling of the commonly used names of the ideographs and for storing information representing a descriptive characteristic of each ideograph in the list of available ideographs to uniquely identify each available ideograph, means for inputing information representing at least a portion of the phonetic spelling of a desired ideograph, means for inputing information representing the descriptive characteristic of the desired ideograph, means for comparing the information representing the phonetic spelling and descriptive characteristic of the desired ideograph with the stored information of the available ideographs, means for selecting the desired ideograph based on the stored information and the input information and means for visually reproducing the selected ideograph thereby permitting the use of a conventional keyboard by a person without special training to uniquely identify and print each desired ideograph.

2. The machine of claim 1 wherein the means for reproducing includes means for retaining and moving a sheet to receive the imprint of an ideograph type; a cylindrical type head having a flexible outer cylinder and mounted for translation and rotation adjacent said sheet; ideograph type fixed to the outer surface of the cylinder; means for translating the cylinder axially; means for rotating the cylinder about its axis; and means for biasing each ideograph type outwardly into contact with the sheet when the cylinder is translated and rotated to a desired position.

3. The machine of claim 1 wherein the ideographs are Chinese and wherein the phonetic spelling uses standard Peking dialect.

4. The machine of claim 1 wherein the ideographs are Chinese and wherein the descriptive characteristic information includes phonetic symbols to identify the geometric shape of the brush strokes of at least one corner of the ideograph.

5. The machine of claim 1 wherein the descriptive characteristic information includes the commonly used name of the ideograph radicals.

6. The machine of claim 1 wherein the descriptive characteristic information includes the name of parts of the ideographs.

7. The machine of claim 1 wherein the descriptive characteristic information includes the suggested meaning of the ideographs.

8. The machine of claim 1 wherein at least one of the most frequently used ideographs is coded by a single symbol thereby maximizing typing speed.

9. The machine of claim 1 wherein the descriptive characteristic includes the suggested meanings of the ideographs and the descriptive information includes the phonetic spelling of said meaning.

10. The machine of claim 1 wherein said comparing the inputed information representing at least a portion of the phonetic spelling and descriptive characteristic of the desired ideograph includes selecting the homonym group of available ideographs having the same phonetic spelling as the desired ideograph and selecting from said homonym group the ideograph having the inputed descriptive characteristic.

11. The machine of claim 10 wherein the descriptive characteristic includes the commonly used name of the ideograph radicals and the descriptive information includes the phonetic spelling of said commonly used name.

12. The machine of claim 10 wherein the descriptive characteristic includes the names of parts of the ideographs and the descriptive information includes the phonetic spelling of said name.

13. The machine of claim 10 wherein the descriptive characteristic includes the suggested meanings of the ideographs and the descriptive information includes the phonetic spelling of said meaning.

14. The machine of claim 1 wherein the descriptive characteristic includes the commonly used name of the ideograph radicals and the descriptive information includes the phonetic spelling of said commonly used name.

15. The machine of claim 1 wherein the descriptive characteristic includes the names of parts of the ideographs and the descriptive information includes the phonetic spelling of said names.

16. A method for selecting and printing desired ideographs from a list of available ideographs comprising coding the available ideographs by at least a portion of the phonetic spelling of their commonly used names, coding the available ideographs by a descriptive characteristic of each available ideograph, storing the codes as coded information representing the available ideographs, inputing information representing at least a portion of the phonetic spelling of a desired ideograph, inputing information representing the descriptive characteristic of the desired ideograph, comparing the inputed information representing the phonetic spelling and descriptive characteristic of the desired ideograph with the stored coded information of the available ideographs, selecting the desired ideograph based on the stored coded information and the input information and visually reproducing the selected indeograph thereby permitting the use of a conventional keyboard by a person without special training to uniquely identify and print each desired ideograph.

17. The method of claim 16 wherein the descriptive characteristic includes the geometry of the ideographs.

18. The method of claim 16 wherein the descriptive characteristic includes the commonly used name of the ideograph radicals.

19. The method of claim 16 wherein the descriptive characteristic includes the names of parts of the ideographs.

20. The method of claim 16 wherein the descriptive characteristic includes the suggested meanings of the ideographs.

21. The method of claim 17 wherein the ideographs are Chinese and the coding by phonetic spelling uses standard Peking dialect.

22. The method of claim 21 wherein the coding by geometric characteristics uses phonetic symbols to identify the geometric shape of the brush strokes of at least one corner of the ideograph.

23. The method of claim 16 additionally including coding at least one of the most frequently used ideographs by a single key stroke in order to maximize typing speed.

24. The method of claim 16 wherein the descriptive characteristic includes the commonly used name of the ideograph radicals and the descriptive information includes the phonetic spelling of said commonly used name.

25. The method of claim 16 wherein the descriptive characteristic includes the name of part of the ideograph and the descriptive information includes the phonetic spelling of said name.

26. The method of claim 16 wherein the descriptive characteristic includes the suggested meaning of the ideographs and the descriptive information includes the phonetic spelling of said meaning.

27. The method of claim 16 wherein said comparing the inputed information representing at least a portion of the phonetic spelling and descriptive characteristic of the desired ideograph includes selecting the homonym group of available ideographs having the same phonetic spelling as the desired ideograph and selecting from said homonym group the ideograph having the inputed descriptive characteristic.

28. The method of claim 27 wherein the descriptive characteristic includes the commonly used name of the ideograph radicals and the descriptive information includes the phonetic spelling of said commonly used name.

29. The method of claim 27 wherein the descriptive characteristic includes the name of part of the ideographs and the descriptive information includes the phonetic spelling of said name.

30. The method of claim 27 wherein the descriptive characteristic includes the suggested meaning of the ideograph and the descriptive information includes the phonetic spelling of said meaning.

* * * * *